US006939666B2

(12) United States Patent
Matsumoto

(10) Patent No.: US 6,939,666 B2
(45) Date of Patent: Sep. 6, 2005

(54) HEAT-DEVELOPABLE COLOR PHOTOSENSITIVE MATERIAL

(75) Inventor: Kazuhiko Matsumoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/408,351

(22) Filed: Apr. 8, 2003

(65) Prior Publication Data

US 2003/0224302 A1 Dec. 4, 2003

(30) Foreign Application Priority Data

Apr. 8, 2002 (JP) ..... 2002-105173
Aug. 23, 2002 (JP) ..... 2002-243771

(51) Int. Cl.[7] ..... G03C 1/46; G03C 1/76; G03C 7/32

(52) U.S. Cl. ..... 430/505; 430/531; 430/534; 430/536; 430/543; 430/546; 430/566

(58) Field of Search ..... 430/505, 531, 430/536, 534, 566, 543, 546

(56) References Cited

U.S. PATENT DOCUMENTS 5,747,231 A 5/1998 Sato et al.
6,379,876 B1 * 4/2002 Irving et al. ..... 430/350

FOREIGN PATENT DOCUMENTS

| | | | | |
|---|---|---|---|---|
| JP | 6-95321 A | | 4/1994 | |
| JP | 8-62757 A | | 3/1996 | |
| JP | 8-129252 A | | 5/1996 | |
| JP | 08-129252 | * | 5/1996 | ..... G03C/8/40 |

* cited by examiner

*Primary Examiner*—Thorl Chea
(74) *Attorney, Agent, or Firm*—Birch, Stewart, Kolasch & Birch, LLP

(57) ABSTRACT

A heat-developable color photosensitive material of single sheet type, which comprises a support having provided thereon at least light-sensitive silver halide, a color developing agent or a precursor thereof, dye-forming couplers capable of forming dyes by reacting with an oxidation product of the color developing agent, a reducible silver salt, a thermal solvent and a binder, wherein a water-insoluble thermoplastic polymer prepared by polymerizing at least one kind of monomer is included in layers containing the dye-forming couplers, thereby preventing the dyes formed from bleeding to ensure high sharpness and making an improvement in raw-stock storability.

11 Claims, No Drawings

HEAT-DEVELOPABLE COLOR PHOTOSENSITIVE MATERIAL

FIELD OF THE INVENTION

The present invention relates to a heat-developable color photosensitive material, and more specifically, to a heat-developable color photosensitive material ensuring high sharpness and having excellent storability before development (raw-stock storability).

BACKGROUND OF THE INVENTION

Methods of forming images by heat development are described, e.g., in U.S. Pat. Nos. 3,152,904 and 3,457,075, and D. Klosterboer, *Thermally Processed Silver Systems* (chap. 9, p. 279, in the book entitled "Imaging Processes and Materials", compiled by J. Sturge, V. Walworth & A. Shepp, 8th ed., published by Neblette in 1989). In general a heat-developable photosensitive material contains a reducible light-insensitive silver source (e.g., an organic silver salt), a catalytically active amount of photocatalyst (e.g., silver halide) and a silver-reducing agent in an organic binder matrix-dispersed condition. Such a heat-developable photosensitive material is stable at room temperature, but it produces silver through an oxidation-reduction reaction between a reducible silver source (functioning as an oxidizing agent) and a reducing agent when heated at a high temperature (e.g., at least 80° C.) after exposure. This oxidation-reduction reaction is accelerated by a catalytic action of latent images formed under exposure. The reducible silver salt produces silver through the reaction in exposed areas, and thereby the exposed areas are blackened and stand in contrast to unexposed areas. Thus image formation is effected.

On the other hand, the most common method of color-image formation for photographic light-sensitive materials is a method of utilizing coupling reaction between a coupler and an oxidized color developing agent. JP-A-9-10506 (the term "JP-A" as used herein refers to an "unexamined published Japanese patent application") and European Patent No. 762,201 disclose methods of the type which forms color images in a photosensitive material by supplying a small amount of water to a light-sensitive element wherein a developing agent and couplers are incorporated, pasting the light-sensitive element to an image-receiving element containing a base precursor, and then heating these elements to cause development reaction therein. In addition, U.S. Pat. Nos. 3,761,270, 4,021,240, 4,426,441 and 4,435,499, JP-A-59-231539 and JP-A-60-128438 disclose the heat-developable color photosensitive materials in which image formation is effected by heating treatment alone and does not require such a complex constitution as to include incorporation of a base precursor and supply of a small amount of water. In those patents, p-sulfonamidophenol, ureidoaniline and sulfonylhydrazone are used as color developing agents. The photosensitive materials utilizing the coupling system have a sensitivity advantage because couplers have no absorption in the visible region before processing, and it is a considerable point in their favor that they can be used as not only printing materials but also picture-taking materials.

Moreover, JP-A-9-204031, JP-A-2000-171914, JP-A-2000-40590 and JP-A-2002-169233 propose systems of the type which includes forming color images on a picture-taking sensitive material, reading the color images at once with a scanner to digitize them and printing positive images onto another material by using the digitized image information.

When the heat-developable photosensitive materials are used as picture-taking sensitive materials in those simple-and-rapid negative printing systems, the processing is simple and rapid, and besides, it requires no complicated management of processing solutions, compared with conventional picture-taking materials. In addition, the heat-developable photosensitive materials enable simplification and miniaturization of processing machines, so have an advantage of permitting processing machines to be placed anywhere. Therefore, realization of heat-developable color photosensitive materials ensuring high-quality images has been desired.

In many cases, thermal solvents are used in those heat-developable photosensitive materials for the purpose of increasing developed-color densities through improvements in thermal decomposition rates of precursors of color developing agents and mobility of incorporated color developing agents. It is thought that, when developing the photosensitive materials by heating, the precursors of color developing agents are dissolved in the fused thermal solvents and the thermal decomposition rates thereof are increased, and besides, the color developing agents released from the precursors are also dissolved in the fused thermal solvents and their diffusion in binder matrices are speeded up. However, there is apprehension that color images spread and become blurred at the time of heating because couplers and dyes produced by reaction between the couplers and the oxidized color developing agents are also dissolved in the fused thermal solvents. It is therefore important in preventing the spreading of dye images to search thermal solvents having high compatibility with color developing agents as well as their precursors and low compatibility with couplers and color-developed dyes. Hitherto, thermal solvents have been studied mainly to assess their effects in applying them to the methods of positively diffusing and transferring dyes formed or released by development reaction in forming color images, as in U.S. Pat. No. 5,843,618, JP-B-6-82209 (the term "JP-B" as used herein refers to an "examined published Japanese patent application") and Japanese Patent Nos. 2,700,808, 2,711,339 and 2,711,340. On the other hand, there has been known practically no study on suitability of thermal solvents in the cases of using heat-developable photosensitive materials as picture-taking materials. Therefore, there is little information as to thermal solvents that have high development activity and hardly cause the spreading of dyes by diffusion, so the problem of blurred color images is difficult to solve by use of previous knowledge. Under these circumstances, simple alternative proposals have been sought.

Further, as described in the patents cited above, it is common knowledge in the field that the selection of what kind of thermal solvent to use affects greatly the raw-stock storability of a photosensitive material. And the above-cited patents also have a description that the raw-stock storability, especially the raw-stock storability under high-humidity conditions, is higher in the case of using a lipophilic, solid dispersion-capable thermal solvent. However, the inventors' study has revealed that the lopophilic, solid dispersion-capable thermal solvents were apt to cause spreading of dyes because of their high compatibility with lipophilic couplers and dyes formed by reaction between lipophilic couplers and oxidized color developing agents.

When heat-developable photosensitive materials are used for picture-taking purpose, the spreading of dyes causes serious deterioration in sharpness of prints, and so it is in need of improvement.

SUMMARY OF THE INVENTION

Therefore, the invention aims to provide a mono-sheet, heat-developable photosensitive material that hardly causes deterioration of sharpness due to the spreading of dyes produced by development reaction, and what is more, undergoes reduced deterioration in quality of images obtained after storage in a raw-stock (virgin) state.

The aim of the invention is attained with (1) a heat-developable color photosensitive material comprising a support having provided thereon at least a light-sensitive silver halide, a color developing agent or a precursor thereof, dye-forming couplers capable of forming dyes by reacting with an oxidation product of the color developing agent, a reducible silver salt, a thermal solvent and a binder, wherein a water-insoluble thermoplastic polymer prepared by polymerizing at least one kind of monomer is included in layers containing the dye-forming couplers.

In the invention, it is preferable to incorporate a water-insoluble thermoplastic polymer prepared by polymerizing at least one kind of monomer into the same layer as the foregoing various ingredients are contained in addition to a dye-forming coupler. And it is difficult to anticipate from previous knowledge that the combined use of these compounds can achieve at a time reduction in both deterioration of sharpness due to the spreading of dyes and deterioration of quality of images obtained after storage in a raw-stock state.

The aim of the invention can be achieved more effectively by the following heat-developable color photosensitive materials (2) to (5):

(2) A heat-developable color photosensitive material as described in the above-mentioned (1), wherein the thermal solvent is a water-insoluble solvent and contained as a solid microcrystalline dispersion.

(3) A heat-developable color photosensitive material as described in the above-mentioned (1) or (2), wherein the water-insoluble thermoplastic polymer contains aromatic group-containing monomer units of at least one kind as constituents thereof.

(4) A heat-developable color photosensitive material as described in the above-mentioned (3), wherein the water-insoluble thermoplastic polymer has a molecular weight of 10,000 or more.

(5) A heat-developable color photosensitive material as described in the above-mentioned (3) or (4), wherein the water-insoluble thermoplastic polymer is a polymer containing monomer units derived from at least one of styrene, α-methylstyrene and β-methylstyrene as constituents thereof.

DETAILED DESCRIPTION OF THE INVENTION

[I] Constituents of Heat-Developable Color Photosensitive Material

(A) Water-Insoluble Thermoplastic Polymers

Water-insoluble thermoplastic polymers used suitably in the invention are described below.

The term "water-insoluble polymers" as used in the invention refers to the polymers substantially insoluble in water. By quantitative definition, the water-insoluble polymers are polymers whose solubility in water is 1 weight % or below, preferably 0.1 weight % or below, at room temperature. Unless otherwise sated, the units "weight %" and "weight ratio" as used herein are by mass.

The suitable monomers forming the polymers are vinyl monomers. It is appropriate for the polymers to have weight average molecular weight not higher than 200,000, preferably not higher than 20,000, more preferably 10,000 from the viewpoint of their sensitivity to a change in temperature at time of heat development. As to the lower limit of weight average molecular weight, the polymers have no particular restriction, but it is appropriate for them to have weight average molecular weight of at least 1,000. Each of polymers used in the invention may be the so-called a homopolymer produced from one kind of monomer or a copolymer produced from two or more different kinds of monomers. In the invention, it is preferable to use polymers having as their constituents at least one kind of aromatic group-containing monomer units. When the polymers used are copolymers, it is preferable that aromatic group-containing monomer units constitute at least 50 weight % of each copolymer.

The polymers have no particular restriction as to their structures so far as they meet the foregoing conditions, but examples of the polymers having a structural advantage include polymers having repeated units derived from styrene, α-methylstyrene, β-methylstyrene or monomers having substituents (e.g., an alkyl group, an alkoxy group, a halogen atom) on the aromatic rings of these styrenes, and polymers having repeated units derived from aromatic acrylamide, aromatic methacrylamide, aromatic acrylate, or aromatic methacrylate.

In addition, it is also preferable for the polymers to have repeated units derived from aliphatic acrylates, such as methyl methacrylate, ethyl acrylate and n-butyl acrylate, or lipid-soluble acrylamides such as n-butylacrylamide. When the aliphatic acrylates or lipid-soluble acrylamides are used for producing polymers, it is appropriate that the polymers have their weight average molecular weight in the range of 10,000 to 500,000 preferably 30,000 to 200,000

Of the polymers recited above, the polymers derived from styrene, α-methylstyrene or β-methylstyrene are preferred in particular from the viewpoints of availability and storage stability of polymer emulsion. The suitable proportion of the polymer to a dye-forming coupler incorporated in the same layer is from 1 to 1,000% by weight, preferably from 10 to 200% by weight.

Examples of polymers used in the invention are illustrated below, but it should be understood that these examples are not to be construed as limiting the scope of the invention in any way.

P-1

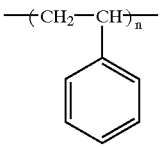

P-2

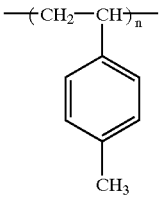

P-3

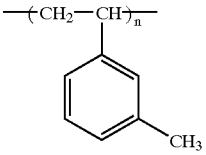

-continued
P-4
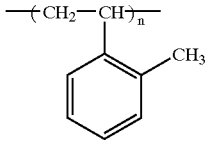
P-5
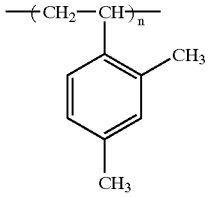
P-6
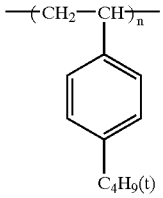
P-7
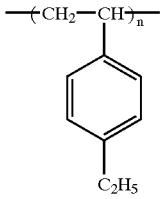
P-8
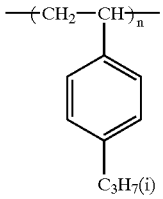
P-9
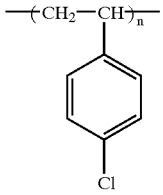
P-10
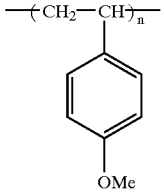
P-11
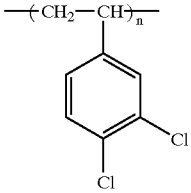
-continued
P-12
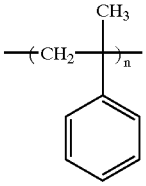
P-13
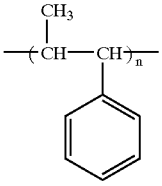
P-14
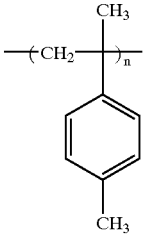
P-15
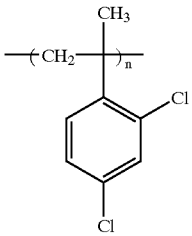
P-16
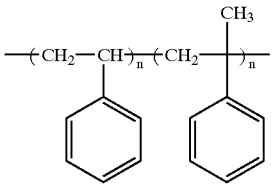
P-17
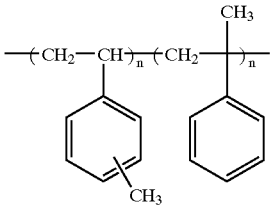
P-18
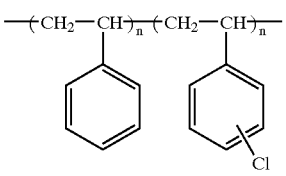

-continued
P-19
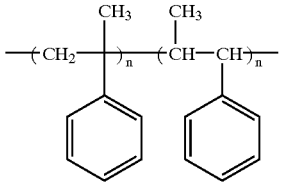
P-20
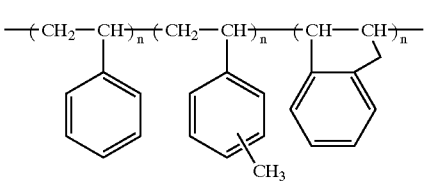
P-21
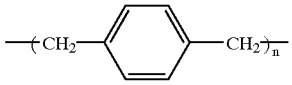
P-22
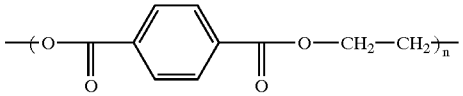
P-23
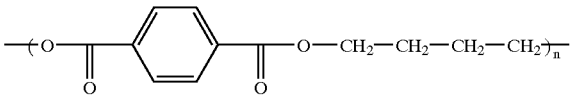
P-24
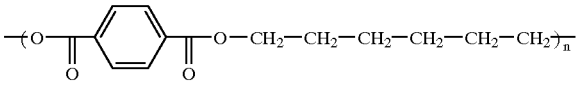
P-25
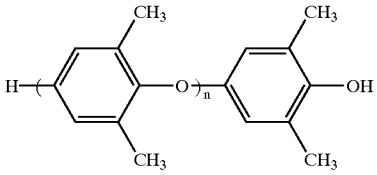
P-26
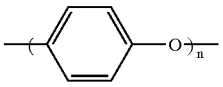
P-27
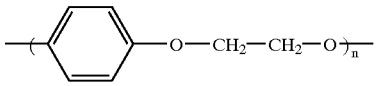
P-28
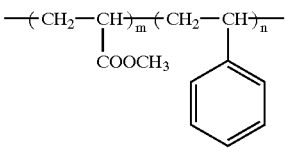
P-29
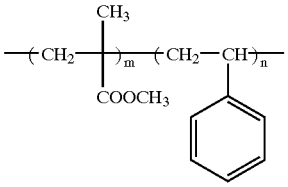
-continued
P-30
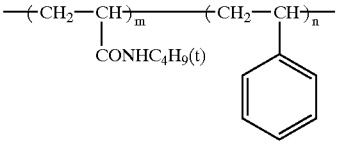
P-31
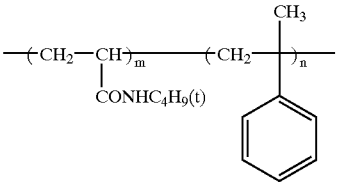
P-32
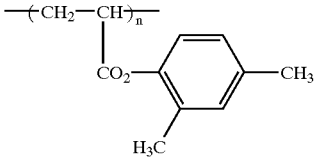
P-33
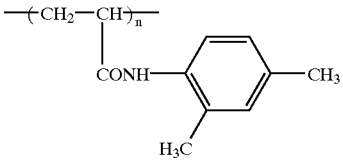
P-34
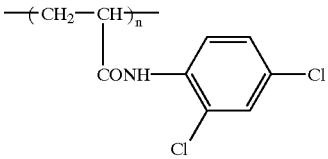
P-35
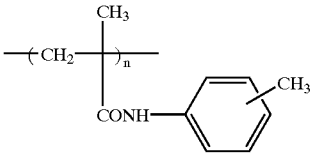
P-36
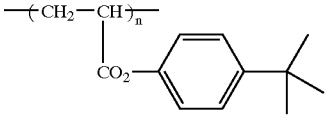
P-37
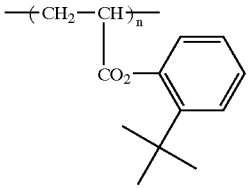
P-38
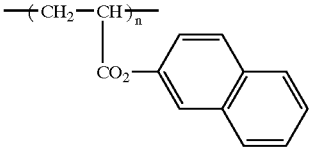

-continued
P-39
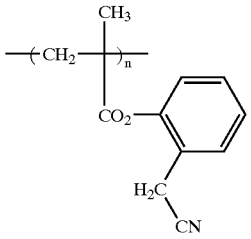
P-40
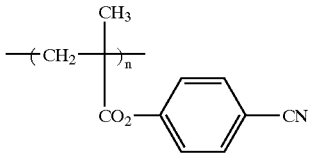
P-41
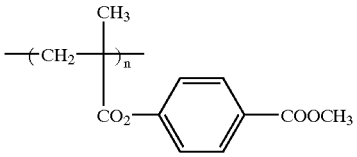
P-42
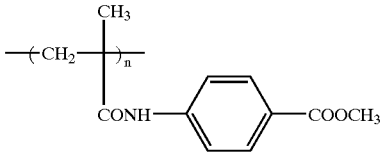
P-43
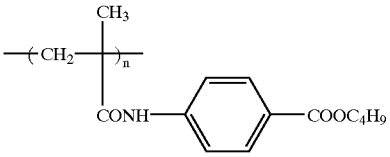
P-44
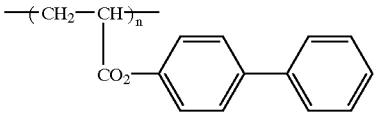
P-45
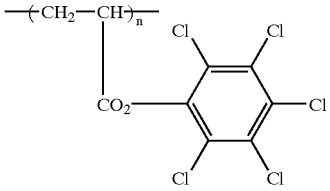
P-46
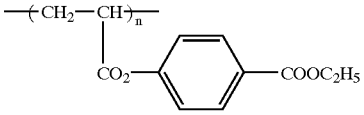
P-47
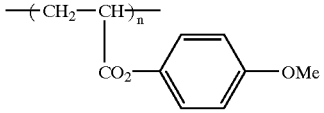
P-48
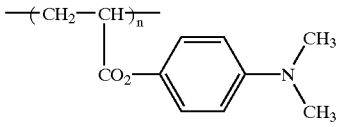
-continued
P-49
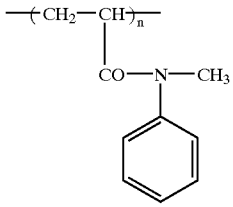
P-50
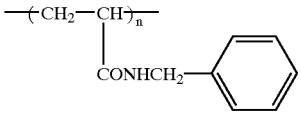
P-51
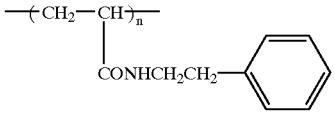
P-52
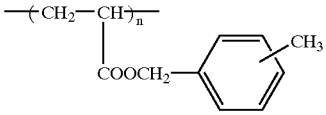
P-53
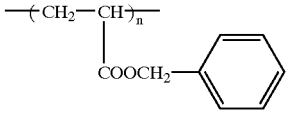
P-54
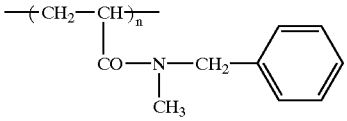
P-55
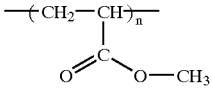
P-56
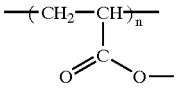
P-57
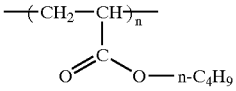
P-58
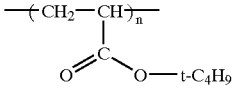
P-59
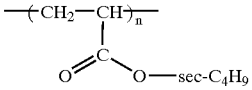
P-60
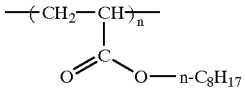
P-61
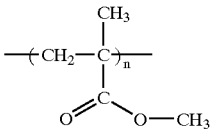

-continued

P-62

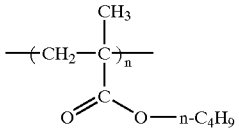

P-63

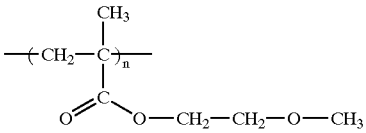

P-64

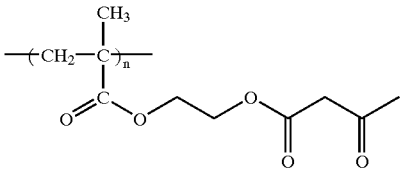

P-65

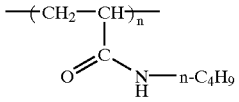

P-66

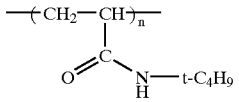

P-67

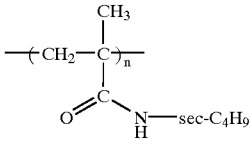

P-68

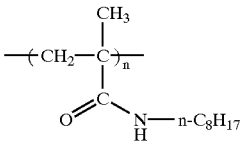

When those polymers are used in the invention, they can be introduced into constituent layers of a heat-developable photosensitive material in a known manner as in the case of introducing hydrophobic additives described hereinafter. Further, as mentioned already, the polymers are preferably introduced into the same layers as couplers, and are introduced, more preferably as emulsions in which the couplers are also present.

(B) Thermal Solvents

The thermal solvents used in the invention are defined as organic materials that are in a solid state at ambient temperatures, but melt at temperatures adopted for heat treatment or below when mixed with other ingredients and come to have the function of promoting heat development and thermal transfer of dyes through liquefaction at time of heat development. Examples of organic materials useful as thermal solvents include compounds usable as solvents of developers, compounds having high dielectric constants and promoting physical development of silver salts, and compounds which are compatible with binders and cause swelling of binders.

The thermal solvents preferred in the invention are compounds having low solubility in water and capable of being incorporated as microcrystalline dispersions in photosensitive materials. Examples of such thermal solvents include the compounds disclosed in U.S. Pat. Nos. 3,347,675, 3,667,959, 3,438,776 and 3,666,477, *Research Disclosure*, No. 17,643, JP-A-51-19525, JP-A-53-24829, JP-A-53-60223, JP-A-58-118640, JP-A-58-198038, JP-A-59-229556, JP-A-59-68730, JP-A-59-84236, JP-A-60-191251, JP-A-60-232547, JP-A-60-14241, JP-A-61-52643, JP-A-62-78554, JP-A-62-42153, JP-A-62-44737, JP-A-63-53548, JP-A-63-161446, JP-A-1-224751, JP-A-2-863, JP-A-2-120739 and JP-A-2-123354. More specifically, materials having low solubility in water and high suitability for microcrystalline dispersion are selected from urea derivatives (such as phenylmethylurea), amide derivatives (such as acetamide, stearylamide, p-toluamide and p-propanoyloxyethoxybenzamide), sulfonamide derivatives (such as p-toluenesulfonamide) or polyhydric alcohol compounds (such as high-molecular polyethylene glycols) and used as thermal solvents.

The suitable water solubility of a thermal solvent for heightening the dispersion stability of a microcrystalline dispersion is 1 g/m$^3$ or below, preferably $10^{-3}$g/m$^3$ or below.

The suitable melting temperature of a thermal solvent used in the invention is from 90° C. to the chosen development temperature.

The suitable amount of a thermal solvent used is from 1 to 200 weight %, preferably from 5 to 50 weight %, of the binder coverage.

Examples of representative thermal solvents usable in the invention and melting points thereof are shown below, but these examples should not be construed as limiting the scope of the invention in any way.

TS-1

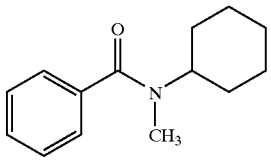

mp. 76° C.

TS-2

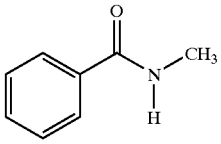

mp. 76° C.

TS-3

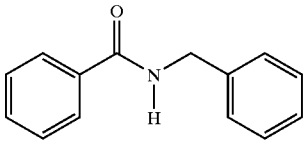

mp. 104° C.

TS-4

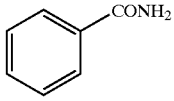

mp. 128° C.

TS-5

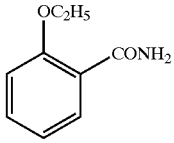

mp. 131° C.

-continued

TS-6

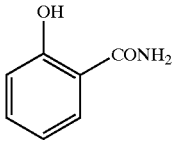

mp. 140° C.

TS-7

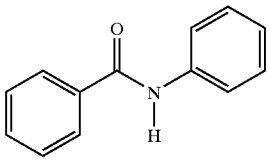

mp. 164° C.

TS-8

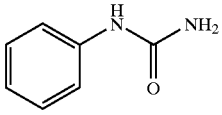

mp. 146° C.

TS-10

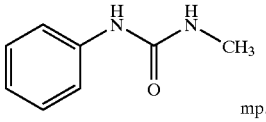

mp. 149° C.

TS-11

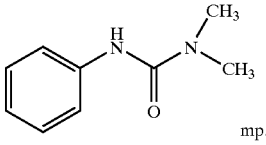

mp. 134° C.

TS-12

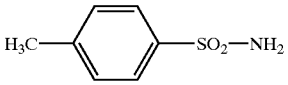

mp. 139° C.

TS-13

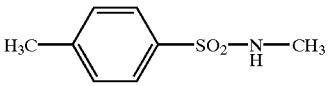

mp. 80° C.

TS-14

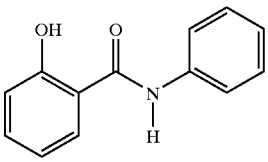

TS-15

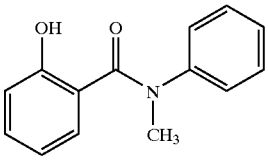

TS-16

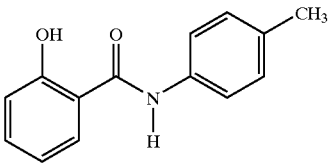

-continued

TS-17

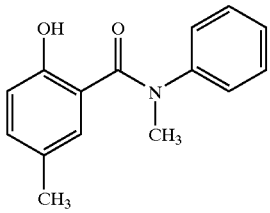

(C) Color Developing Agent and Precursors Thereof

The present heat-developable photosensitive material can produce dye images by having, on a support, image-forming layers which each contain a binder and a reducible silver salt, preferably an organic silver salt, and beside these image-forming layers at least three kinds of light-sensitive silver halide emulsion layers (light-sensitive layers) which contain light-sensitive silver halides, respectively, and differ in wavelength region of light to which they each have sensitivity and/or absorption wavelength region of the dye formed therein from an oxidized color developing agent and a coupler.

The color developing agent or its precursor contained in the present heat-developable photosensitive material is a compound having practically no absorption in the visible region. Such an agent contributes to formation of silver image by acting as a reducing agent by itself or releasing a reducing agent when the present heat-developable photosensitive material undergoes heat development, and the agent itself is converted into an oxidized compound or the reducing agent released is converted into an oxidized compound. These oxidized compounds produce dyes by reaction with coupler compounds and dye images are formed according imagewise to silver images.

Examples of color developing agents include p-phenylenediamines and p-aminophenols. Preferable examples thereof include the sulfonamidophenols disclosed in JP-A-8-110608, JP-A-8-122994, JP-A-9-15806 and JP-A-9-146248, the sulfonylhydrazines disclosed in EP-A-545491, JP-A-8-166664 and JP-A-8-227131, the carbamoylhydrazines disclosed in JP-A-8-286340, the sulfonylhydrazones disclosed in JP-A-8-202002, JP-A-10-186564 and JP-A-10-239793, the carbamoylhydrazones disclosed in JP-A-8-234390, the sulfaminic acids disclosed in JP-A-63-36487, the sulfohydrazones disclosed in JP-B-4-20177, the 4-sulfonamidopyrazolones disclosed in JP-B-5-48901, the p-hydroxyphenylsulfaminic acids disclosed in JP-B-4-69776, the sulfaminic acids having alkoxy groups on their respective benzene rings as disclosed in JP-A-62-227141, the hydrophobic salts formed from amino group-containing color developing agents and organic acids as disclosed in JP-A-3-15052, the hydrazones disclosed in JP-B-2-15885, the ureidoanilines disclosed in JP-A-59-111148, the sulfamoylhydrazones disclosed in U.S. Pat. No. 4,430,420, the sulfonylaminocarbonyl or acylaminocarbonyl group-containing aromatic primary amine developing agent derivatives disclosed in JP-B-3-74817, the compounds releasing aromatic primary amine developing agents by a reverse Mickael reaction as disclosed in JP-A-62-131253, the fluorine-substituted acyl group-containing aromatic primary amine developing agent derivatives disclosed in JP-B-5-33781, the alkoxycarbonyl group-containing aromatic primary amine developing agent derivatives disclosed in JP-B-5-33782, the oxalic acid amide type of aromatic primary amine developing agent derivatives disclosed in JP-A-63-8645, and the Schiff base type of aromatic primary amine developing agent derivatives disclosed in JP-A-63-123043. Of these compounds, the sufonamidophenols disclosed in JP-A-8-110608, JP-A-8-122994, JP-A-8-146578, JP-A-9-15806 and JP-A-9-146248, the carbamoylhydrazines disclosed in JP-A-8-286340 and the aromatic primary amine developing agent derivatives disclosed in JP-B-3-74817 and JP-A-62-131253 are preferred over the others.

In the invention, the aromatic primary amine derivative-type developing agents and precursors thereof are used to particular advantage. Suitable precursors of the aromatic primary amine derivative-type developing agents are p-phenylenediamine derivatives blocked with blocking groups, and it is preferable for the p-phenylenediamine moieties of them to have formula weights of at least 300. In addition, it is favorable that the p-phenylenediamine derivatives whose blocking groups are replaced by hydrogen atoms have oxidation potentials of 5 mV or lower (vs SCE) in water of pH 10.

As the foregoing blocking groups can be used known ones. Suitable examples of blocking groups include such blocking groups as the acyl and sulfonyl groups disclosed in JP-B-48-9968, JP-A-52-8828, JP-A-57-82834, U.S. Pat. No. 3,311,476 and JP-B-47-44805 (corresponding to U.S. Pat. No. 3,615,617), the blocking groups utilizing a reverse Mickael reaction as disclosed in JP-B-55-17369 (corresponding to U.S. Pat. No. 3,888,677), JP-B-55-9696 (corresponding to U.S. Pat. No. 3,791,830), JP-B-55-34927 (corresponding to U.S. Pat. No. 4,009,029), JP-A-56-77842 (corresponding to U.S. Pat. No. 4,307,175), JP-A-59-105640, JP-A-59-105641 and JP-A-59-105642, the blocking groups utilizing the formation of quinonemethides or compounds analogous thereto through intramolecular electron transfer as disclosed in JP-B-54-39727, U.S. Pat. Nos. 3,674,478, 3,932,480 and 3,993,661, JP-A-57-135944, JP-A-57-135945 (corresponding to U.S. Pat. No. 4,420,554), JP-A-57-136640, JP-A-61-196239, JP-A-61-196240 (corresponding to U.S. Pat. No. 4,702,999), JP-A-61-185743, JP-A-61-124941 (corresponding to U.S. Pat. No. 4,639,408) and JP-A-2-280140, the blocking groups utilizing intramolecular nucleophilic displacement reactions as disclosed in U.S. Pat. Nos. 4,358,525 and 4,330,617, JP-A-55-53330 (corresponding to U.S. Pat. No. 4,310,612), JP-A-59-121328, JP-A-59-219439 and JP-A-63-318555 (corresponding to EP-A-0295729), the blocking groups utilizing ring cleavage reactions of 5- or 6-membered rings as disclosed in JP-A-57-76541 (corresponding to U.S. Pat. No. 4,335,200), JP-A-57-135949 (corresponding to U.S. Pat. No. 4,350,752), JP-A-57-179842, JP-A-59-137945, JP-A-59-140445, JP-A-59-219741, JP-A-59-202459, JP-A-60-41034 (corresponding to U.S. Pat. No. 4,618,563), JP-A-62-59945 (corresponding to U.S. Pat. No. 4,888,268), JP-A-62-65039 (corresponding to U.S. Pat. No. 4,772,537), JP-A-62-80647, JP-A-3-236047 and JP-A-3-238445, the blocking groups utilizing addition reaction of nucleophilic agents to conjugated unsaturated bonds as disclosed in JP-A-59-201057 (corresponding to U.S. Pat. No. 4,518,685), JP-A-61-43739 (corresponding to U.S. Pat. No. 4,659,651), JP-A-61-95346 (corresponding to U.S. Pat. No. 4,690,885), JP-A-61-95347 (corresponding to U.S. Pat. No. 4,892,811), JP-A-64-7035, JP-A-4-42650 (corresponding to U.S. Pat. No. 5,066,573), JP-A-1-245255, JP-A-2-207249, JP-A-2-235055 (corresponding to U.S. Pat. No. 5,118,596) and JP-A-4-186344, the blocking groups utilizing β-elimination reactions as disclosed in JP-A-59-93442, JP-A-61-32839, JP-A-62-163051 and JP-B-5-37299, the blocking groups utilizing nucleophilic displacement reactions of diarylmethanes as disclosed in JP-A-61-188540, the blocking groups utilizing a Lossen rearrangement reaction as disclosed in JP-A-62-187850, the blocking groups utilizing reactions between N-acylated compounds of thiazolidine-2-thione and amines as disclosed in JP-A-62-80646, JP-A-62-144163 and JP-A-62-147457, the blocking groups which each have two electrophilic groups and react with two nucleophilic agents as disclosed in JP-A-2-296240 (corresponding to U.S. Pat. No. 5,019,492), JP-A-4-177243, JP-A-4-177244, JP-A-4-177245, JP-A-4-177246, JP-A-4-177247, JP-A-4-177248, JP-A-4-177249, JP-A-4-179948, JP-A-4-184337, JP-A-4-184338, WO 92/21064, JP-A-4-330438, WO 93/03419 and JP-A-5-45816, and the blocking groups as disclosed in JP-A-3-236047 and JP-A-3-238445. Of these blocking groups, the blocking groups such as acyl and sulfonyl groups, the blocking groups utilizing a reverse Mickael reaction and the blocking groups which each have two electrophilic groups and react with two nucleophilic agents are preferred over the others.

Examples of color developing agents (or precursors thereof) usable in the invention are illustrated below, but these examples should not be considered as limiting on the scope of the invention. Additionally, the figures affixed respectively to the repeated units in each of the structural formulae of the polymers given as examples are expressed in weight %.

DEVP-1

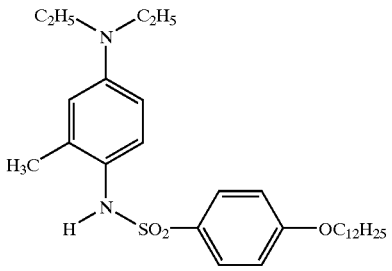

DEVP-2

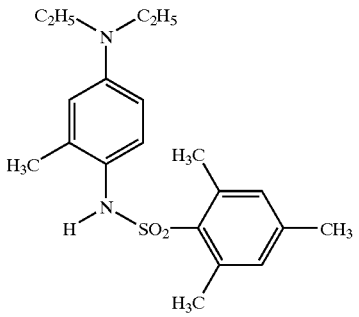

-continued
DEVP-3
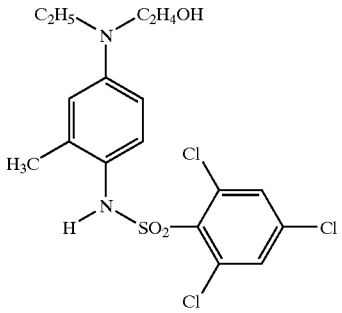
DEVP-4
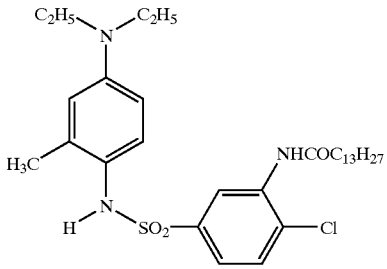
DEVP-5
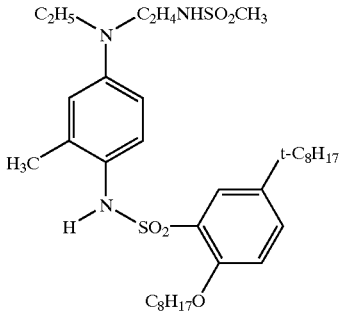
DEVP-6
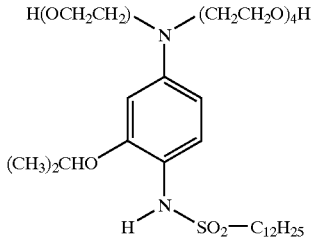
DEVP-7
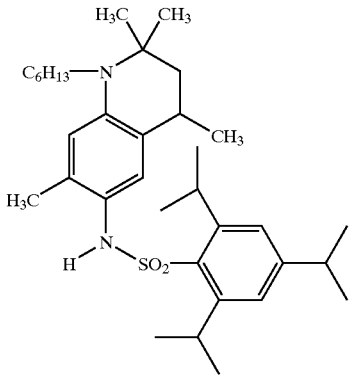
DEVP-8
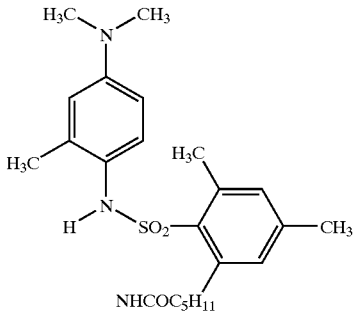
DEVP-9
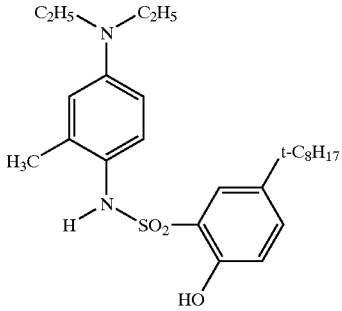
DEVP-10
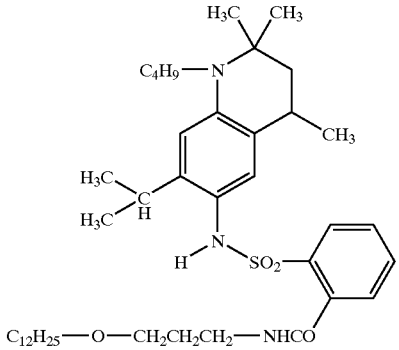

-continued
DEVP-11
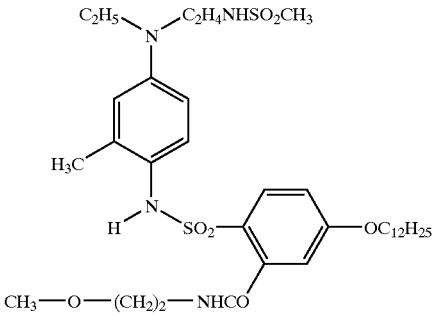
DEVP-12
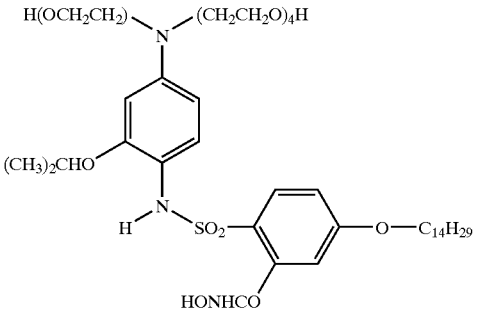
DEVP-13
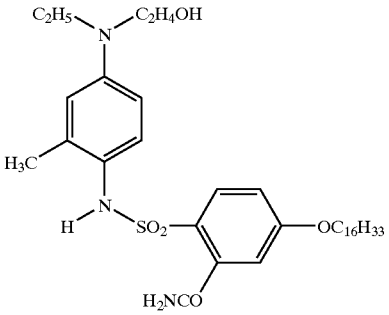
DEVP-14
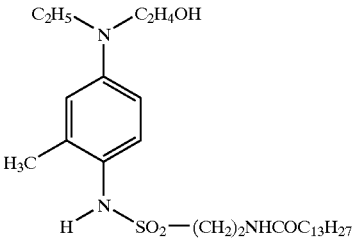
DEVP-15
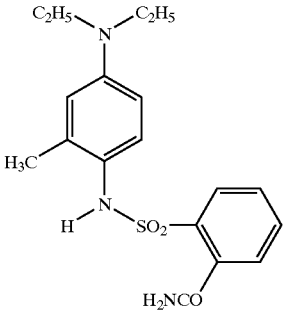
DEVP-16
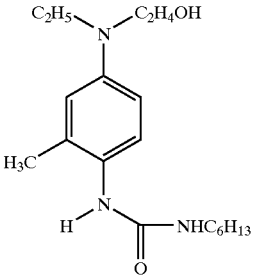
DEVP-17
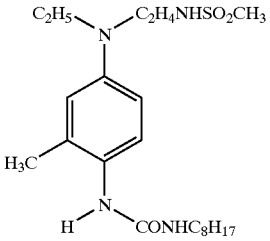
DEVP-18
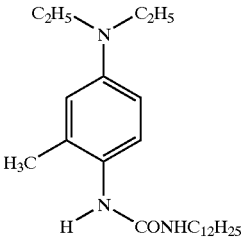
DEVP-19
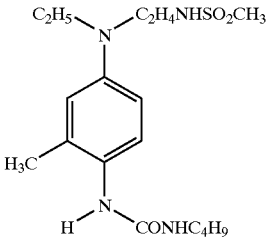
DEVP-20
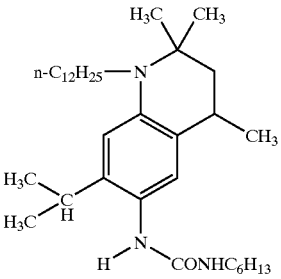

-continued
DEVP-21
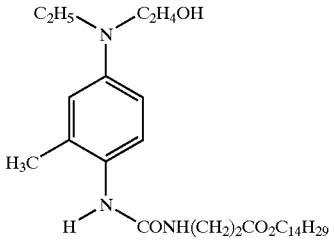
DEVP-22
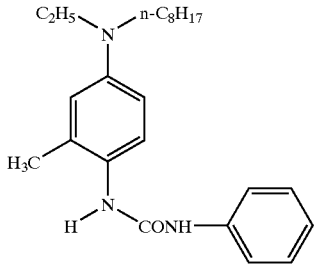
DEVP-23
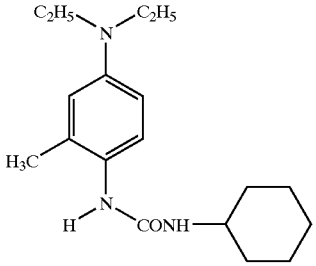
DEVP-24
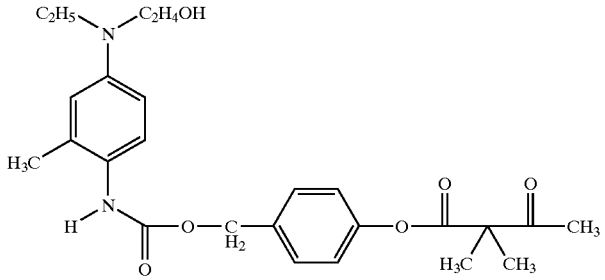
DEVP-25
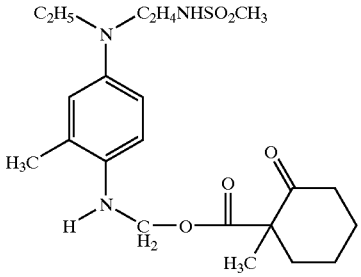
DEVP-26
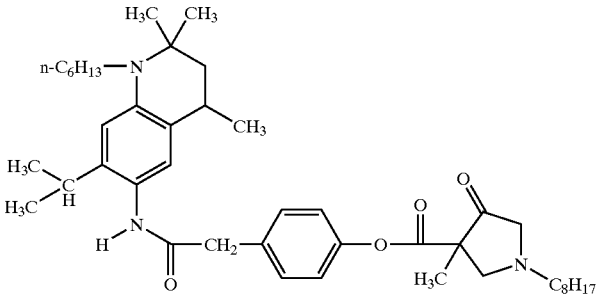
DEVP-27
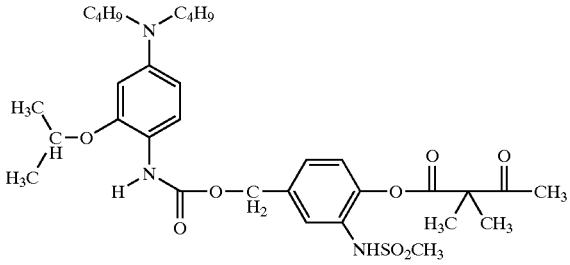
DEVP-28
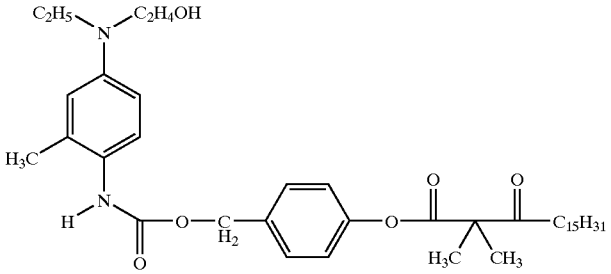
DEVP-29
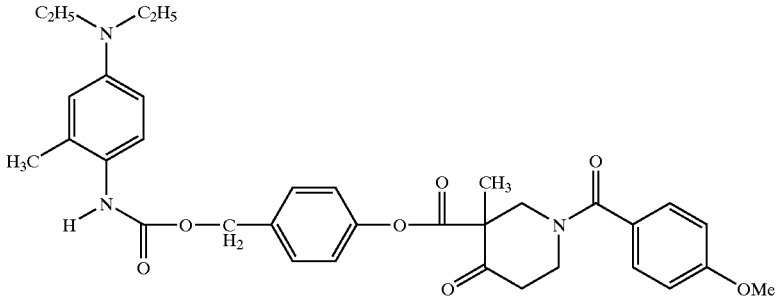

-continued
DEVP-30
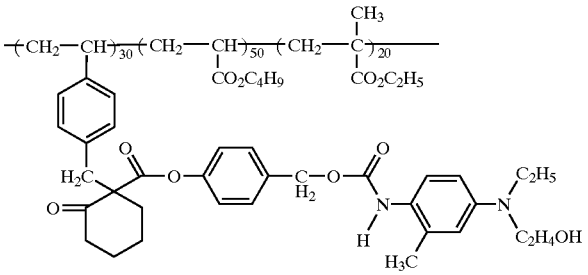
DEVP-31
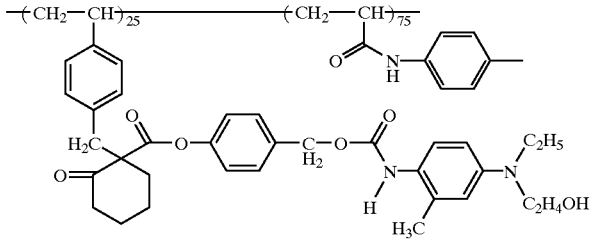
DEVP-32
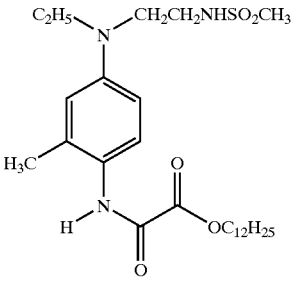
DEVP-33
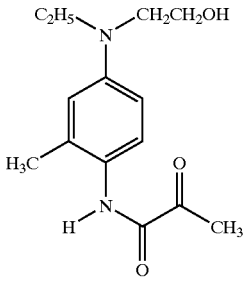
DEVP-34
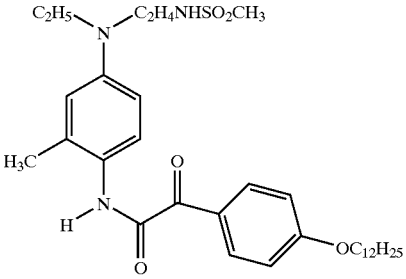
DEVP-35
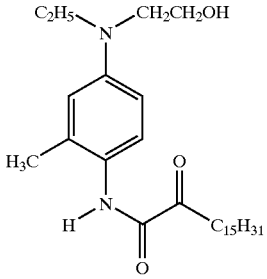
DEVP-36
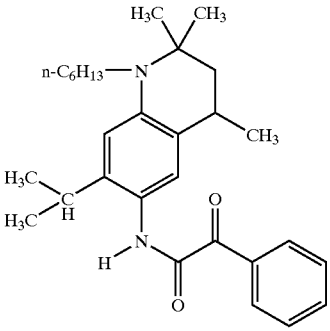
DEVP-37
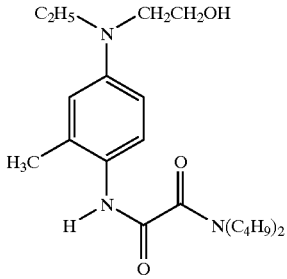
DEVP-32
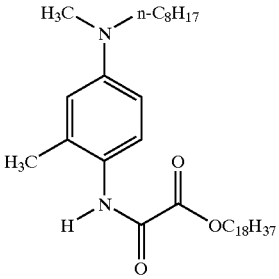
DEVP-39
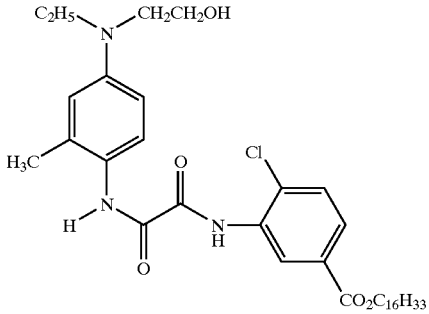

-continued
DEVP-40
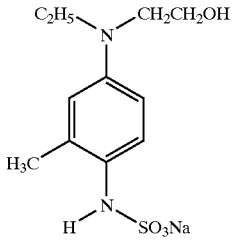
DEVP-41
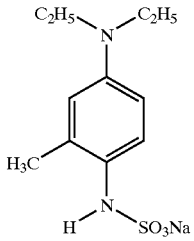
DEVP-42
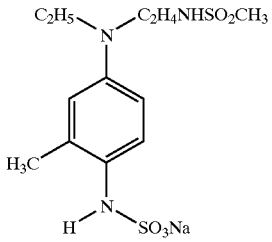
DEVP-36
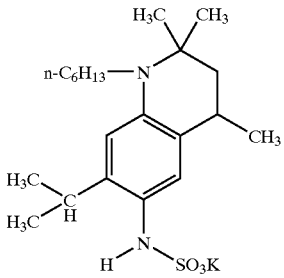
DEVP-45
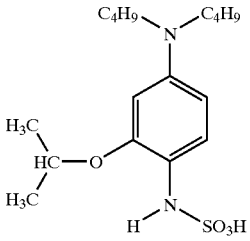
DEVP-45
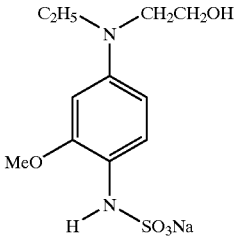
DEVP-46
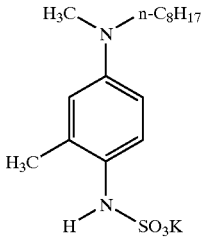
DEVP-47
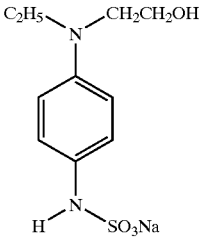
DEVP-48
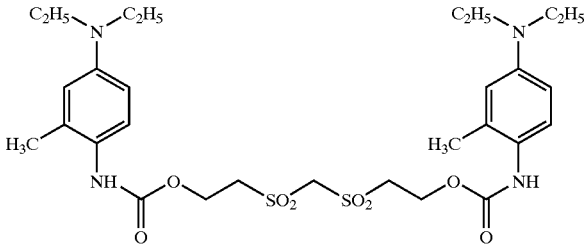
DEVP-49
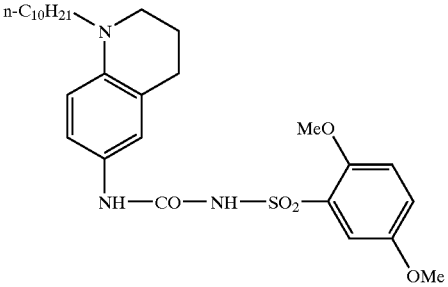

-continued

DEVP-50

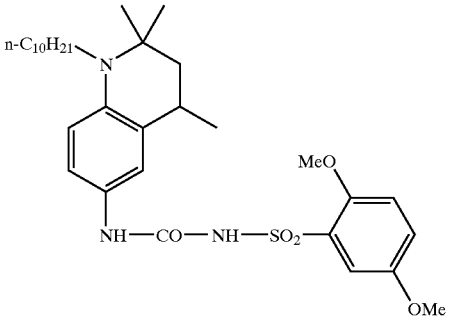

DEVP-51

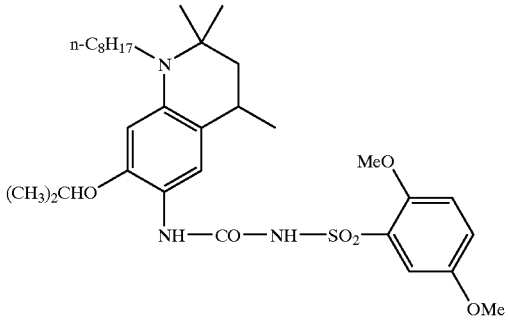

DEVP-52

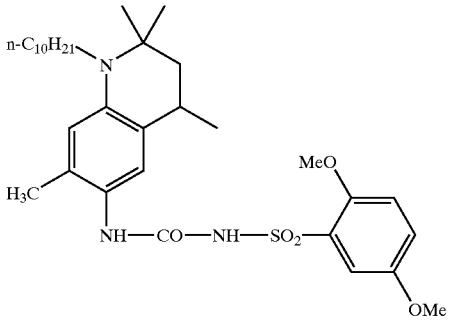

DEVP-53

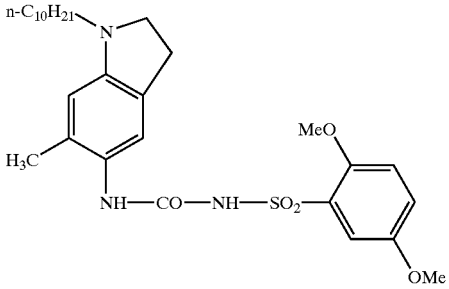

DEVP-54

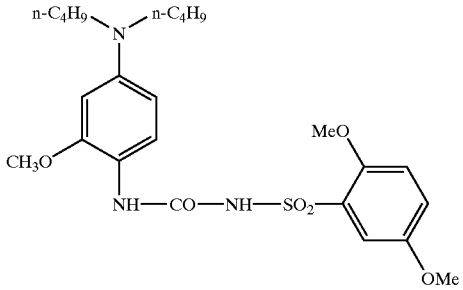

DEVP-55

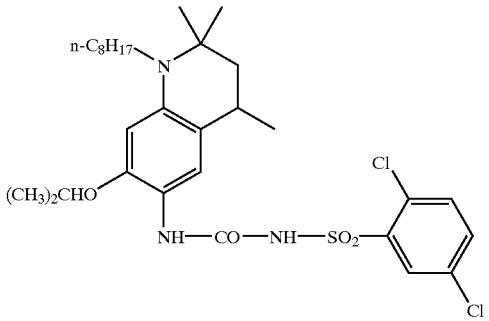

DEVP-56

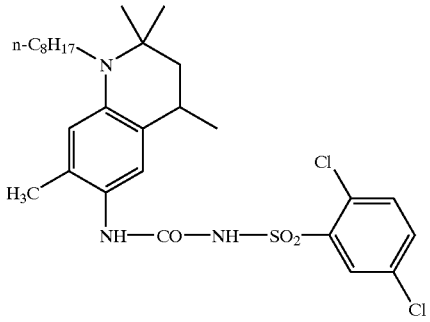

DEVP-57

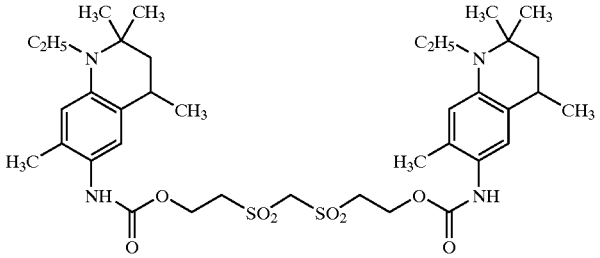

(D) Microcrystalline Grain Dispersion

In the invention, it is appropriate that the precursors of color developing agents and the thermal solvents be incorporated as microcrystalline grain dispersions into a photosensitive material.

A colloidal dispersion of those ingredients in a state of microcrystalline grains can be prepared by applying mechanical shear stress in accordance with any of methods well-known in the technical field. Examples of such methods are described in U.S. Pat. Nos. 2,581,414 and 2,855,156, and Canadian Patent No. 1,105,761, and they are usable in the invention also. Specifically, those methods include methods of finely grinding solid grains with various mills (such as a ball mill, a pebble mill, a roller mill, a sand mill, a bead mill, a Dyno mill, a Mass up mill and a media mill). Therein are further included a colloid mill method, a method of finely grinding with an Attritor, a dispersion method utilizing ultrasonic energy and a high-speed stirring method (as described in U.S. Pat. No. 4,474,872). Of those methods, the fine grinding methods using a ball mill, a roller mill, a media mill and an Attritor, respectively, are preferred because these grinding machines can be operated and cleaned with ease and ensure high reproducibility.

Alternatively, a colloidal dispersion of microcrystalline grains can be obtained as follows: A dispersion in which the aforesaid compounds are present in an amorphous state is prepared first in accordance with a well-known method, such as a colloid mill method, a homogenization method, a high-speed stirring method or an acoustic treatment method, and then the compounds in the amorphous state are transformed into a microcrystalline state by use of a thermal annealing method or a chemical annealing method. The thermal annealing method includes the temperature programming method wherein the amorphous compounds are circulated into the temperature zone higher than their glass transition temperatures. Preferably, such a thermal annealing method has a process of circulating a dispersion through the temperature region of 17 to 90° C. This circulation process can include an arbitrary temperature-change sequence for promoting formation of a microcrystalline phase from the remaining amorphous state. Typically, the time period of a high-temperature interval is chosen so that the phase formation is promoted and, at the same time, the grain growth through ripening and collision processes is controlled to the least possible extent. The chemical annealing method includes an incubation method using a chemical agent capable of changing the distribution of the compounds and a surfactant between the continuous phase and the discontinuous phase of the dispersion. Examples of such a chemical agent include hydrocarbons (e.g., hexadecane), surfactants, alcohol compounds (e.g., butanol, pentanol, undecanol) and high boiling organic solvents. These chemical agents can be added to dispersions during or after the grain formation. Such a chemical annealing method includes the method of incubating the dispersion at 17 to 90° C. in the presence of a chemical agent as recited above, the method of stirring the dispersion in the presence of a chemical agent as recited above, and a method of once adding a chemical agent as recited above to the dispersion and then slowly removing the chemical agent by a diafiltration method.

In general the formation of a colloidal dispersion in an aqueous medium requires the presence of a dispersing aid, such as a surfactant, a surface-active polymer or a hydrophilic polymer. Such dispersing aids are described in U.S. Pat. No. 5,008,179 (columns 13 to 14) and U.S. Pat. No. 5,104,776 (columns 7 to 13), and therefrom dispersing aids suitable for the invention can be selected.

In the invention, it is appropriate for the microcrystalline grain dispersion to have a number average grain size of 0.001 to 5 $\mu$m, preferably 0.001 to 0.5 $\mu$m.

The present heat-developable photosensitive material has a precursor of the color developing agent on the same side of a support as both light-sensitive silver halide and reducible silver salt are present.

The precursor of the developing agent can be added in a wide range of amounts. Specifically, the suitable amount of the precursor added is 0.01 to 100 times by mole, preferably 0.1 to 10 times by mole, the amount of coupler compounds used.

For heightening the dispersion stability of microcrystalline grain dispersions, it is appropriate that the precursors of the color developing agents used in the invention have water solubility of 1 g/m$^3$ or below, preferably $10^{-3}$g/m$^3$ or below.

Further, it is advantageous that the precursors of the color developing agents used in the invention have their melting points in the range of 80 to 300° C.

In the invention, it is appropriate that the precursor of the color developing agent and the thermal solvent used as a combination be compatible with each other. As to the combinations of the precursor of the color developing agent with couplers, on the other hand, it is preferable that these ingredients have no compatibility.

(E) Couplers

The present heat-developable photosensitive material has coupler compounds on the same side of a support as light-sensitive silver halide, binder and a reducible silver salt are present. The coupler compounds used in the invention are compounds referred to as couplers well-known in the photographic industry, including two-equivalent and four-equivalent couplers. Examples of couplers usable in the invention include the couplers having the functions described in a paper written by Nobuo Furudachi under the title of "Organic Compounds for Conventional Color Photography", published in *Yuki Gosei KagakuKyokai-shi*, vol. 41, p. 439 (1983), and the couplers described in detail in *Research Disclosure*, No. 37038, pp. 80–85 and 87–89 (February 1995).

Examples of yellow color image-forming couplers include couplers of pivaroylacetamide type, couplers of benzoylacetamide type, couplers of malondiester type, couplers of malondiamide type, couplers of dibenzoylmethane type, couplers of benzothiazolylacetamide type, couplers of malonester monoamide type, couplers of benzoxazolylacetamide type, couplers of benzimidazolylacetamide type, couplers of cycloalkylcarbonylacetamide type, couplers of indoline-2-ylacetamide type, couplers of the quinazoline-4-one-2-ylacetamide type disclosed in U.S. Pat. No. 5,021,332, couplers of the benzo-1,2,4-thiadizine-1,1-dioxide-3-ylacetamide type disclosed in U.S. Pat. No. 5,021,330, the couplers disclosed in EP-A-0421221, the couplers disclosed in U.S. Pat. No. 5,455,149, the couplers disclosed in EP-A-0622673, and the 3-indoloylacetamide-type couplers disclosed in EP-A-0953871, EP-A-0953872 and EP-A-0953873.

Examples of magenta color image-forming couplers include couplers of 5-pyrazolone type, couplers of 1H-pyrazolo[1,5-a]benzimidazole type, couplers of 1H-pyrazolo[5,1-c][1,2,4]triazole type, couplers of 1H-pyrazolo[1.5-b][1,2,4]triazole type, couplers of 1H-imidazo[1,2-b]pyrazole type, couplers of cyanoacetophenone type, couplers of the active propene type disclosed in WO 93/01523, couplers of the enamine type disclosed in WO 93/075342, couplers of 1H-imidazo[1,2-b][1,2,4]triazole type, and the couplers disclosed in U.S. Pat. No. 4,871,652.

Examples of cyan color image-forming couplers include couplers of phenol type, couplers of naphthol type, couplers of the 2,5-diphenylimidazole type disclosed in, EP-A-0249453, coupler of 1H-pyrrolo[1,2-b][1,2,4]triazole type, couplers of 1H-pyrrolo[2,1-c][1,2,4]triazole type, couplers of the pyrrole type disclosed in JP-A-4-188137 and JP-A-4-190347, couplers of the 3-hydroxypyrizine type disclosed in JP-A-1-315736, couplers of the pyrrolopyrazole type disclosed in U.S. Pat. No. 5,164,289, couplers of the pyrroloimidazole type disclosed in JP-A-4-174429, couplers of the pyrazolopyrimidine type disclosed in U.S. Pat. No. 4,950,585, couplers of the pyrrolotriazine type disclosed in JP-A-4-204730, the couplers disclosed in U.S. Pat. No. 4,746,602, the couplers disclosed in U.S. Pat. No. 5,104,783, the couplers disclosed in U.S. Pat. No. 5,162,196, and the couplers disclosed in European Patent No. 0 556 700.

The dye-forming couplers used in the invention may be compounds forming dyes having their maximum absorption peaks in non-visible regions. The couplers of such a type are disclosed, e.g., in JP-A-53-125836 and JP-A-53-129036.

Examples of representative coupler compounds usable in the invention are illustrated below, but these examples should not be considered as limiting the scope of the invention. Additionally, the figures affixed respectively to the repeated units in each of the structural formulae of the polymeric couplers given as examples are expressed in weight %.
CP-101
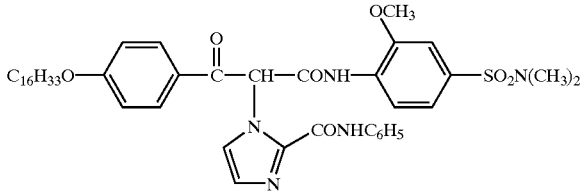
CP-102
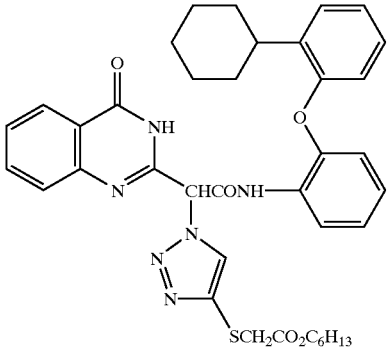
CP-103
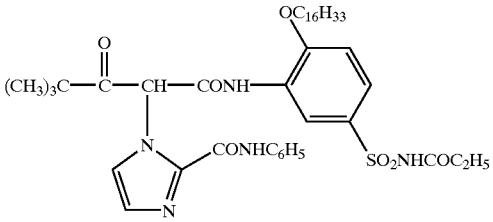
CP-104
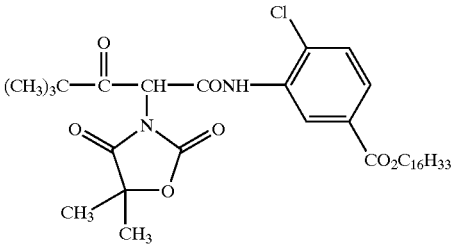
CP-105
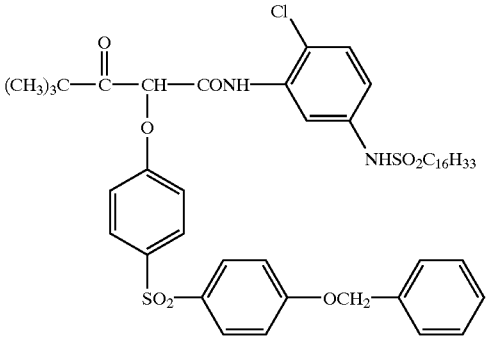
CP-106
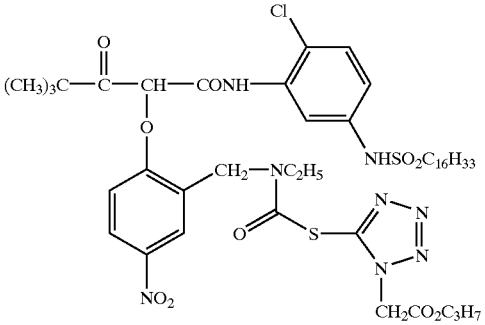
CP-107
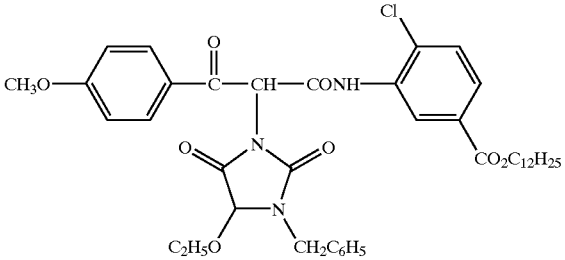
CP-108
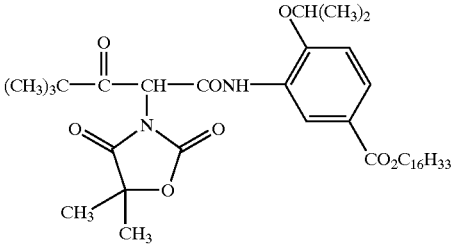
CP-109
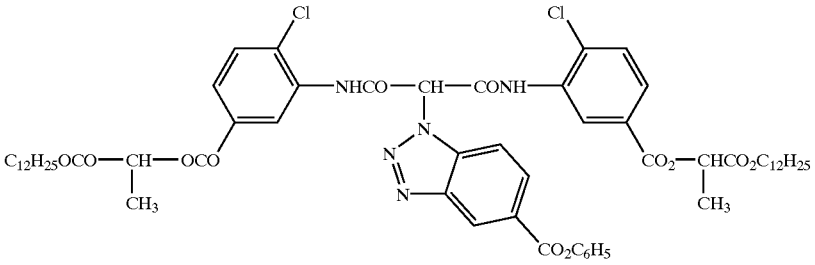

-continued
CP-110
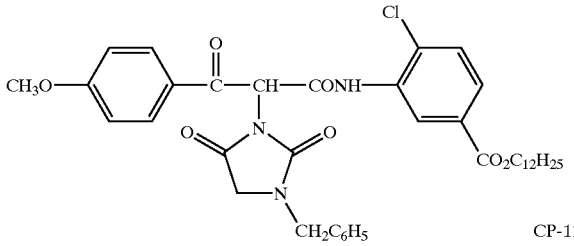
CP-111
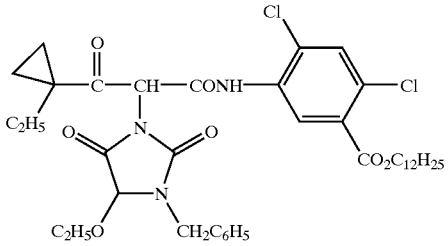
CP-112
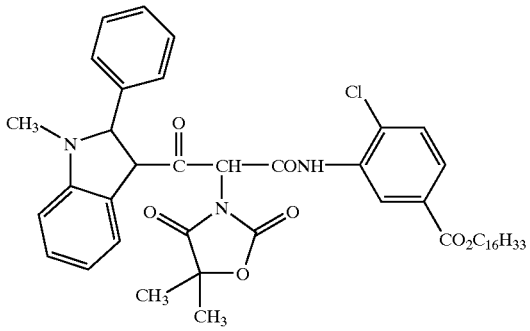
CP-113
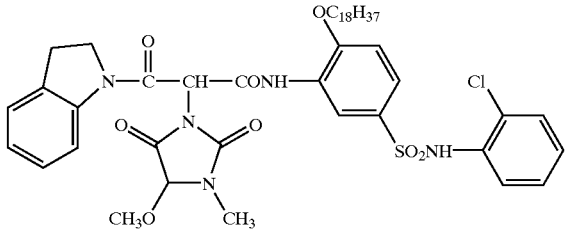
CP-114
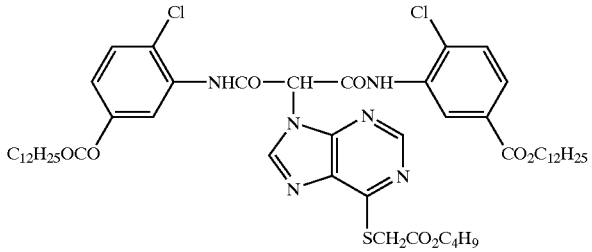
CP-115
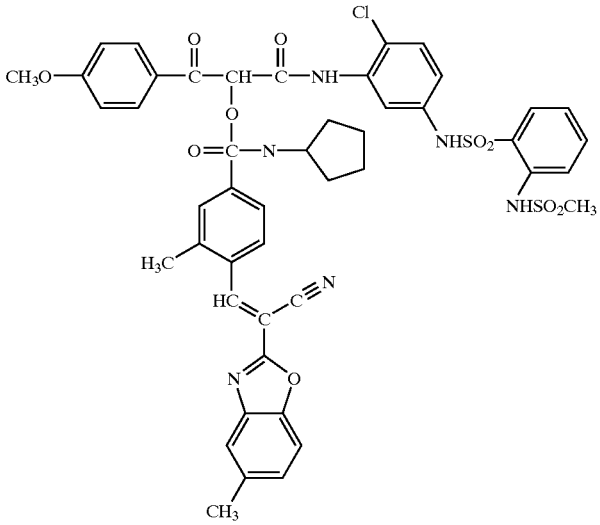
CP-116
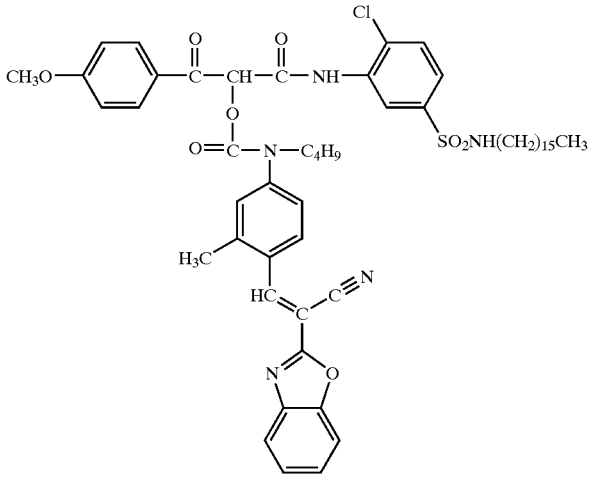
Compound I-5 disclosed in U.S. Pat. No. 5,457,004
Compound Inv-16 disclosed in JP-A-2000-206655
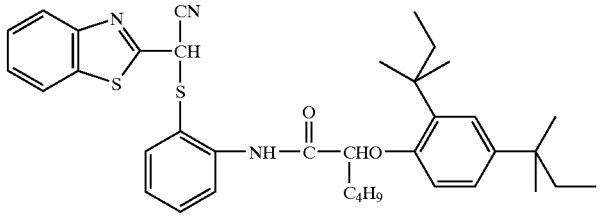

-continued
CP-201
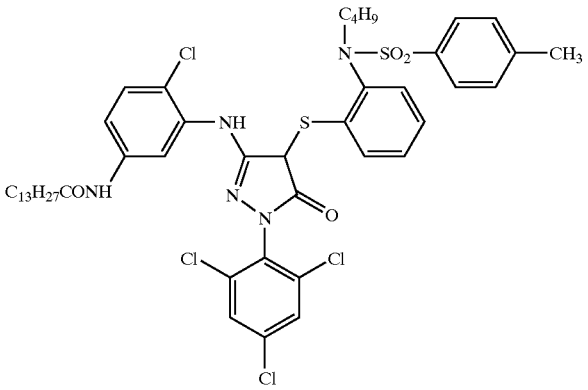
CP-202
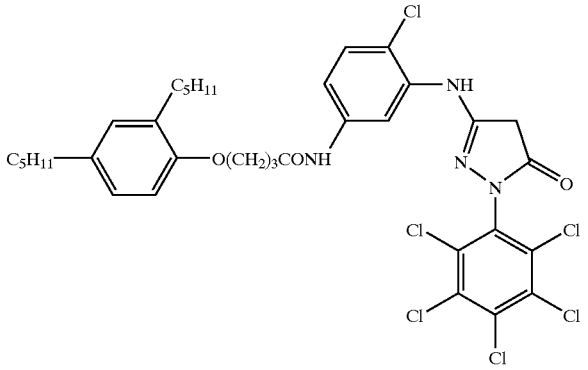
CP-203
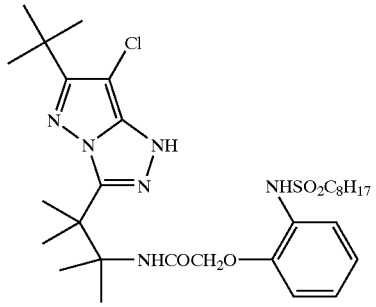
CP-203
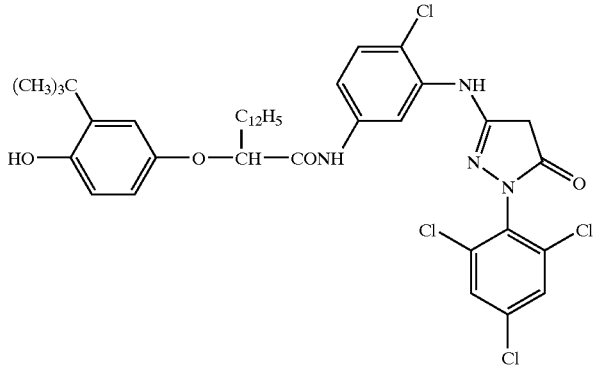
CP-205
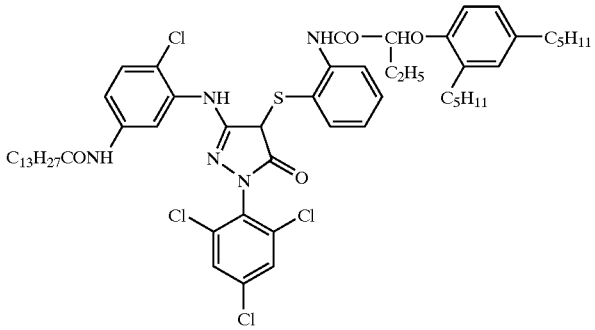
CP-206
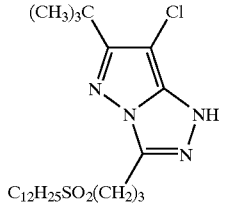
CP-207
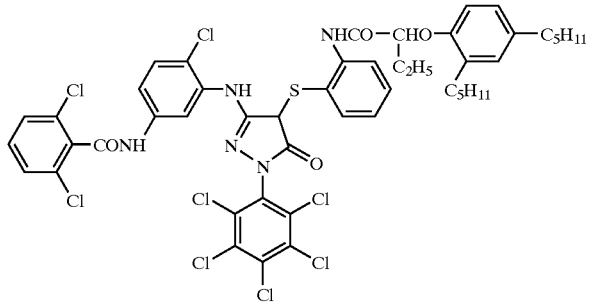
CP-208
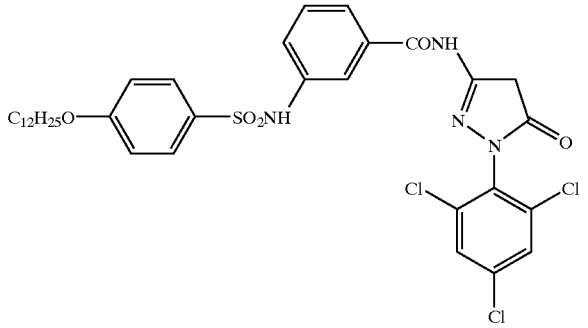

-continued
CP-209
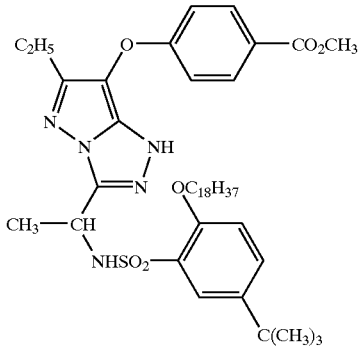
CP-210
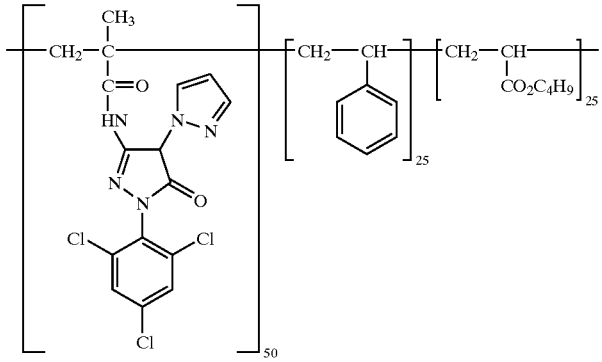
CP-211
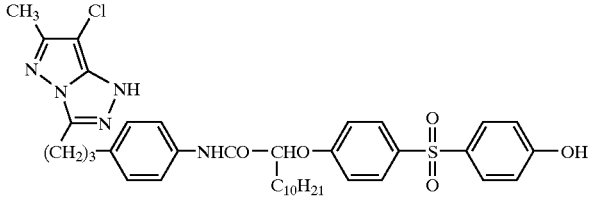
CP-212
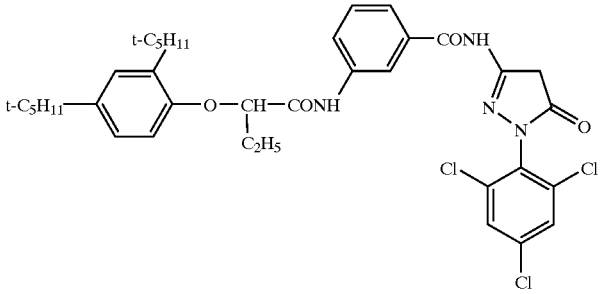
CP-213
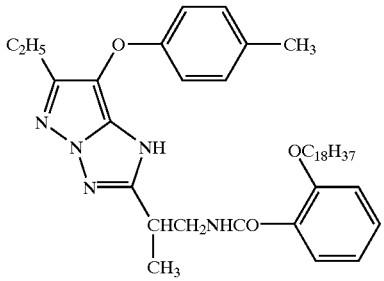
CP-214
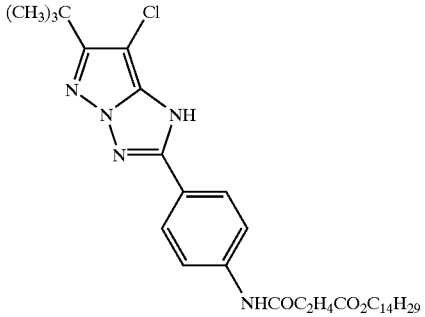
CP-215
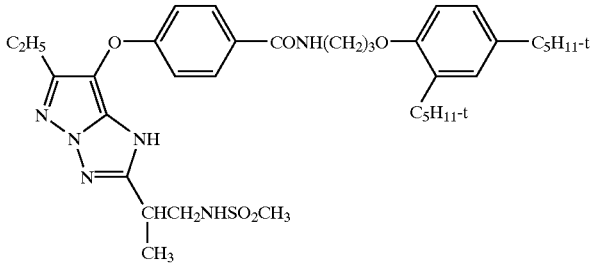
CP-216
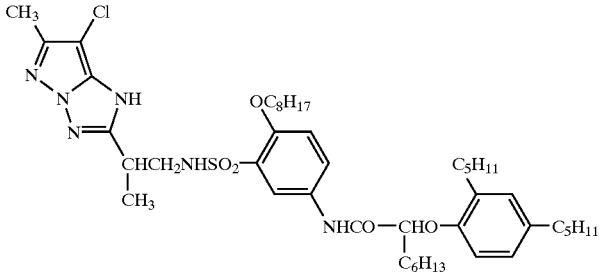

-continued
CP-217
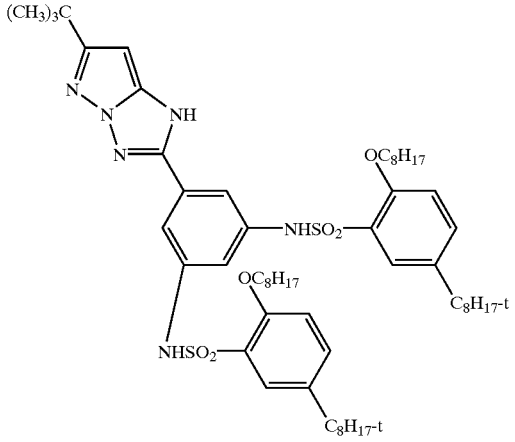
CP-218
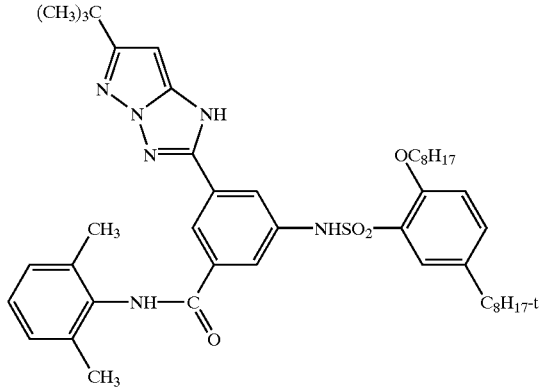
CP-219
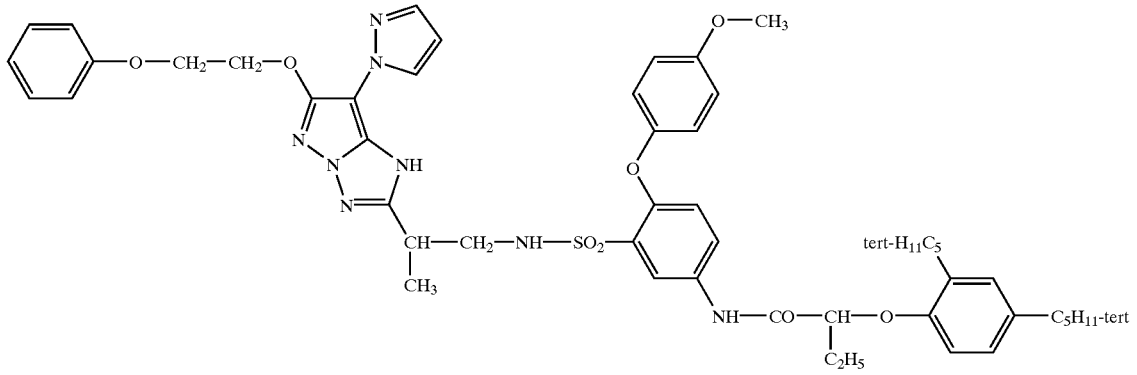
CP-220
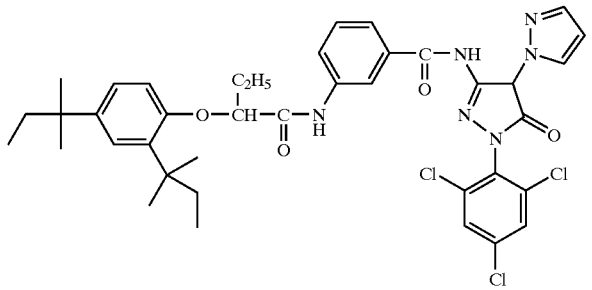
CP-301
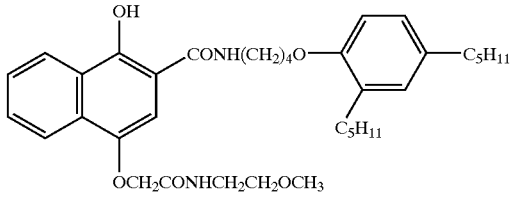
CP-302
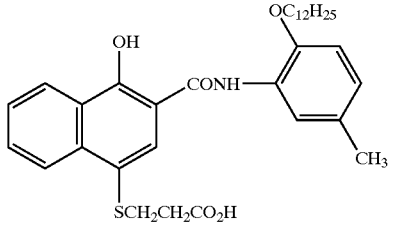
CP-303
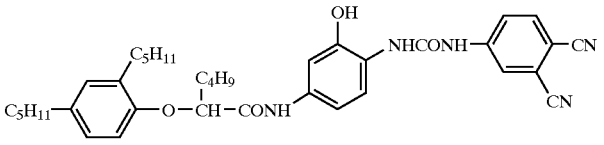
CP-304
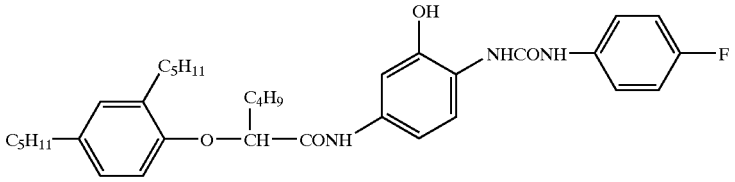

-continued
CP-305
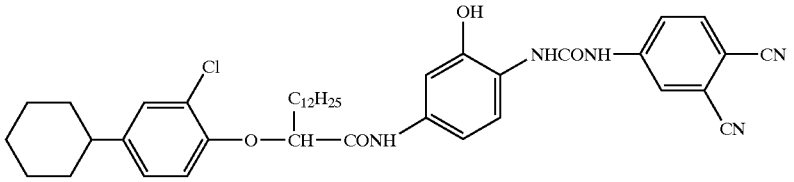
CP-306
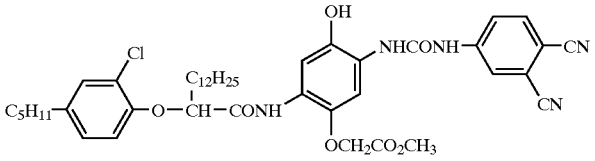
CP-307
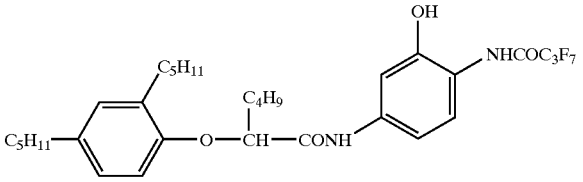
CP-308
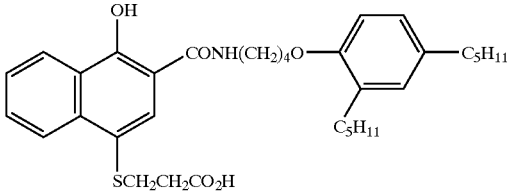
CP-309
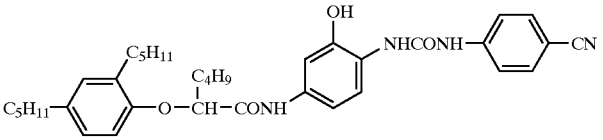
CP-310
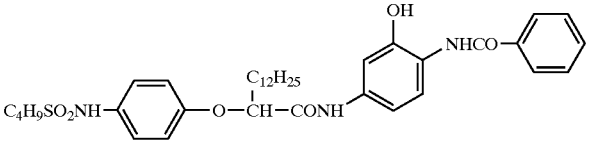
CP-311
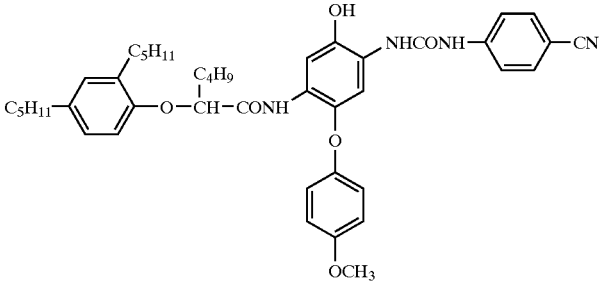
CP-312
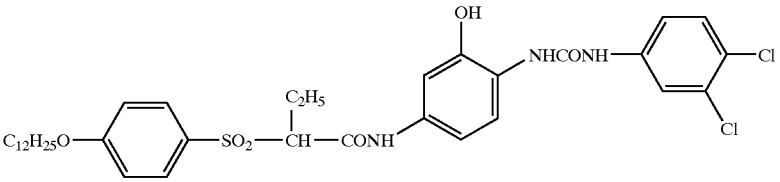
CP-313
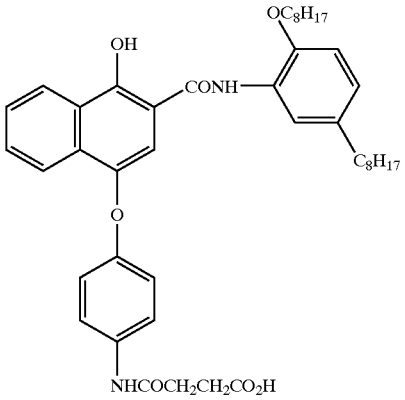
CP-314
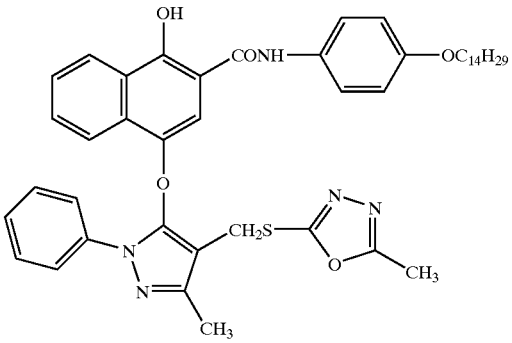

-continued
CP-315
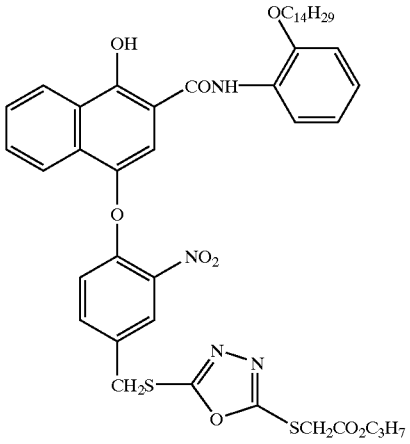
CP-316
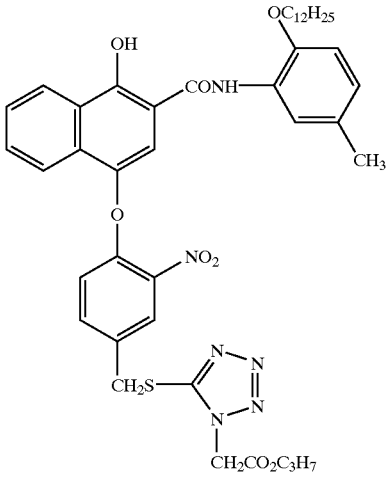
CP-317
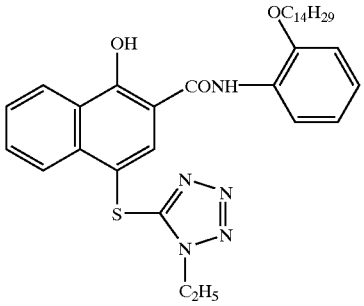
CP-318
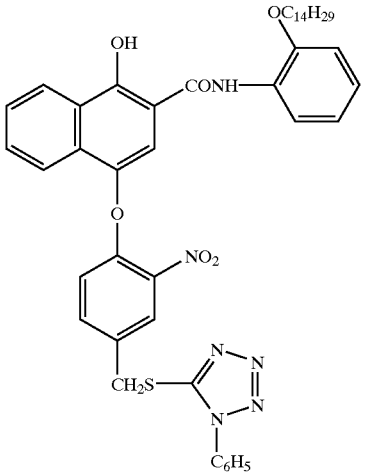
CP-319
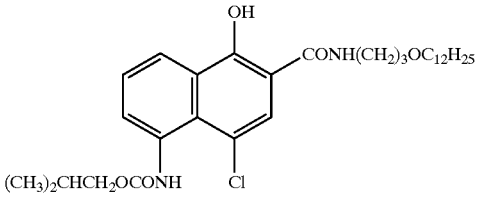
CP-320
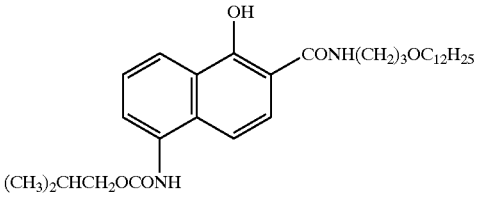
CP-321
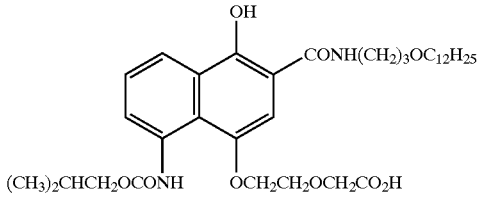
CP-322
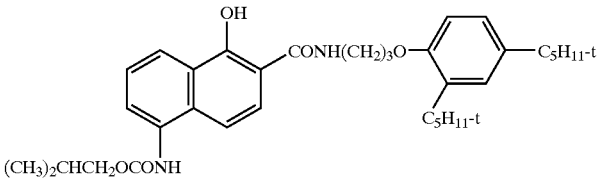

-continued
CP-323
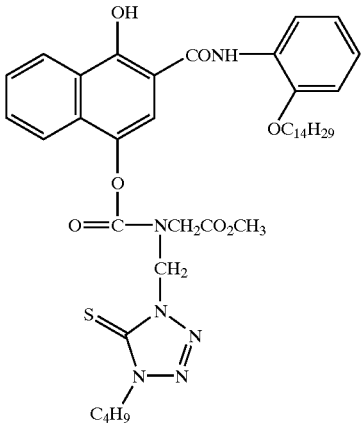
CP-324
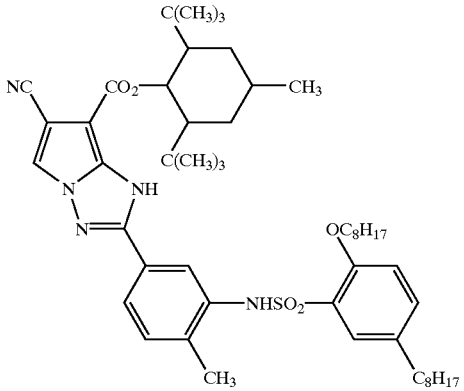
CP-325
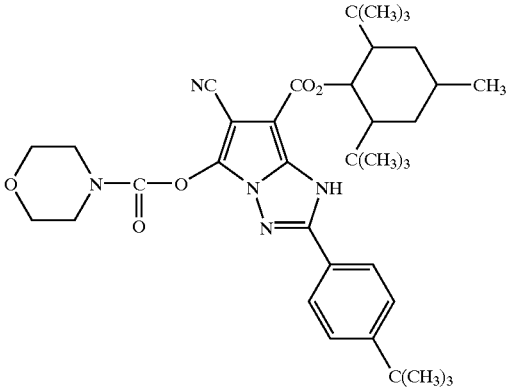
CP-326
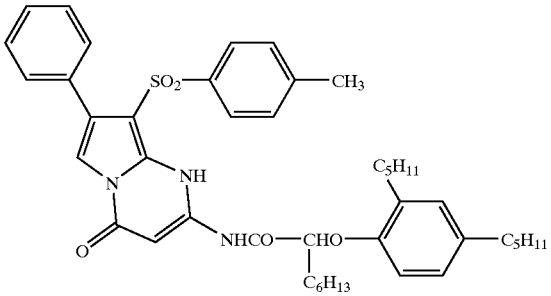
CP-327
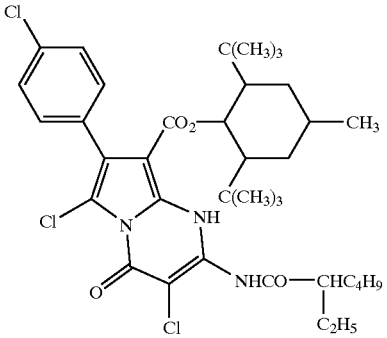
CP-328
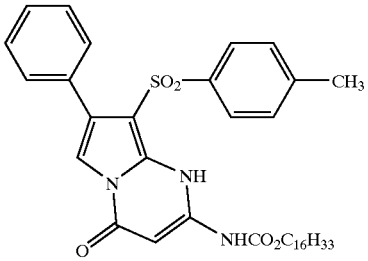
CP-329
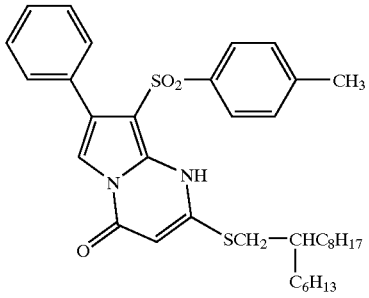
CP-330
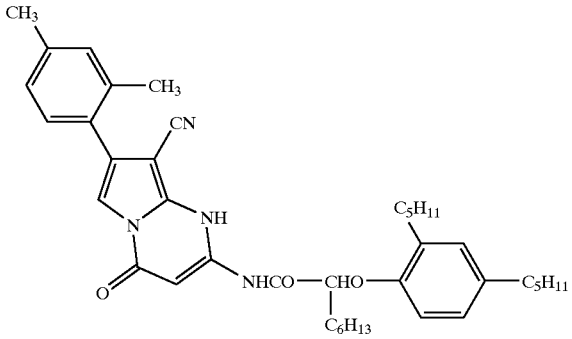

-continued
CP-331
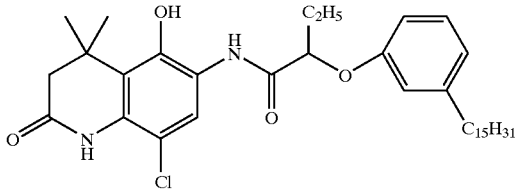
(1)-1
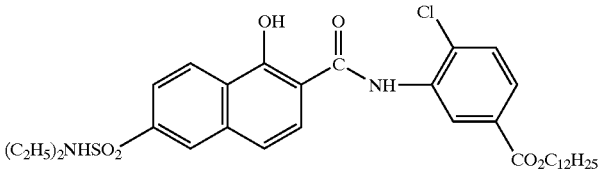
(1)-2
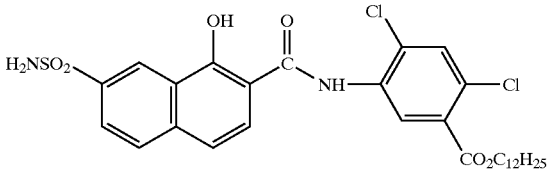
(1)-3
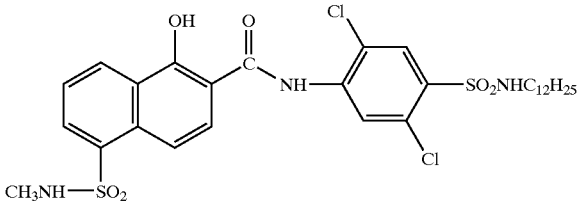
(1)-4
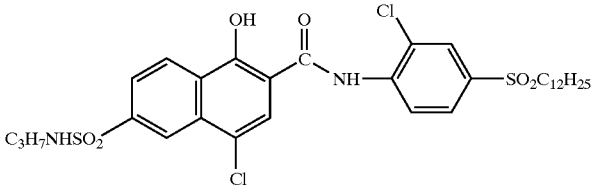
(1)-5
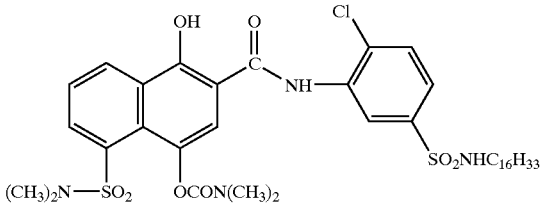
(1)-6
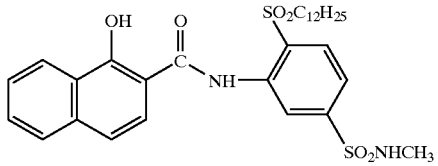
(1)-7
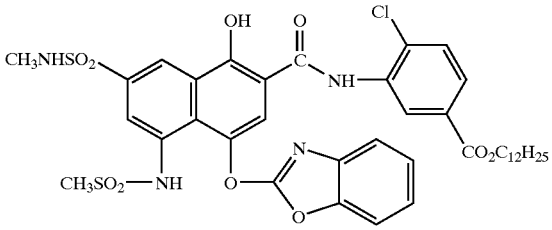
(1)-8
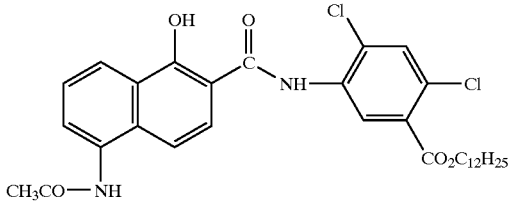
(1)-9
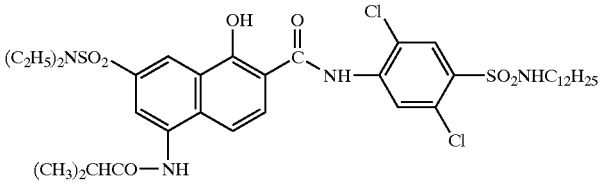
(1)-10
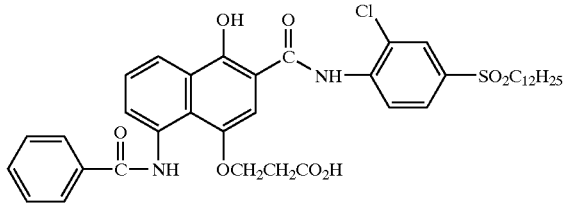
(1)-11
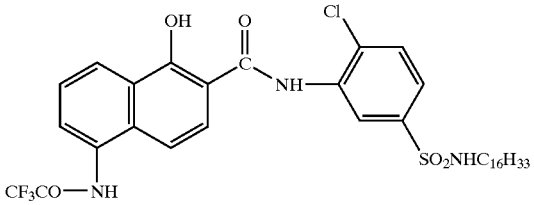
(1)-12
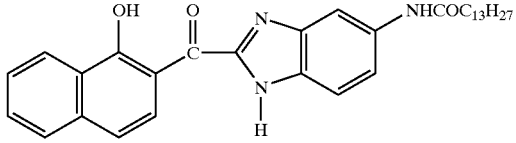
(1)-13
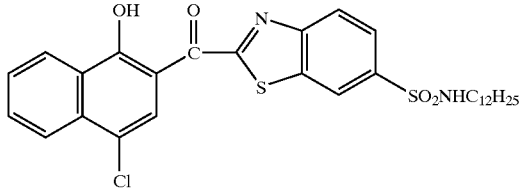

-continued
(1)-14
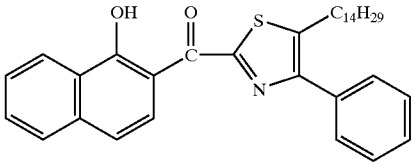
(1)-15
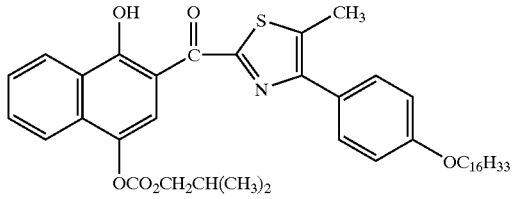
(1)-16
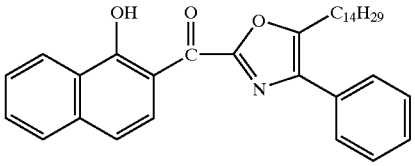
(1)-17
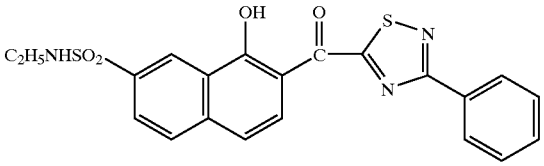
(1)-18
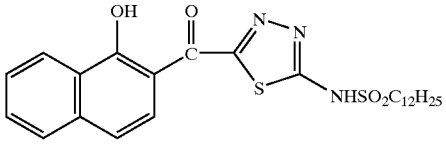
(1)-19
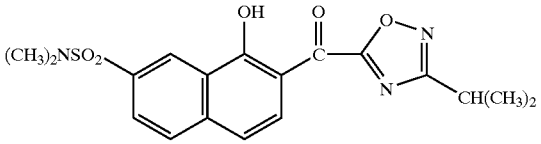
lp;1p
(1)-20
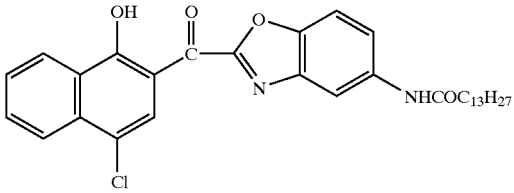
(1)-21
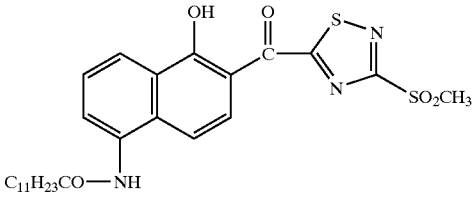
(1)-22
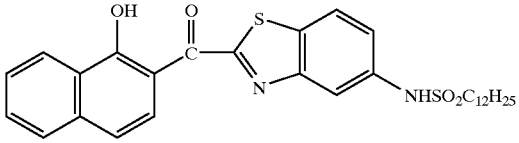
(1)-23
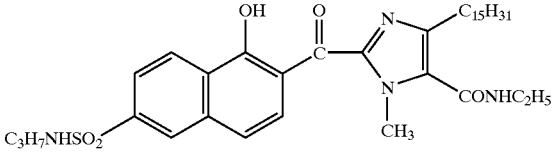
(1)-24
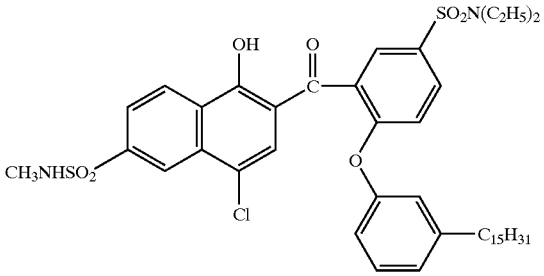
(1)-25
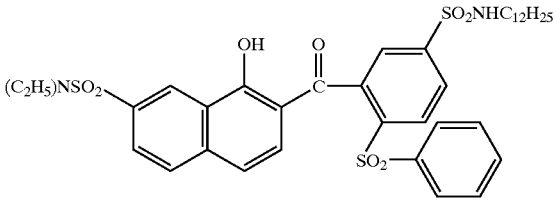
(1)-26
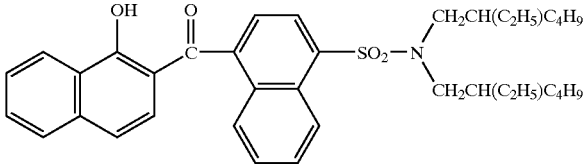
(1)-27
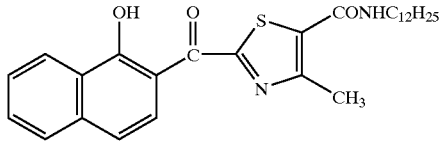

-continued
(1)-28
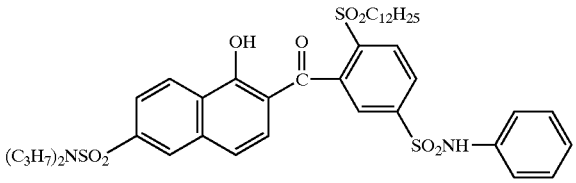
(1)-29
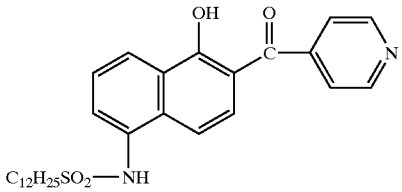
(1)-30
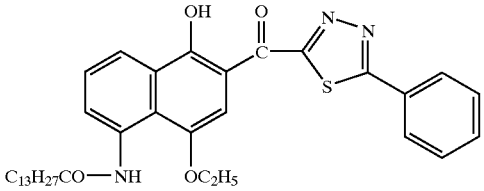
(1)-31
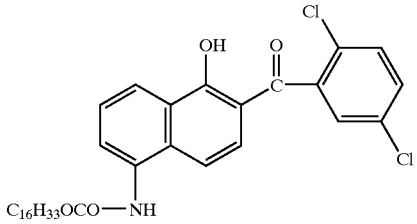
(1)-32
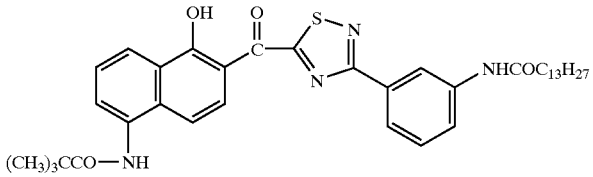
(1)-33
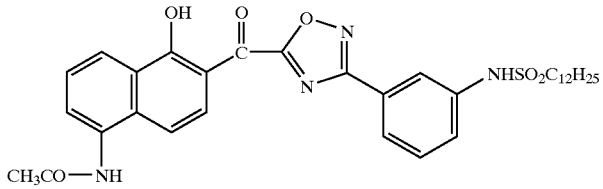
(1)-34
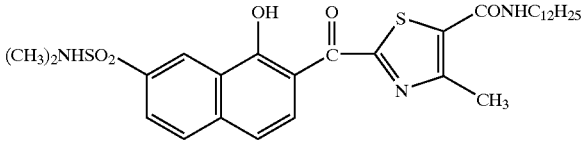
(1)-35
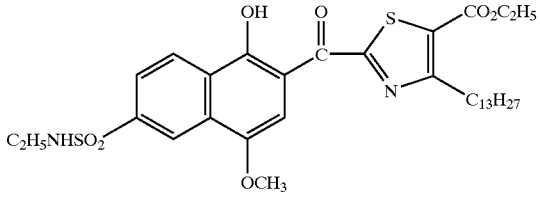
(1)-36
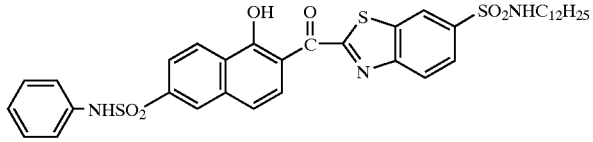
(1)-37
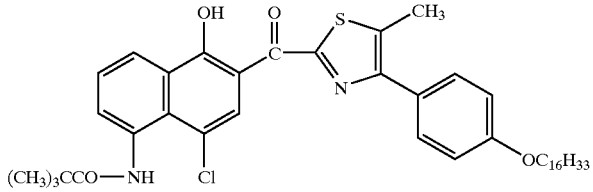
(1)-38
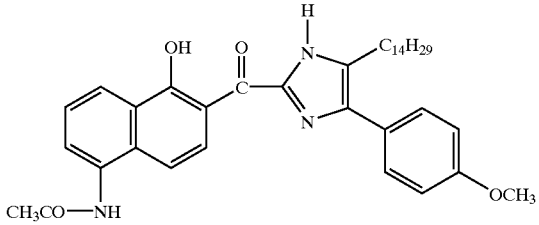
(1)-39
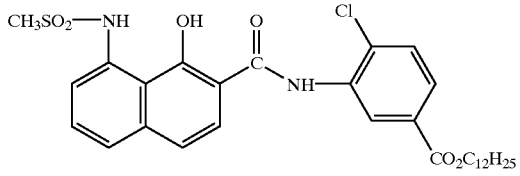
(1)-40
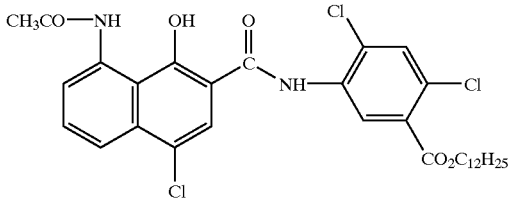
(1)-41
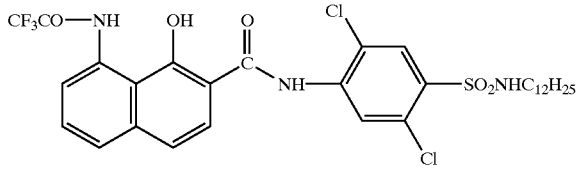

-continued
(1)-42
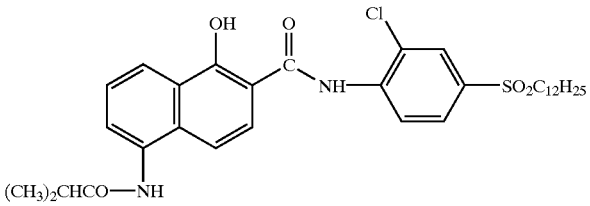
(1)-43
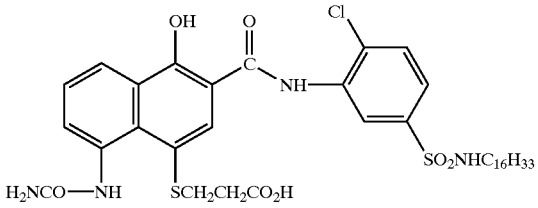
(2)-1
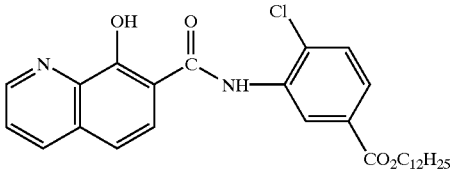
(2)-2
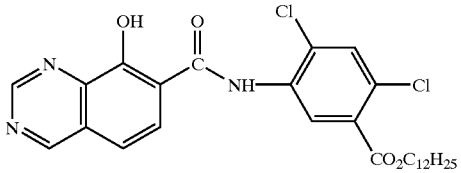
(2)-3
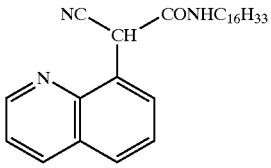
(2)-4
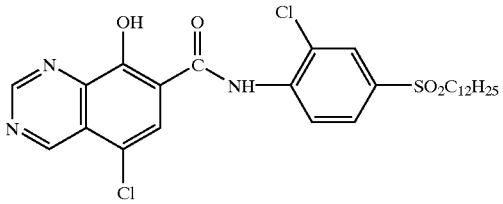
(2)-5
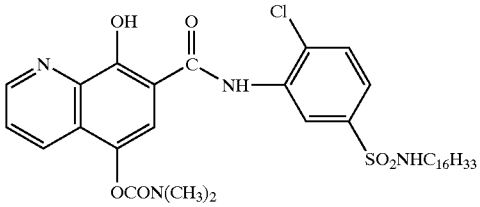
(2)-6
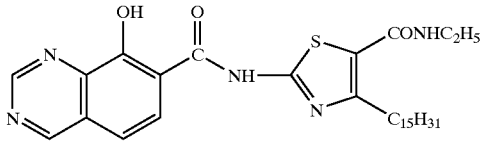
(3)-1
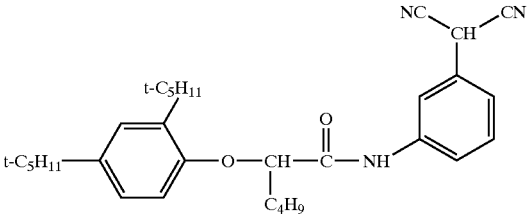
(3)-2
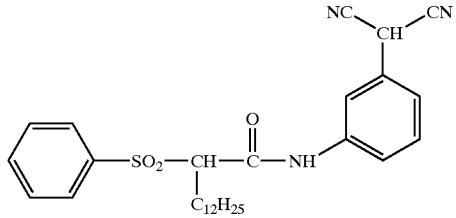
(3)-3
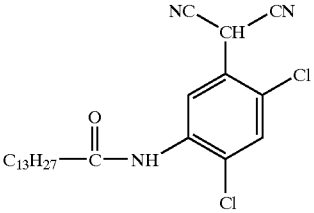
(3)-4
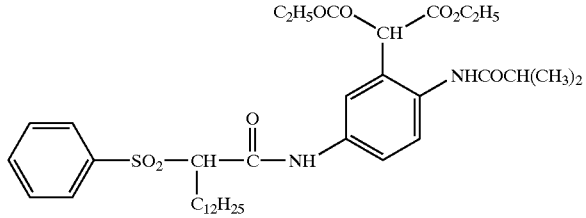
(3)-5
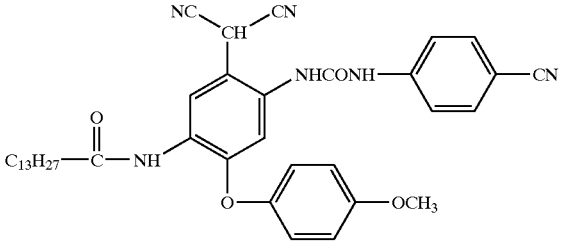
(3)-6
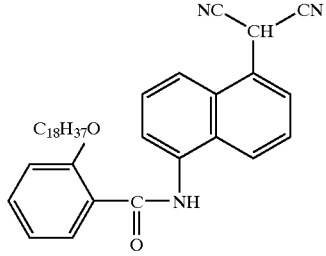

-continued
(3)-7
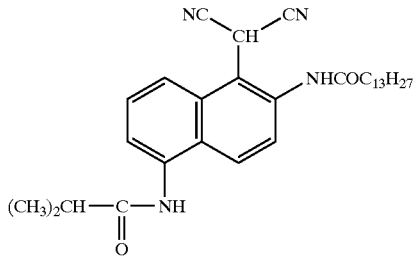
(3)-8
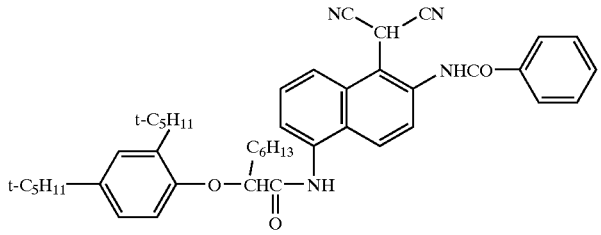
(3)-9
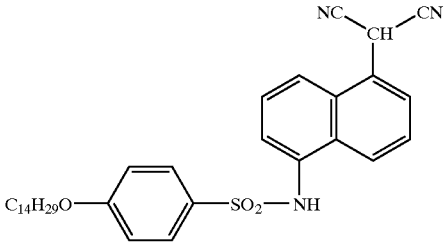
(3)-10
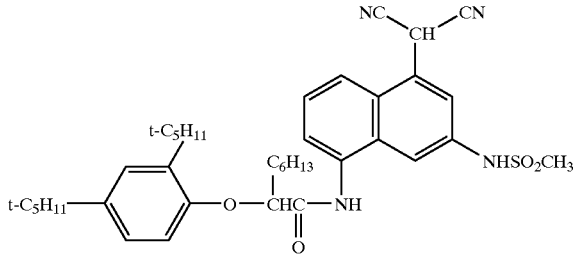
(3)-11
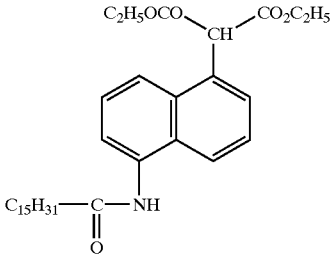
(3)-12
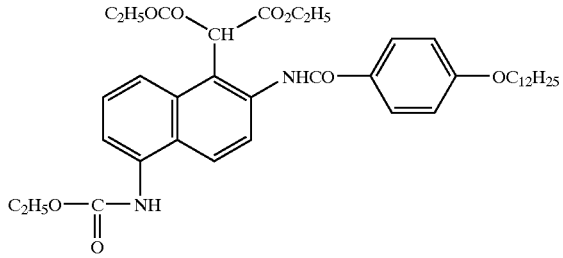
(3)-13
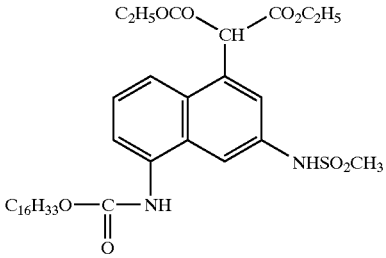
(3)-14
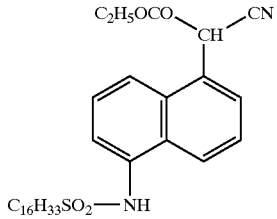
(3)-15
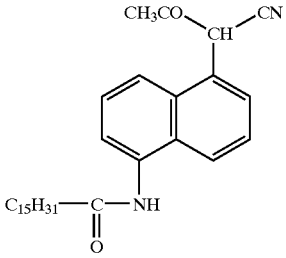
(4)-1
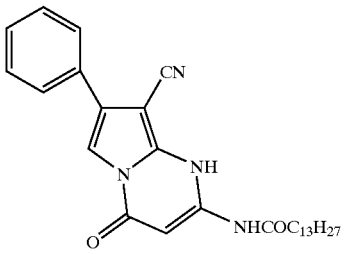

-continued
(4)-2
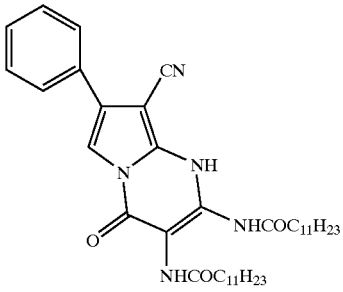
(4)-3
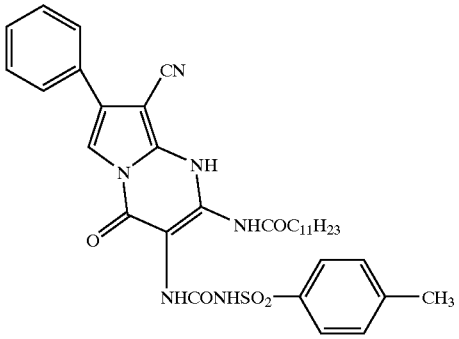
(4)-4
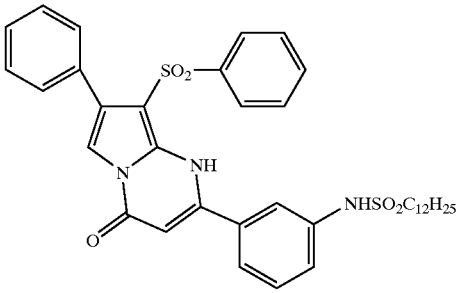
(4)-5
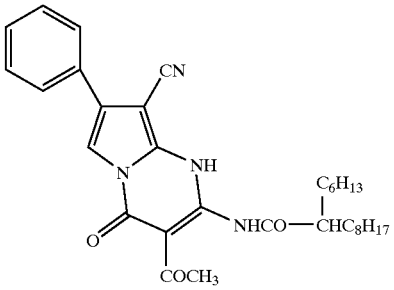
(4)-6
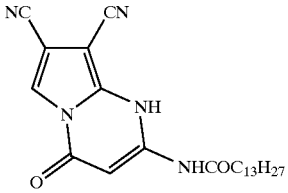
(4)-7
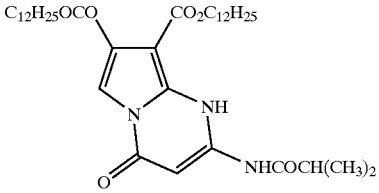
(4)-8
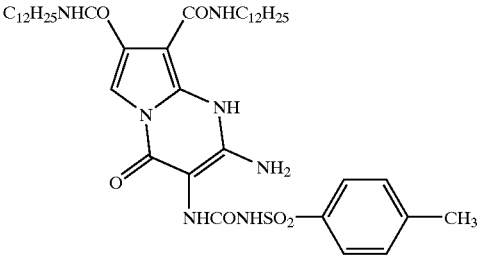
(4)-9
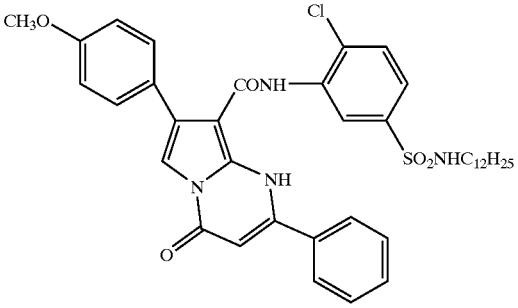
(4)-10
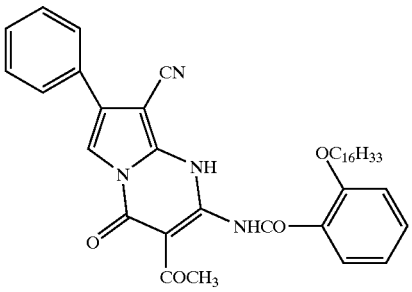
(4)-11
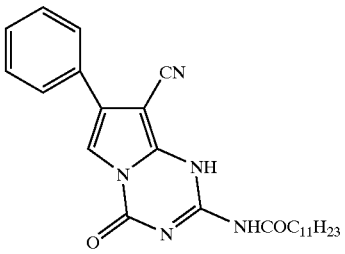

-continued
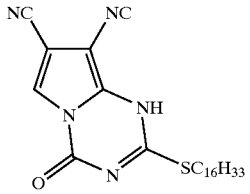
(4)-12
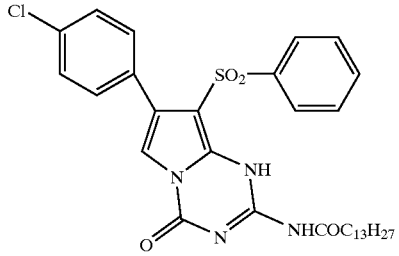
(4)-13
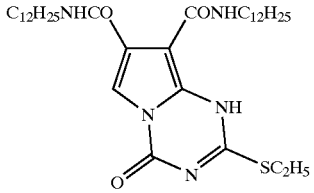
(4)-14
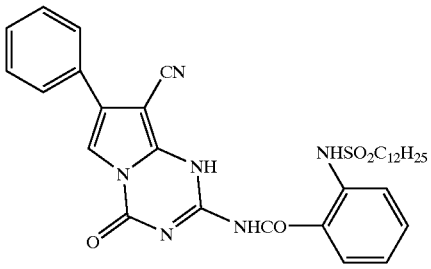
(4)-15
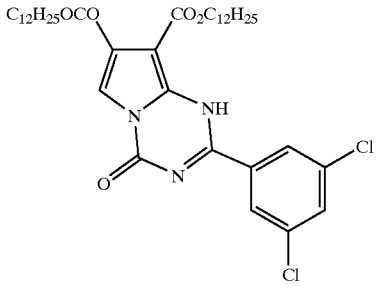
(4)-16
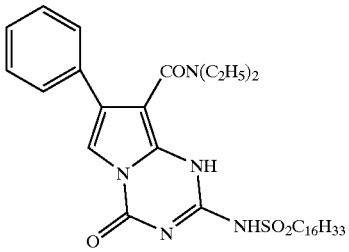
(4)-17
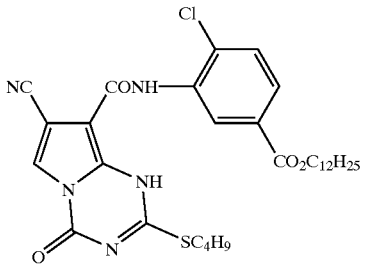
(4)-18
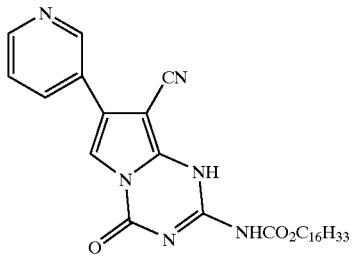
(4)-19
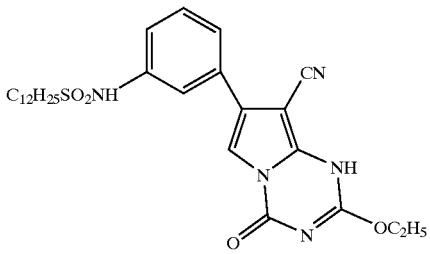
(4)-20
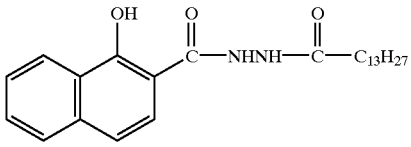
(5)-1
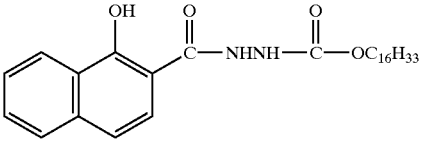
(5)-2
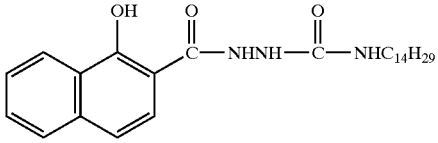
(5)-3

-continued
(5)-4
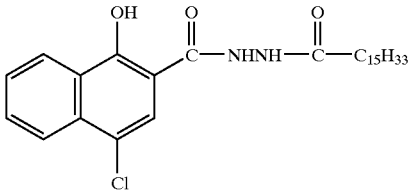
(5)-5
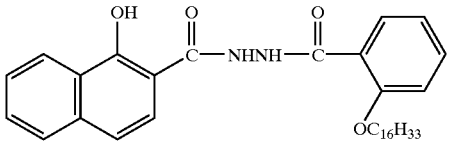
(5)-6
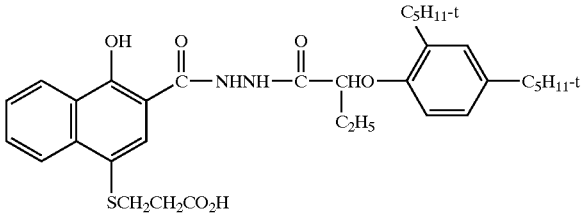
(5)-7
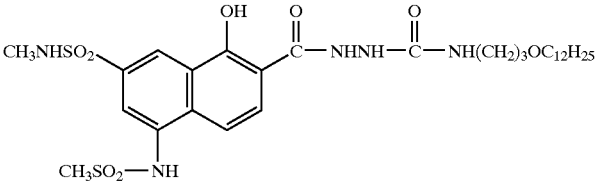
(5)-8
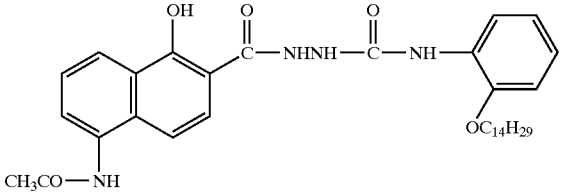
(5)-9
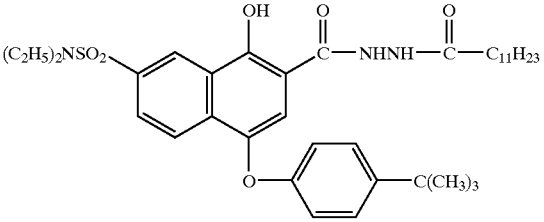
(5)-10
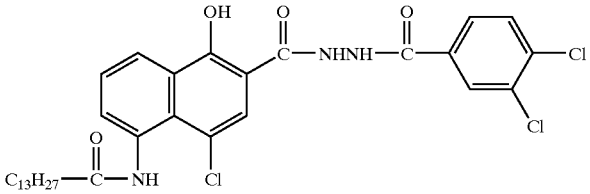
(5)-11
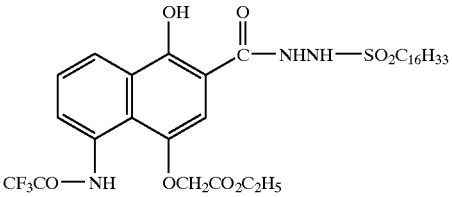
(5)-12
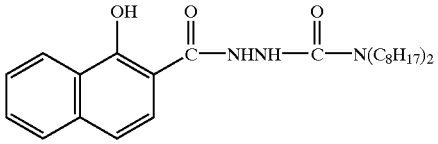
(5)-13
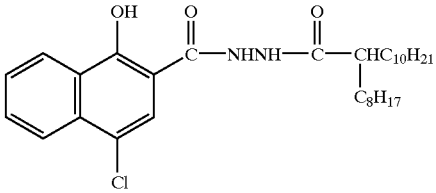
(5)-14
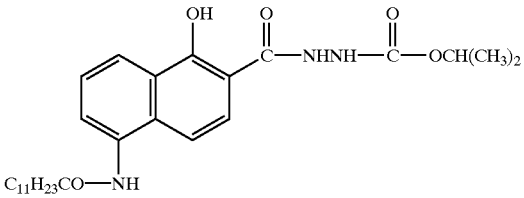
(5)-15
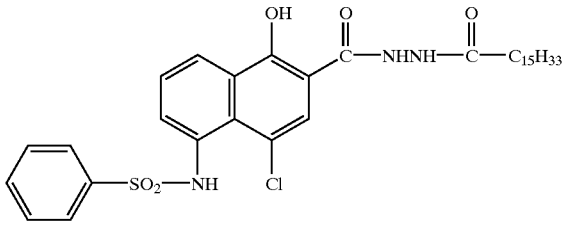
(5)-16
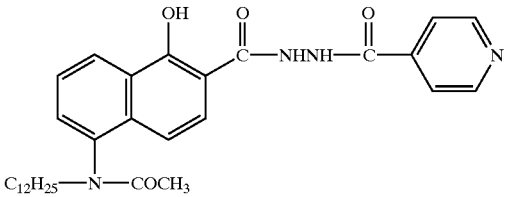
(5)-17
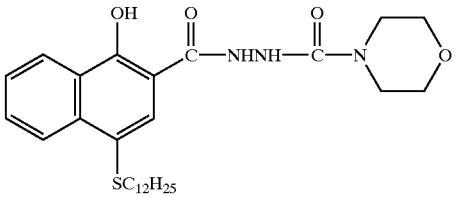

-continued (5)-18

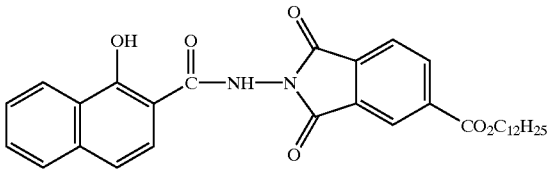

(5)-19

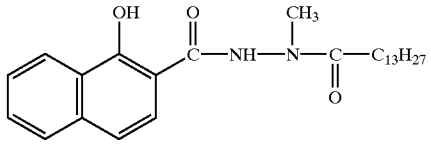

(5)-20

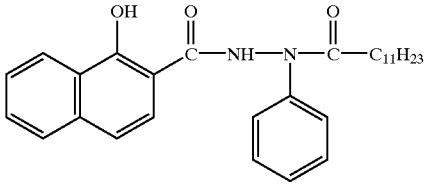

(5)-21

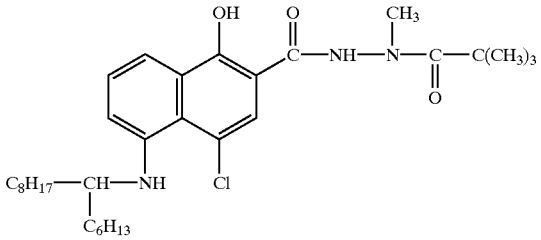

The coupler compounds illustrated above can be synthesized with ease in accordance with methods well known in the photographic industry, including the methods described in the patents cited above in relation to couplers.

The coupler compounds may be added to any of layers as far as the layers are provided on the same side of a support as light-sensitive silver halide and a reducible silver salt are present. Preferably, the coupler compounds are added to silver halide-containing layers or layers adjacent thereto.

The suitable amount of the coupler compound added is from 0.2 to 500 millimoles, preferably from 0.3 to 100 millimoles, more preferably from 0.5 to 30 millimoles, per mole of silver. The coupler compounds may be used alone or as a combination of two or more thereof.

When the photosensitive materials in the invention are used as picture-taking materials, the couplers usable in the invention are added in amounts of 0.5 to 200 millimoles, preferably 2 to 100 millimoles, per mole of silver in the silver halide emulsion layer into which they are to be incorporated.

Further, functional couplers as described below may be used in the invention.

Suitable examples of couplers capable of providing color-developed dyes having moderate diffusibility include the couplers disclosed in U.S. Pat. No. 4,366,237, GB Patent No. 2,125,570, EP-B-96873 and DE Patent No. 3,234,533.

Examples of couplers for compensating unnecessary absorption of color-developed dyes include the yellow-colored cyan couplers disclosed in EP-A1-456257, the yellow-colored magenta couplers disclosed in the EP patent cited above, the magenta-colored cyan couplers disclosed in U.S. Pat. No. 4,833,069, the Compound (2) exemplified in U.S. Pat. No. 4,837,136, and the colorless masking couplers represented by formula (A) in claim 1 of WO 92/11575 (especially the compounds illustrated on pages 36 to 45).

Compounds (including couplers) capable of releasing photographically useful compound residues through reaction with an oxidized color developing agent are illustrated below with representative examples.

Examples of a development inhibitor-releasing compound include the compounds represented by formulae (I) to (IV) disclosed on page 11 of EP-A1-378236, the compounds represented by formula (I) disclosed at page 7 of EP-A2-436938, the compounds represented by formula (1) in EP-A-568037, and the compounds represented by formulae (I), (II) and (III) at pages 5 and 6 of EP-A2-4401952.

Examples of a bleach accelerator-releasing compound include the compounds represented by formulae (I) and (I') at page 5 of EP-A2-310125, and the compounds represented by formula (I) in claim 1 of JP-A-6-59411.

Examples of a ligand-releasing compound include the compounds represented by LIG-X in claim 1 of U.S. Pat. No. 4,555,478.

Examples of a leuco dye-releasing compound include the Compounds 1 to 6 disclosed on columns 3 to 8 of U.S. Pat. No. 4,749,641.

Examples of a fluorescent dye-releasing compound include the compounds represented by COUP-DYE in claim 1 of U.S. Pat. No. 4,774,181.

Examples of a development accelerator- or fogging agent-releasing compound include the compounds represented by formulae (1), (2) and (3) on column 3 of U.S. Pat. No. 4,656,123, and the Compound ExZK-2 at page 75, lines 36–38, of EP-A2-450637.

Examples of a compound releasing a group converted into a dye only after elimination include the compounds represented by formula (I) in claim 1 of U.S. Pat. No. 4,857,447, the compounds represented by formula (1) in JP-A-5-307248, the compounds represented by formulae (I), (II) and (III) disclosed at pages 5 and 6 of EP-A2-440195, the compounds represented by formula (I) in claim 1 of JP-A-6-059411 (ligand-releasing compounds), and the compounds represented by LIG-X in claim 1 of U.S. Pat. No. 4,555,478.

The suitable amount of those functional couplers used is 0.05 to 10 times, preferably 0.1 to 5 times, by mole the amount of the aforementioned color-forming couplers used.

In addition, it is appropriate that the couplers used in the invention have melting points not lower than 90° C.

And it is advantageous that the couplers used in the invention have melting points higher than the thermal solvents used in combination therewith, preferably higher than the temperature chosen for development processing. Further, it is appropriate that the couplers be compatible with the thermal solvents used in combination therewith.

(F) Silver Halide

Silver halide used in the present heat-developable photosensitive material may be any of silver iodobromide, silver bromide, silver chlorobromide, silver iodochloride silver chloride and silver iodochlorobromide. The suitable size of silver halide grains is from 0.1 to 2 $\mu$m, preferably from 0.2 to 1.5 μm, in terms of sphere equivalent diameter. Besides being used as the foregoing light-sensitive silver halide grains, those silver halide grains can be used as light-insensitive silver halide grains without undergoing, e.g., chemical sensitization.

As to the crystal shape, silver halide grains having a regular crystal shape, such as a cube, an octahedron or a tetradecahedron, and silver halide grains having the crystal shape of a hexagonal or rectangular tablet can be used. The aspect ratio of each tabular grain, which is defined as the value obtained by dividing a projected area diameter of the grain by a thickness of the grain, is preferably at least 2, more preferably at least 8, particularly preferably at least 20. It is appropriate to use emulsions wherein such tabular grains constitute, on a projected area basis, at least 50%, preferably at least 80%, more preferably at least 90%, of the total grains. The suitable thickness of those tabular grains is 0.3 μm or below, more preferably 0.2 μm or below, particularly preferably 0.1 μm or below.

Further, the grains 0.07 μm or thinner in thickness and higher in aspect ratio as disclosed in U.S. Pat. Nos. 5,494,789, 5,503,970, 5,503,971 and 5,536,632 can be used to advantage. In addition, the tabular silver halide grains having high chloride contents and (111) principal planes as disclosed in U.S. Pat. Nos. 4,400,463, 4,713,323 and 5,217,858, and the tabular silver halide grains having high chloride contents and (100) principal planes as disclosed in U.S. Pat. Nos. 5,264,337, 5,292,632 and 5,310,635 are also used to advantage. The practical cases of using those silver halide grains are described in JP-A-9-274295, JP-A-9-319047, JP-A-10-115888 and JP-A-10-221827. It is preferable for the silver halide grains to be narrow in grain size distribution, or the so-called monodisperse grains. Taking as an index of monodisperse the variation coefficient obtained by dividing the standard deviation of a grain size distribution by an average grain size, the suitable variation coefficient of monodisperse grains is preferably 25% or smaller, more preferably 20% or smaller. In addition, it is advantageous that the halide composition is consistent from grain to grain.

The silver halide grains used in the invention may have a uniform halide composition in the interior of the grains, or regions differing in halide composition may be introduced thereto intentionally. For achieving high sensitivity in particular, it is appropriate to use grains having a multilayer structure constituted of a core and shell(s) which are different from one another in halide composition. It is also preferable to introduce dislocation lines intentionally by further growing the grains after introduction of regions having a different halide composition. Further, it is advantageous that guest crystals having a different halide composition are joined epitaxially to apexes or edges of the host grains formed.

It is also effective that the insides of silver halide grains are doped with polyvalent transition metal ions or polyvalent anions as impurities. As the former, halogeno complexes, cyano complexes and organic-ligand complexes containing iron-group elements as central metals are used to advantage.

The silver halide grains can be prepared by basically using known methods as described, e.g., in P. Glafkides, *Chimie et Phisigue Photographigue*, Paul Montel, 1967, G. F. Duffin, *Photographic Emulsion Chemistry*, Focal Press, 1966, and V. L. Zelikman et al., Making and Coating of Photographic Emulsion, Focal Press, 1964. More specifically, the silver halide grains can be prepared in various pH regions by applying an acid process, a neutral process or an ammoniacal process. And a water-soluble silver salt solution and a water-soluble silver halide solution as reacting solutions can be fed using a single-jet method, a double-jet method or a combination of these methods. Further, a controlled double-jet method wherein the addition of those solutions is controlled so as to keep pAg during the reaction at the intended value can be used to advantage. Alternatively, a method of keeping the pH value constant during the reaction may be adopted. In forming grains, a method of controlling the solubility of silver halide by changing the temperature, the pH value or the pAg value of the reaction system can be adopted, and it is also possible to use a silver halide solvent, such as thioether, thiourea or rhodanate (thiocyanate). These cases are described in JP-B-47-11386 and JP-A-53-144319.

The preparation of silver halide grains is generally carried out by feeding a solution of water-soluble silver salt, such as silver nitrate, and a solution of water-soluble halide, such as alkali halide, into an aqueous solution of water-soluble binder, such as gelatin, under controlled conditions. After formation of silver halide grains, it is preferable to remove excess water-soluble salts. For this purpose may be used a noodle washing method which involves setting a gelatin solution containing silver halide grains to a gel, cutting the gel into strips and washing water-soluble salts from the strips with chilled water, or a sedimentation method which include removal of excess salts through coagulation of gelatin by addition of an inorganic salt having a polyvalent anion (such as sodium sulfate), an anionic surfactant, an anionic polymer (such as sodium polystyrenesulfonate) or a gelatin derivative (such as aliphatic acylated gelatin, aromatic acylted gelatin or aromatic carbamoylalted gelatin). Of these method, the sedimentation method is preferred because it enables rapid removal of excess salts.

(G) Chemical Sensitization, Spectral Sensitization and Other Additives

It is generally appropriate that the emulsions used in the invention be subjected to chemical sensitization and spectral sensitization.

For chemical sensitization, a chalcogen sensitization method utilizing a sulfur, selenium or tellurium compound, a precious metal sensitization utilizing gold, platinum or iridium, and the so-called reduction sensitization method ensuring high sensitivity through introduction of reduced silver nuclei by use of a compound having moderate reducing power can be used alone or as combinations thereof.

For spectral sensitization, cyanine dyes, merocyanine dyes, complex cyanine dyes, complex merocyanine dyes, holopolar dyes, hemicyanine dyes, styryl dyes and hemioxonol dyes, called spectral sensitizing dyes which are adsorbed onto silver halide grains and impart sensitivities in their own absorption wavelength regions to the grains, can be used alone or as combinations thereof. It is also advantageous to use these dyes in combination with supersensitizers.

The light-sensitive silver halide is used in an amount of 0.05 to 15 g/m$^2$, preferably 0.1 to 8 g/m$^2$, based on silver.

To silver halide emulsions, it is preferable to add various stabilizers in order to prevent fogging and enhance stability during storage. Examples of such stabilizers include nitrogen-containing heterocyclic compounds (such as azaindenes, triazoles, tetrazoles and purines) and mercapto compounds (such as mercaptotetrazoles, mercaptotriazoles, mercaptoimidazoles and mercpatothiadiazoles). In particular, triazoles containing as substituents alkyl groups having at least 5 carbon atoms or aromatic groups, or mercaptoazoles produce considerable effects in preventing fogging at the time of heat development and, in some cases, providing high discrimination by enhancing developability in exposed areas.

More specifically, the antifoggants having hydrophobic substituents as disclosed in U.S. Pat. No. 5,773,560, JP-A-11-109539 and JP-A-11-119397 can be used.

These antifoggants and stabilizers may be added to the silver halide emulsions at any stage of emulsion preparation. The addition thereof may be effected in various ways. For instance, the addition during a period from the conclusion of chemical sensitization to the time of preparing a coating solution, at the conclusion of chemical sensitization, in the course of chemical sensitization, before chemical sensitization, during a period after grain formation and before desalting, during grain formation, or prior to grain formation can be adopted alone or as combinations thereof.

In addition, it is preferable to use these agents in combination with the divalent metal ions described in JP-A-2000-89409.

The antifoggants may be added to any of layers provided on a support so far as the layers are present on the same side as the light-sensitive silver halide and the reducible silver salt. It is preferred to add them to layers containing a reducible silver salt or the layers adjacent thereto. The antifoggants can be used in a state that they are dissolved in water or an organic solvent. Alternatively, as well known, they can be used as an emulsion dispersion prepared in accordance with an emulsion dispersion method. On the other hand, the antifoggants can be used in the form of powder dispersed in water according to the well-known method for dispersing microcrystalline grains.

The suitable amounts of those antifoggants or stabilizers added to silver halide emulsions vary variously depending on the halide composition and end-use purpose of the emulsions. However, it is appropriate to add them in amounts of about $10^{-6}$ to about $10^{-1}$ mole, preferably $10^{-5}$ to $10^{-2}$ mole, per mole of silver halide.

It is also suitable for the invention to add the heterocyclic compounds having ClogP values sufficient to increase the sensitivity as disclosed in EP-A-1016902. And the addition of the triazole compounds having ClogP values in the range of 4.75 to 9.0 as disclosed in JP-A-2001-051383, the purine compounds having ClogP values ranging from 2 to smaller than 7.2 as disclosed in JP-A-2001-051384, the mercapto-1,2,4-thiadiazole or mercapto-1,2,4-oxadiazole compounds having ClogP values ranging from 1 to smaller than 7.6 as disclosed in JP-A-2001-051385, or the tetrazole compounds having ClogP values ranging from 2 to smaller than 7.8 as disclosed in JP-A-2001-051386 is also preferable. Those compounds may be dissolved in high-boiling organic solvents and added to the present photosensitive materials in the form of minute oil droplets similarly to other oil-soluble compounds including color developing agents and couplers. Alternatively, they may be dissolved in solvents miscible with water and added to binders. Further, the silver salts of those compounds may be prepared in advance and added to the photosensitive materials. In this case, besides being added in the foregoing ways, the silver salts may be made into solid dispersions and added to the photosensitive materials. As an example of the foregoing compounds, the Compound X disclosed in FP-A-1016902 can be given.

Compound X

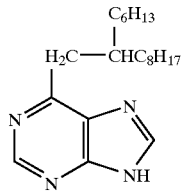

The addition amount of those compounds can be adjusted over a wide range so as to attain the desired properties. Specifically, they can be added in amounts of the order of $1\times10^{-5}$ mole to 1 mole per mole of silver halide emulsion. More specifically, the suitable addition amount of those compounds is of the order of $10^{-3}$ mole to $10^{-1}$ mole per mole of silver halide emulsion when they are added in the free form or in the form of alkali metal salts, while it is of the order of $10^{-2}$ mole to 1 mole per mole of silver halide emulsion when they are added in the form of silver salts.

As the photographic additives recited above, those described in *Research Disclosure* (hereinafter abbreviated as "RD"), No. 17643 (December 1978), ibid. No. 18716 (November 1979), ibid. No. 307105 (November 1989), and ibid. No. 38957 (September 1996) can be preferably used in the present heat-developable photosensitive materials also. The following is a RD-by-RD summary of locations in which the photographic additives are described:

| Kinds of Additives | RD 17643 | RD 18716 | RD 307105 |
|---|---|---|---|
| Chemical sensitizer | p. 23 | p. 648, right column | p. 866 |
| Sensitivity increasing agent | | p. 648, right column | |
| Spectral sensitizer and Supersensitizer | pp. 23–24 | p. 648, right column to p. 649, right column | pp. 866–868 |
| Brightening agent | p. 24 | p. 648, right column | p. 868 |
| Antifoggant and Stabilizer | pp. 24–26 | p. 649, right column | pp. 868–870 |
| Light absorbent, Filter dye and UV absorbent | pp. 25–26 | p. 649, right column, to p. 650, left column | p. 873 |
| Dye image stabilizer | p. 25 | p. 650, left column | p. 872 |
| Hardener | p. 26 | p. 651, left column | pp. 874–875 |
| Binder | p. 26 | p. 651, left column | pp. 873–874 |
| Plasticizer and Lubricant | p. 27 | p. 650, right column | p. 876 |
| Coating aid and Surfactant | pp. 26–27 | p. 650, right column | pp. 875–876 |
| Antistatic agent | p. 27 | p. 650, right column | pp. 876–877 |
| Matting agent | | | pp. 878–879 |

(H) Reducible Silver Salts

Reducible silver salts which can be used in the invention are comparatively stable to light, but can provide silver ions when heated to 80° C. or higher in the presence of an exposed photocatalyst (e.g., latent images formed from light-sensitive silver halide) and a reducing agent. Suitable examples of silver salts of the foregoing type include complexes of organic or inorganic silver salts having such stability that the gross stability constants of their ligands to silver ion are in the range of 4.0 to 10.0.

Examples of organic silver salts suitably used therein include silver salts of organic compounds having carboxyl groups, such as silver salts of aliphatic carboxylic acids and silver salts of aromatic carboxylic acids. In addition, silver salts capable of being substituted with halogen atoms or hydroxyl group can also be used effectively. Suitable examples of the silver salt of an aliphatic carboxylic acid include silver behenate, silver stearate, silver oleate, silver laurate, silver caprate, silver myristate, silver palmitate, silver maleate, silver fumarate, silver tartarate, silver furoate, silver linolate, silver butyrate, silver camphorate and mixtures of two or more thereof. Suitable examples of the silver salt of an aromatic carboxylic acid or other compounds containing carboxyl groups include silver benzoate, silver substituted benzoates (such as silver 3,5-dihydroxybenzoatae, silver o-methylbenzoate, silver m-methylbenzoate, silver p-methylbenzoate, silver 2,4-dichlorobenzoate, silver acetamidobenzoate and silver p-phenylbenzoate), silver gallate, silver tannate, silver phthalate, silver terephthalate, silver salicylate, silver phenylacetate, silver pyromellitate, silver salt of 3-carboxymethyl-4-methyl-4-thiazoline-2-thione, the silver salts disclosed in U.S. Pat. No. 3,785,830, and the silver salts of thioether group-containing aliphatic carboxylic acids as disclosed in U.S. Pat. No. 3,330,663.

In addition, the silver salts of mercapto- or thione-substituted compounds which each contain a 5- or 6-membered heterocyclic nucleus having at least one nitrogen, one or two hetero atoms chosen from oxygen, sulfur or nitrogen and residual number of carbon atoms are also used to advantage. Representatives of suitable heterocyclic nuclei are triazole, oxazole, thiazole, thiazoline, thiadiazole, imidazoline, imidazole, diazole, pyridine and triazine nuclei. Suitable examples of silver salts of the compounds having such heterocyclic nuclei include silver salt of 3-mercapto-4-phenyl-1,2,4-triazole, silver salt of 2-mercaptobenzimidazole, silver salt of 2-mercapto-5-aminothiadiazole, silver salt of 2-(2-ethyl-glycolamido) benzothiazole, silver salt of 5-carboxyl-1-methyl-2-phenyl-4-thiopyridine, silver salt of mercaptotriazine, silver salt of 2-mercpatobenzoxazole, silver salt of 1-mercpato-5-alkyltetrazole, silver salt of 1-mercapto-5-phenyltetrazole disclosed in JP-A-1-100177, the silver salts disclosed in U.S. Pat. No. 4,123,274 (e.g., the silver salts of 1,2,4-mercaptothiazole derivatives including silver salt of 3-amino-5-benzylthio-1,2,4-triazole), the silver salts of thione compounds including 3-(2-carboxyethyl)-4-methyl-4-thiazoline-2-thione as disclosed in U.S. Pat. No. 3,201,678, the silver salts of 3-amino-1,2,4-triazoles as disclosed in JP-A-53-116144, silver salts of substituted or unsubstituted benzotriazoles, and the silver salts of benzotriazoles and fatty acids as described in U.S. Pat. No. 4,500,626, columns 52—52. In addition, silver salts of mercapto or thione compounds containing no heterocyclic nuclei are also usable, with examples including silver salts of thioglycolic acids such as the silver salts of S-alkylthioglycolic acids (the alkyl moieties of which contain 12 to 22 carbon atoms) as described in Japanese Patent Application No. 48-28221, silver salts of dithiocarboxylic acids such as silver dithioacetate, and silver salts of thioamides.

Further, silver salts of imino group-containing compounds can also be used. Suitable examples of such compounds include the silver salts of benzotriazole and derivatives thereof as described in Japanese Patent Application Nos. 44-30270 and 45-18146, specifically silver salts of benzotriazoles such as silver salt of methylbenzotriazole, silver salts of halogen-substituted benzotriazoles such as silver salt of 5-chlorobenzotriazole and silver salt of 1,2,4-triazoles, the silver salts of 1H-tetrazoles disclosed in U.S. Pat. No. 4,220,709, and silver salts of imidazole and derivatives thereof. Furthermore, the acetylene silver disclosed in U.S. Pat. No. 4,775,613 is also useful.

The organic silver salts may be used as combinations of two or more thereof. The suitable amount of organic silver salts added in combination is from 0.01 to 10 moles, preferably 0.01 to 1 mole, per mole of light-sensitive silver halide.

The suitable total coverage of a light-sensitive silver halide emulsion and organic silver salts is from 0.1 to 20 $g/m^2$, preferably from 1 to 10 $g/m^2$, based on silver. The silver providing substances constitute about 5 to 70 weight % of the image-forming layer.

The organic silver salts are prepared by reacting silver nitrate with solutions or suspensions of organic compounds as recited above or alkali metal salts thereof (e.g., sodium, potssium or lithium salts) in an airtight vessel for mixing fluids. Specifically, the methods described in Japanese Patent Application Nos. 11-203413 and 11-104187, par. Nos. 19–21, can be adopted.

Alternatively, the method of adding a solution of organic compound and a solution of silver nitrate simultaneously to a solution of dispersing agent may be used.

In preparing the silver salt of an organic acid, it is possible to add a water-soluble dispersing agent to a water solution of silver nitrate, a solution of organic compound or an alkali metal salt thereof, or a reaction solution. Examples of the kind and the amount of a dispersing agent usable therein are described in JP-A-2000-292882, par. No. 52.

As the method of forming the silver salt of an organic compound, the method of forming the silver salt while controlling the pH as disclosed in JP-A-1-100177 can be used appropriately.

The organic silver salts formed in the above manners are preferably subjected to desalting treatment. The desalting treatment is not particularly restricted as to the method therefor, but any of known methods can be used. More specifically, known filtration methods, such as centrifugal filtration, suction filtration and ultrafiltration, and the method of washing through formation of flocks by coagulation can be used to advantage. To the ultrafiltration, the method described in JP-A-2000-292882 can be applied, For the purpose of preparing a dispersion of organic silver salt in a solid state which is small in particle size and free of agglomeration of particles, it is appropriate to use a dispersion method of converting an aqueous dispersion of organic silver salt to a high-speed flow and then lowering the pressure. To such a dispersion method, the methods described in Japanese Patent Application No. 11-104187, par. Nos. 27–38, can be applied.

The organic silver salts usable in the invention have no particular restriction as to the shape and the size, but they are used appropriately in the form of a dispersion of solid fine grains having an average size of 0.001 to 5.0 $\mu$m, preferably 0.005 to 1.0 $\mu$m.

The solid fine-grain dispersions of organic silver salts used in the invention are preferably monodisperse with respect to the grain size distribution. More specifically, the value obtained by dividing the standard deviation concerning a volume weighted average diameter by the volume weighted average diameter (variation coefficient) is, on a percentage basis, preferably 80% or below, more preferably 50% or below, particularly preferably 30% or below.

The solid fine-grain dispersions of organic silver salts used in the invention contain at least organic silver salts and water. The proportions of organic silver salts to water in the dispersions have no particular limitation, but the suitable proportion of an organic silver salt in each dispersion is from 5 to 50 weight %, particularly from 10 to 30 weight %. Therein, it is preferable to use the dispersing aids as mentioned above. And the dispersing aids are used in amounts as small as possible within the range suitable forminimization of grain sizes. More specifically, the suitable proportions of dispersing aids to organic silver salts is in the range of 0.5 to 30 weight %, particularly 1 to 15 weight %.

In the invention, metal ion chosen from Ca, Mg or Zn ion may be added to light-insensitive organic silver salts for prevention of fogging.

Further, the light-sensitive silver halides and/or reducible silver salts used in the invention are protected from additional fogging by known antifoggants or known stabilizers or precursors thereof, and can be stabilized against decrease in sensitivity during the stock storage. Examples of appropriate antifoggants, stabilizers and precursors of stabilizers which can be used alone or as combinations include the thiazolium salts disclosed in U.S. Pat. Nos. 2,131,038 and 2,694,716, the azaindenes disclosed in U.S. Pat. Nos. 2,886,437 and 2,444,605, the mercury salts disclosed in U.S. Pat. No. 2,728,663, the urazoles disclosed in U.S. Pat. No. 3,287,135, the sulfocatechols disclosed in U.S. Pat. No. 3,235,652, the oximes, nitrones and nitroindazoles disclosed in British Patent No. 623,338, the polyvalent metal salts disclosed in U.S. Pat. No. 2,839,405, the thiuronium salts disclosed in U.S. Pat. No. 3,220,839, the palladium, platinum and gold salts diclosed in U.S. Pat. Nos. 2,566,263 and 2,597,915, the halogen-substituted organic compounds disclosed in U.S. Pat. Nos. 4,108,665 and 4,442,202, the triazines disclosed in U.S. Pat. Nos. 4,128,557, 4,137,079, 4,138,365 and 4,459,350, the phosphorus compounds disclosed in U.S. Pat. No. 4,411,985, and the halogenated organic compounds disclosed in JP-A-50-119624, JP-A-54-58022, JP-A-56-70543, JP-A-56-99335, JP-A-61-129642, JP-A-62-129845, JP-A-6-208191, JP-A-7-5621, JP-A-8-15809 and U.S. Pat. Nos. 5,340,712, 5,369,000 and 5,464,737.

Besides containing color developing agents, the present heat-developable photosensitive materials may contain reducing agents. Suitable examples of reducing agents include reducing agents of hindered phenol type in addition to traditional photographic developers, such as phenidone, hydroquinone and catechol. It is appropriate that the reducing agents be incorporated in proportions of 5 to 50 mole %, preferably 10 to 40 mole %, to 1 mole of silver on the side where the image-forming layers are present. And the reducing agents may be added to any of layers on the side of a support where the image-forming layers are present. When the reducing agents are added to layers other than image-forming layers, it is preferable to add them in greater amounts, specifically in proportions of 10 to 50 mole % to 1 mole of silver. Additionally, the reducing agents may be the so-called precursors designed so as to function effectively only at a time of development.

In the heat-developable photosensitive materials utilizing organic silver salts, a wide variety of reducing agents can be used. Examples of reducing agents usable therein include the reducing agents disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,679,426, 3,751,252, 3,751,255, 3,761,270, 3,782,949, 3,839,048, 3,928,686 and 5,464,738, German Patent No. 2,321,328 and EP-A-0692732.

(I) Precursors

In general, bases are required for processing photographic light-sensitive materials, but the present photosensitive materials do not necessarily require bases. However, bases may be used in the invention for the purposes of acceleration of development, acceleration of reaction between a color developing agent and couplers as described hereinafter and promotion of color generation of dyes formed. To the present photosensitive materials, various base-providing methods can be applied. For instance, in the case of giving a base-generating function to the photosensitive material's part, the bases can be introduced into the photosensitive material in the form of their precursors. These precursors include the salts of bases and organic acids capable of undergoing decarboxylation by heat, and the compounds capable of releasing amines by intramolecular nucleophilic substitution reaction, Lossen rearrangement or Beckmann rearrangement. Examples of those compounds are disclosed in U.S. Pat. Nos. 4,514,493 and 4,657,848.

The present photosensitive materials may contain nucleophiles or precursors thereof for the purpose of accelerating reaction between color developing agents and couplers. Although various precursors of nucleophiles are known, the precursors of the type which produce or release bases by heating are used to advantage because they can release nucleophiles at a time of heat development. Representatives of base precursors capable of producing bases by heating are base precursors of thermal decomposition type (decarboxylation type) including the salts formed from carboxylic acids and bases. When the base precursors of decarboxylation type are heated, the carboxyl groups of the carboxylic acids undergo decarboxylation reaction and the bases are released. As the carboxylic acids, decarboxylation-sensitive sulfonylacetic acids and propiolic acids are used. The sulfonylacetic acids and proiolic acids preferably contain substituents having aromaticity (such as aryl groups and unsaturated heterocyclic groups) capable of accelerating decarboxylation. The base precursors of sulfonylacetates are described in JP-A-59-168441, and those of propiolates are described in JP-A-59-180537. The base's side components of decarboxylation-type base precursors are preferably organic bases, and far preferably amidine, guanidine and their derivatives. The organic bases are preferably diacidic bases, triacidic bases or tetraacidic bases, far preferably diacidic bases, and particularly preferably the diacidic bases of amidine or guanidine derivatives.

The precursors of diacidic bases, triacidic bases and tetraacidic bases of amidine derivatives are described in JP-B-7-59545. The precursors of diacidic bases, triacidic bases and tetraacidic bases of guanidine derivatives are described in JP-B-8-10321. Each of the diacidic bases of amidine derivatives or guanidine derivatives has (A) two amidine or guanidine moieties, (B) substituents attached to the amidine or guanidine moieties, and (C) a divalent linkage group binding the two amidine or guanidine moieties. Examples of substituents (B) include alkyl groups (including cycloalkyl groups), alkenyl groups, alkinyl groups, aralkyl groups and heterocyclic residues. Two or more of the substituents may be combined to form a nitrogen-containing heterocyclic ring. The linkage group (C) is preferably an alkylene group or a phenylene group. Examples of diacidic base precursors of amidine or guanidine derivatives which can be used to advantage in the invention include p-(phenylsulfonyl)-phenylsulfonylacetates such as BP-1 to BP-41, especially BP-9, BP-32, BP-35, BP-40 and BP-41, disclosed in JP-A-11-231457, pp. 19–26.

The amount of base precursors used is preferably 0.1 to 10 times by mole the amount of color developing agents used, and more preferably 0.3 to 3 times by mole the amount of color developing agents used. It is appropriate that the base precursors be dispersed in a state of solid fine grains.

(J) Binder

The present heat-developable photosensitive materials uses binders in light-sensitive layers and light-insensitive layers including colored layers, protective layers and interlayers. The binders can be selected arbitrarily from well-known natural or synthetic resins (such as gelatin, polyvinyl acetal, polyvinyl chloride, polyvinyl acetate, cellulose acetate, polyolefin, polyester, polystyrene, polyacrylonitrile, polycarbonate and SBR latex purified by ultra filtration). In those polymers, copolymers and terpolymers are included. And two or more of those polymers may be used in combination, if desired. The polymers are used in amounts enough to hold the intended ingredients therein. In other words, they are used in amounts effectively functioning as binder. The effective range of addition amounts can be determined properly by persons skilled in the arts.

Of those polymers, hydrophilic ones are preferred as binders of the photosensitive materials. Examples of hydrophilic polymers include the binders described in the above-cited Nos. of *Research Disclosure* and JP-A-64-13546, pp. 71–75. In particular, gelatin and combinations of gelatin with other water-soluble binders, such as polyvinyl alcohol, modified polyvinyl alcohol, cellulose derivatives and acrylamide polymers, are preferred over the others. The suitable coverage of binders is from 1 to 25 g/m$^2$, preferably from 3 to 20 g/m$^2$, far preferably from 5 to 15 g/m$^2$. The proportion of gelatin to the total binders is from 50 to 100% by weight, preferably from 70 to 100% by weight.

[II] Layer Structure of Heat-developable Photosensitive Material

A heat-developable photosensitive material according to the invention generally includes at least three kinds of light-sensitive layers differing in color sensitivity. Each light-sensitive layer has at least one silver halide emulsion layer. In a typical case, each light-sensitive layer has two or more silver halide emulsion layers substantially the same in color sensitivity but different in sensitivity to light. It is advantageous to use silver halide grains having a shape higher in the so-called aspect ratio, or the value obtained by dividing the grain's projected area diameter by grain's thickness, when the grains used have greater projected area diameters. Each light-sensitive layer is a unit light-sensitive layer having color sensitivity to any of blue light, green light and red light. In a silver halide color photographic material having a multilayer structure, unit light-sensitive layers are generally arranged in the order of a red-sensitive layer, a green-sensitive layer and a blue-sensitive layer, from the nearest to a support first. However, the arranging order mentioned above can be reversed, if needed, or another arranging order may be adopted wherein a light-sensitive layer having one color sensitivity is sandwiched between two layers whose color sensitivities are the same as each other but different from that of the former layer. The total thickness of light-sensitive layers is generally from 2 to 40 $\mu$m, and preferably from 5 to 25 $\mu$m.

It is preferable that two or more silver halide emulsion layers forming each of unit light-sensitive layers be arranged in an order that the sensitivity becomes lower toward a support as DE Patent No. 1,121,470 and GB Patent No. 923,045 disclose the arranging order relating to two layers constituted of a high-speed emulsion layer and a low-speed emulsion layer. Alternatively, as disclosed in JP-A-57-112751, JP-A-62-200350, JP-A-62-206541 and JP-A-62-206543, it may be chosen to arrange a low-speed emulsion layer on the side distant from a support and a high-speed emulsion layer on the side near to the support.

More specifically, one applicable arranging order of light-sensitive layers, from most distant from a support to nearest thereto, is a low-speed blue-sensitive layer (BL), a high-speed blue-sensitive layer (BH), a high-speed green-sensitive layer (GH), a low-speed green-sensitive layer (GL), a high-speed red-sensitive layer (RH) and a low-speed red-sensitive layer (RL), another applicable arranging order of light-sensitive layers is BH-BL-GL-GH-RH-RL, the layer most distant from a support first, and still another applicable arranging order is BH-BL-GH-GL-RL-RH, the layer most distant from a support first.

In addition, as disclosed in JP-B-34932, it is possible to arrange a blue-sensitive layer, GH, GL, RL and RH in order of mention, the layer most distant from a support first. And it is also possible as disclosed in JP-A-56-25738 and JP-A-62-63936 that a blue-sensitive layer, GL, RL, GH and RH are arranged in order of mention, the layer most distant from a support first.

Further, as disclosed in JP-A-49-15495, three silver halide emulsion layers differing in sensitivity may be arranged in the order in which the sensitivity is decreased toward a support. Namely a silver halide emulsion layer having highest sensitivity is arranged as the upper layer, a silver halide emulsion layer having lower sensitivity as the intermediate layer and a silver halide emulsion layer having sensitivity still lower than the intermediate layer as the lower layer. In another case where a unit light-sensitive layer is constituted of 3 layers differing in sensitivity, as disclosed in JP-A-59-202464, the arranging order of the 3 layers having the same color sensitivity may be a medium-speed emulsion layer, a high-speed emulsion layer and a low-speed emulsion layer in order of mention, the layer most distant from a support first.

Alternatively, a high-speed emulsion layer, a low-speed emulsion layer and a medium-speed emulsion layer may be arranged in order of mention, or a low-speed emulsion layer, medium-speed emulsion layer and a high-speed emulsion layer may be arranged in order of mention. When a unit light-sensitive layer is constituted of 4 or more layers, the arranging order may be changed widely as in the foregoing cases.

For improvement of color reproducibility, it is appropriate to arrange donor layers (CL) having spectral sensitivity distributions different from those of main light-sensitive layers, such as BL, GL and RL, in the neighborhood of or in vicinity to their respective main light-sensitive layers as disclosed in U.S. Pat. Nos. 4,663,271, 4,705,744 and 4,707,436, JP-A-62-160448 and JP-A-63-89850.

In the invention, silver halide, a dye-providing coupler and a color developing agent (or a precursor thereof) may be incorporated into the same layer, or they may be separated and added to different layers so long as reaction can occur between them. For instance, when the layer containing a color-developing agent is different from the layer containing silver halide, the raw-stock storability of the sensitive material can be heightened.

The relation between the spectral sensitivity and the hue of a coupler in each layer can be arbitrarily chosen. However, when a cyan coupler is used in a red-sensitive layer, a magenta coupler in a green-sensitive layer and a yellow coupler in a blue-sensitive layer, direct projective exposure can be performed on conventional color paper.

On the other hand, couplers capable of forming dyes having wavelengths of their respective absorption maximums within non-visible regions can be used in any of light-sensitive layers. According to the image-forming method of the invention, there is a case that after heat development the image information is read with CCD as the silver halide is left in the photosensitive material. Therefore, a coupler having the wavelengths of its absorption maximum in the infrared region is used in place of the yellow coupler in a blue-sensitive layer and reduces the influence of a reading load by the remaining silver halide. Thus, image information of good quality can be obtained.

Various light-insensitive layers, such as a protective layer, a subbing layer, an interlayer, a yellow filter layer and an antihalation layer, may be provided between silver halide emulsion layers, as the topmost layer or as the lowest layer. On the back of a support, various auxiliary layers including a backing layer can be provided. In those layers may be contained the foregoing couplers, developing agents and DIR, color stain inhibitors and dyes. More specifically, it is possible to provide the layer structures disclosed in the patents cited above, the subbing layer disclosed in U.S. Pat. No. 5,051,335, the interlayers containing solid pigments as disclosed in JP-A-1-167838 and JP-A-61-20943, the interlayers containing reducing agents and DIR compounds as disclosed in JP-A-1-120553, JP-A-5-34884 and JP-A-2-64634, the interlayers containing electron transfer agents as disclosed in U.S. Pat. Nos. 5,017,454 and 5,139,919, and JP-A-2-235044, the protective layer containing the reducing agents disclosed in JP-A-4-249245, or a combination of two or more of the layers recited above.

In the invention, a yellow filter layer, a magenta filter layer and an antihalation layer can be used as colored layers. By using these layers, in the case of providing a red-sensitive layer, a green-sensitive layer and a blue-sensitive layer in order of mention, the layer nearest to the support first, the yellow filter layer is disposed between a blue-sensitive layer and a green-sensitive layer, the magenta filter layer between a green-sensitive layer and a red-sensitive layer, and the cyan filter layer (antihalation layer) between a red-sensitive layer and a support. These colored layers may be brought into direct contact with emulsion layers, or may be arranged so as to come into contact with emulsion layers via interlayers made of gelatin. Further, they maybe arranged on the support side opposite to the emulsion layer-coated side. These dyes are used in such amounts that the layers containing them can have transmission densities of 0.03 to 3.0, preferably 0.1 to 1.0, as measured with blue light, green light and red light respectively. Specifically, the appropriate addition amount of dyes, though depends on $\epsilon$ and molecular weight, is from 0.005 to 2.0 millimoles/$m^2$, preferably from 0.05 to 1.0 millimole/$m^2$.

In the invention, it is preferable to use colored layers in which dyes decolorizable by treatment are contained. The expression "dyes in a yellow filter layer and an antihalation layer are decolorized or removed at a time of development" means that the quantity of dyes remaining after treatment is one-third or below, preferably one-tenth or below, the quantity of dyes just before coating.

The photosensitive material in the invention may contain a mixture of two or more dyes in each of colored layers. For instance, a mixture of three kinds of dyes, namely yellow, magenta and cyan dyes, may be used in the antihalation layer.

Examples of such dyes include the dyes disclosed in EP-A-549489 and the dyes ExF-2 to ExF-6 disclosed in JP-A-7-152129. The dyes dispersed in a state of microcrystalline grains as described in Japanese Patent Application No. 6-259805 can also be used.

On the other hand, it is possible to fix dyes to binders by use of mordants. The mordants and the dyes usable in this case are those known in the photographic field. More specifically, the mordants disclosed in U.S. Pat. No. 4,500,626, columns 58–59, JP-A-61-88256, pp. 32–41, JP-A-62-244043 and JP-A-62-244036 can be used.

Decolorizable leuco dyes can also be used. For example, JP-A-1-150132 discloses the silver halide photosensitive material containing a leuco dye colored in advance by using a metal salt of organic acid as a developer. The leuco dye-developer complex is decolorized by heat or reaction with an alkali agent.

Known leuco dyes can be used in the invention too. Descriptions of leuco dyes can be found in Moriga & Yoshida, *Senryo to Yakuhin,* 9, p. 84, Kaseihin Kogyo Kyokai, *Shinpan Senryou Binran*, p. 242, Maruzen (1970), R. Garner, *Reports on the Progress of Appl. Chem.,* 56, p. 199 (1971), *Senryo to Yakuhin,* 19, p. 230, Kaseihin Kogyo Kyokai (1974), *Shikizai,* 62, p. 288 (1989), and *Senshoku Kogyo,* 32, 208.

Examples of developers suitably used in the invention include developers of acid clay type, phenol-formaldehyde resins, and metal salts of organic acids. Examples of metal salt of organic acids usable as developers include metal salts of salicylic acids, metal salts of phenol-salicylic acid-formaldehyde resins, thiocyanates and metal salts of xanthogenic acid. As the metal for such salts, zinc is preferred in particular. As to the oil-soluble zinc salicylates, those disclosed in U.S. Pat. Nos. 3,863,146 and 4,046,941, and JP-B-52-1327 are usable.

Furthermore, various additives as mentioned below can be used together in the invention.

Dyes decolorizable by treatment in the presence of decoloring agents can also be used. Examples of such dyes include the cyclic ketomethylene compounds disclosed in JP-A-11-207027 and JP-A-2000-89414, the cyanine dyes disclosed in EP-A1-911693, and the polymethine dyes disclosed in U.S. Pat. No. 5,324,627, and the merocyanine dyes disclosed in JP-A-2000-112058.

Those decolorizable dyes are preferably added to photosensitive materials in a state of the microcrystalline grain dispersions as described above. Alternatively, they may be used in a state that oil droplets of the decolorizable dyes dissolved in oils and/or oil-soluble polymers are dispersed in a hydrophilic binder. A method suitable for preparation of such dispersions is an emulsification dispersion method including the method disclosed in U.S. Pat. No. 2,322,027. Therein, the high boiling oils as disclosed in U.S. Pat. Nos. 4,555,470, 4,536,466, 4,587,206, 4,555,476 and 4,599,296, and JP-B-3-62256 can be used, if necessary, in combination with low boiling organic solvents having boiling points in the range of 50 to 160° C. Additionally, two or more of high boiling oils may be used together. Alternatively, oil-soluble polymers may be used in place of or in combination with oils. Examples of such cases are disclosed in PCT international publication number WO 88/00723. The amount of high boiling oils and/or polymers used is from 0.01 to 10 g, preferably from 0.1 to 5 g, per g of dyes.

It is possible to use latex dispersion methods for dissolving dyes in polymers. Examples of a usable process and latex for impregnation are disclosed in U.S. Pat. No. 4,199,363, West German Patent Application (OLS) Nos. 2,541,274 and 2,541,230, JP-B-53-41091, and EP-A-029104.

In dispersing dyes into hydrophilicbinders, various surfactants can be used. For instance, the surfactants described in JP-A-59-157636, pp. 37–38, and *Kochi Gijuts*, No. 5, pp. 136–138, Aztec Corporation (Mar. 22, 1991) can be used. In addition, the surfactants of phosphate type as disclosed in Japanese Patent Application Nos. 5-204325 and 6-19247 and DE-A-932299 can also be used.

Hydrophilic binders used for dispersing dyes are preferably water-soluble polymers. Examples of such polymers include natural compounds, such as gelatin, proteins derived from gelatin and polysaccharides including cellulose derivatives, starch, gum arabic, dextran and pullulan, and synthetic high molecular compounds, such as polyvinyl alcohol, polyvinyl pyrrolidone and acrylamide polymers.

These water-soluble polymers may be used as combinations of two or more thereof. In particular, combinations of gelatin and other water-soluble polymers are used to advantage. The gelatin may be chosen from lime-processed gelatin, acid-processed gelatin, or the so-called delimed gelatin having a reduced content of calcium, and these gelatins may be used as combinations thereof.

The dyes recited above are decolorized when processed in the presence of a decoloring agent.

Examples of a decoloring agent usable therein include alcohol or phenols, amines or anilines, sulfinic acids or their salts, sulfurous acid and its salts, thiosulfuric acid and its salts, carboxylic acids or their salts, hydrazines, guanidines, aminoguanidines, amidines, thiols, cyclic or linear active methylene compounds, cyclic or linear active methine compounds, and anion species formed from those compounds.

Of these compounds, hydroxyamines, sulfinic acids, sulfurous acid, guanidines, aminoguanidines, heterocyclic thiols, and cyclic or linear active methylene and methine compounds are preferred over the others. In particular, guanidines and aminoguanidines are used to advantage. In addition, the base precursors as mentioned above are also suitable as decoloring agents.

It can be supposed that the decoloring agents are brought into contact with dyes at a time of processing and cause nucleophilic addition to dye molecules, thereby decoloring the dyes. It is appropriate to perform this decoloring treatment in the following manner: After or at the same time of imagewise exposure of a dye-containing silver halide photosensitive material, a processing element containing a decoloring agent or a precursor thereof is brought into face-to-face contact with the photosensitive material and heated in the presence of water, and then these materials are peeled apart. Thus, developed color images are formed in the silver halide photosensitive material, and at the same time, the dye is decolorized. In this case, it is appropriate that the color density of the dye after decolorization be reduced to at most one-third, preferably at most one-fifth, of the original color density of the dye. The amount of the decoloring agent used is 0.1 to 200 times by mole, preferably 0.5 to 100 times by mole, the amount of the dye used.

Further, it is also advisable to adopt a method of preventing a deterioration in the S/N ratio at a time of reading the color density of a dye used by choosing as the dye a reversibly decolorizable dye of the type which is colored at temperatures lower than the decoloring start temperature (T) but it is decolorized at least in part when heated up to temperatures not lower than T, and besides, this change is reversible, and reading the color density of the dye at a temperature higher than the decoloring start temperature (T° C.). Such a reversible dye can be prepared by combining a leuco dye, a phenolic developer and a higher alcohol as disclosed in JP-B-51-44706.

For various purposes, hardeners, surfactants, photographic stabilizers, antistatic agents, lubricants, matting agents, latexes, formaldehyde scavengers, dyes and UV absorbents can be used in the present photosensitive materials. Examples of these additives are disclosed in the above-cited Research Disclosures, and Japanese Patent Application No. 8-30103. Additionally, antistatic agents preferred in particular are fine grains of metal oxides, such as ZnO, $TiO_2$, $SnO_2$, $Al_2O_3$, $In_2O_3$, $SiO_2$, MgO, BaO, $MoO_3$ and $V_2O_5$.

As supports of the present photosensitive materials, transparent substances that can withstand processing temperatures are usable. Examples of such substances generally include paper, synthetic polymer films and other photographic supports as described in *Shashin Kogaku no Kiso-Ginen shashin Hen-*, pp. 223–240, compiled by Nippon Shashin Gakkai, published by Corona-sha Co., Ltd. in 1979. Examples of such substances include polyethylene terephthalate, polyethylene naphthalate, polycarbonate, polyvinyl chloride, polystyrene, polypropylene, polyimide and celluloses (e.g., triacetyl cellulose).

Of these substances, polyesters containing polyethylene naphthalate as their main components are preferred in particular. The expression "containing polyethylene naphthalate as a main component" means that the suitable proportion of naphthalene dicarboxylic acid in the total dicarboxylic acid residues is at least 50 mole %, preferably at least 60 mole %, more preferably at least 70 mole %. Such polyesters may be copolymers or polymer blends.

In the case of copolymers, it is preferable to contain as copolymerized units terephthalic acid, bisphenol A or/and cyclohexane dimethanol units besides naphthalene dicarboxylic acid units and ethylene glycol units. Of these copolymers, the copolymers including terephthalic acid units are most advantageous from the viewpoints of mechanical strength and cost.

Suitable polymers blended with polyethylene naphthalate are polyesters such as polyethylene terephthalate (PET), polyarylate (PAr), polycarbonate (PC) and polycyclohexanedimethanol terephthalate (PCT). In particular, PET-blended polymers are preferred from the viewpoints of mechanical strength and cost.

In the cases where requirements for heat resistance and curling characteristics are particularly strict, the supports disclosed in JP-A-6-41381, JP-A-6-43581, JP-A-5-51426, JP-A-6-51437, JP-A-6-51442, and Japanese Patent Application Nos. 4-251845, 4-231825, 4-253545, 4-258828, 4-240122, 4-221538, 5-21625, 5-15926, 4-331928, 5-199704, 6-13455 and 6-14666 can be advantageously used as supports for the present photosensitive materials.

Alternatively, supports formed mainly from styrene polymers having syndiotactic structures can also be used to advantage. The suitable support thickness is from 5 to 200 $\mu$m, preferably from 40 to 120 $\mu$m.

In order to make a support adhere to constituent layers of the photosensitive material, the support is preferably subjected to surface treatment. Examples of treatment suitable for this purpose include chemical treatment, mechanical treatment, corona discharge treatment, flame treatment, ultraviolet treatment, high-frequency treatment, glow discharge treatment, active plasma treatment, laser treatment, mixed-acid treatment and ozonization treatment. Of these surface treatments, ultraviolet treatment, flame treatment, corona discharge treatment and glow discharge are preferred over the others.

To mention a subbing layer next, it may be a single layer or a double layer. Examples of binders for such a subbing layer include copolymers prepared by using as starting materials monomers selected from among vinyl chloride, vinylidene chloride, butadiene, methacrylic acid, acrylic acid, itaconic acid and maleic anhydride, polyethylene imine, epoxy resin, grafted gelatins, nitrocellulose, gelatin, polyvinyl alcohol and modified products of these polymers. The subbing layer may contain resorcinol or p-chlorophenol as a compound capable of swelling a support. Examples of a gelatin hardener usable in the subbing layer include chromium salts (e.g., chrome alum), aldehydes (e.g., formaldehyde, glutaraldehyde), isocyanates, active halogen-containing compounds (e.g., 2,4-dichloro-6-hydroxy-s-triazine), epichlorohydrin resins and active vinylsulfon compounds. In addition, the subbing layer may contain inorganic fine grains, such as $SiO_2$ or $TiO_2$, or fine particles (0.01 to 10 $\mu$m) of methyl methacrylate copolymer as a matting agent.

As to the dyes used for dyeing films, it is preferable that they have tones enabling gray dyeing from the viewpoint of general properties of a photosensitive material. Further, dyes having excellent heat resistance in the temperature region for film formation and high compatibility with polyester are used to advantage. From these points of view, the foregoing purpose can be attained by mixing dyes commercially available for polyester use, such as Diaresin produced by Mitsubishi Chemical Corporation and Kayaset produced by NIPPON KAYAKU CO., LTD. Viewed from the heatproof stability in particular, the dyes of anthraquinone type are used to advantage. For example, the dyes disclosed in JP-A-8-122970 are included therein.

In the invention, it is preferable to record shooting information by using a support having a magnetic recording layer, such as the support disclosed in JP-A-4-124645, JP-A-5-40321, JP-A-6-35092 or JP-A-6-317875.

The magnetic recording layer is formed by coating on a support a coating composition prepared by dispersing magnetic particles and binder in a water-based or organic solvent.

Examples of usable magnetic particles include ferromagnetic iron oxides such as $\gamma Fe_2O_3$, Co-coated $\gamma Fe_2O_3$, Co-coated magnetite, Co-containing magnetite, ferromagnetic chromium dioxide, ferromagnetic metals, ferromagnetic alloys, and hexagonal-system Ba ferrite, Sr ferrite, Pb ferrite and Ca ferrite. Of these magnetic particles, Co-coated ferromagnetic iron oxides, such as Co-coated $\gamma Fe_2O_3$, are preferred over the others. Those particles may have any of acicular, rice-grained, spherical, cubic and tabular shapes. The suitable specific area thereof is at least 20 $m^2/g$, preferably at least 30 $m^2/g$, in terms of $S_{BET}$. The suitable saturation magnetization ($\sigma s$) of a ferromagnetic substance is from $3.0\times10^4$ to $3.0\times10^5$ A/m, particularly preferably $4.0\times10^4$ to $2.5\times10^5$ A/m. The ferromagnetic particles may be subjected to surface treatment with silica and/or alumina, or an organic material. Further, the surfaces of ferromagnetic particles may be treated with a silane coupling agent or a titanium coupling agent. The magnetic particles having surfaces coated with an inorganic or organic substance as disclosed in JP-A-4-259911 and JP-A-5-81652 are also usable.

For the purpose of imparting core-set resistance to a polyester support, the support is subjected to heat treatment at a temperature of from 40° C. to below Tg, preferably from Tg-20° C. to below Tg. The heat treatment may be carried out while keeping the temperature constant or lowering the temperature within the above temperature range. The time for the heat treatment is from 0.1 to 1,500 hours, preferably from 0.5 to 200 hours. The heat treatment of a support may be performed as the support has a roll form, or while feeding the support in the form of web. The surface condition of a support may be improved by roughening the support surface (e.g., by coating the support surface with inorganic fine particles having electric conductivity, such as $SnO_2$ or $Sb_2O_3$). Further, it is advisable to contrive a device for preventing the cut line of a roll core from being copied, e.g., by forming knurl on both edges of a support and raising the edge part alone. These thermal treatments may be carried out at any stage of support preparation, e.g., after formation of a film for support use, after surface treatment, after coating of a backing layer (containing an antistatic agent and a lubricant) or after coating of a subbing layer. Preferably, the thermal treatments are performed after coating of an antistatic agent.

The polyester kneaded in advance with an ultraviolet absorbent may be formed into a film. For the purpose of preventing light piping, polyester may be kneaded with a dye or pigment commercially available for polyester use, such as Diaresin produced by Mitsubishi Chemical Corporation or Kayaset produced by NIPPON KAYAKU CO., LTD., prior to film formation.

Then, film cartridges in which the photosensitive materials can be loaded are described below.

Main materials of cartridges usable in the invention may be metals or synthetic plastics.

A cartridge of the type which sends out film by rotation of a spool may be used in the invention. And the cartridge may have a structure that the leading end portion of a film is stored inside the body of the cartridge and pushed outward from the port part of the cartridge by rotating a spool axis in the film sending-out direction. Such a structure is disclosed in U.S. Pat. Nos. 4,834,306 and 5,226,613.

The present photosensitive materials can also be used to advantage in the lens-attached film units as disclosed in JP-B-2-32615 and JP-UM-B-3-39784.

Such lens-attached film units are picture-taking units which are each loaded in advance with an unexposed color or monochromatic photographic material inside the body of the unit having a photographic objective and a shutter installed in an injection molded plastic case during the process of manufacturing the unit. After users take photographs with such units, the resulting units are forwarded to processing laboratories for development as they are. The photographic films are taken out of the units in the processing laboratories, and subjected to development and formation of photographic prints.

[III] Image Forming Method

The present heat-developable photosensitive materials may be developed by any method. In general the development of these materials are effected through a temperature raise after imagewise exposure. In preferred modes of heat development, the imagewise exposed photosensitive materials are brought into contact with a heat block, a hot plate, a hot presser, a hot roller or a hot drum, or passed through a high-temperature atmosphere heated with a halogen lamp heater, an infrared lamp heater or a far infrared lamp heater.

In addition to commonly used electric heaters and lamp heaters, heated liquid, dielectric materials and microwave heaters can also be utilized as heat sources.

To mention a suitable form of heat processors, heat processors of the type which enable close contacts between heat-developable photosensitive materials and a heat source, such as a heat roller or a heat drum, are used to advantage in the invention. Examples of a heat processor of this type include the heat processors disclosed in JP-B-5-56499, Japanese Patent No. 684453, JP-A-9-292695, JP-A-9-297385 and WO 95/30934. On the other hand, the heat processors disclosed in JP-A-7-13294, WO 97/28489, WO 97/28488 and WO 97/28487 can be used as heat processors of non-contact type.

The suitable development temperature is from 100° C. to 350° C., preferably from 130° C. to 200° C., and the suitable development time is from 1 to 60 seconds, preferably from 3 to 30 seconds.

The photosensitive materials and/or processing materials used in the invention may have a form equipped with an electrically conductive heating element layer as a heating means for heat development. As the heating element used therein, the substances disclosed in JP-A-61-145544 can be utilized.

The exposed film-form photosensitive materials are generally separated from cartridges (or patrones) and placed in an unprotected state, and then undergo heat-development processing as they are. Alternatively, as disclosed in JP-A-2000-171961, it is also preferable to adopt the method of performing heat development while drawing out a film from a thrust cartridge and putting the developed film back into the thrust cartridge at the conclusion of the heat development. On the other hand, it is possible to carry out development by externally applying heat to a cartridge (or a patrone) in which an exposed film is loaded.

After formation of developed-color images by heat development, the remaining silver halide and/or developed silver may be removed, or may not be removed. As a method of producing output on another material in accordance with image information, usual projection exposure may be adopted, or the method of reading image information optoelectrically by transmission density measurements and producing output based on the signals from the information read may be adopted. Examples of a material on which output can be produced include photosensitive materials, and further sublimation-type heat-sensitive recording materials, ink-jet materials, electrophotographic materials and full-color direct heat-sensitive recording materials.

In a preferred embodiment of the present image-forming method, developed-color images are formed by heat development and, without carrying out any additional treatment for removal of the residual silver halide and developed silver, the information on the images formed is read optoelectrically by transmission density measurements using diffused light and a CCD image sensor. And the information read is converted into digital signals, subjected to image processing, and then output on a color printer of heat-development type, e.g., Pictrography 3000 made by Fuji Photo Film Co., Ltd. In this case, it is possible to produce prints of good quality speedily without using any processing solutions used in conventional photography. Further therein, as the digital signals can be manipulated freely, the images taken can be retouched, deformed and processed into desired shapes prior to output.

Additional steps for bleach and fixation are not always required for removal of the silver halide and the developed silver remaining in the photosensitive material after development. However, in order to reduce the image information-reading load and enhance the image storability, a fixing step and/or a bleaching step may be provided. In this case, the usual wet processing may be adopted, but it is preferable that these steps be performed by heating the developed material together with another sheet coated with the processing chemical as disclosed in JP-A-9-258402. The heating temperature in this case is preferably higher than 50° C., and particularly preferably set to the same temperature as in the development-processing step.

In the invention, the images are formed in the present photosensitive material and then, on the basis of the information on the images formed, color images are produced on another recording material. As a method adopted therein is preferred the method as mentioned above, wherein the information on the images is read optoelectrically by transmission density measurements, the information read is converted into digital signals, subjected to image processing, and then output on another recording material. Examples of a recording material on which the output is produced include sublimation-type heat-sensitive recording materials, full-color direct heat-sensitive recording materials, ink-jet materials and electrophotographic materials in addition to silver halide-utilized photosensitive materials.

It is required that the images formed in the present photosensitive material by heat development be read and converted into digital signals. As an apparatus for reading those images, known image input devices can be employed. Details of image input devices are described in Takao Andou et al., *Digital Gazo Nyuryoku no Kiso*, pp. 58–98 (1998).

The image input devices are required to capture enormous amounts of information with high efficiency, and fall roughly into two categories based on a configuration of minute point sensors: linear sensors and area sensors. In sensors of the former type, a great number of point sensors are aligned linearly. In capturing information on images of a sheet form, therefore, it is required to scan either the photosensitive material part or the sensor part. Consequently, the linear sensors require a rather long time to read information, but have a cost advantage. In the case of area sensors, neither photosensitive material nor sensor is scanned basically at a time of reading images. However, the area sensors are required to have large sizes although they can read images speedily, so they are comparatively expensive. Such being the cases, it is possible to choose a sensor suited to the purpose, so sensors of both types can be used as appropriate.

As to the type of sensors, there are two types, namely an electronic tube system, such as a pickup tube or an image tube, and a solid imaging system, such as sensors of a CCD or MOS form. From the viewpoint of a cost and a simple and easy handling, the solid imaging system is preferred, more preferably CCD form.

As an apparatus equipped with the foregoing image input device, commercially available digital still cameras, drum scanners, flatbed scanners and film scanners can be utilized. From the viewpoint of enabling simple-and-easy reading of high-quality images, the use of film scanners is preferred.

Typical examples of a commercially available film scanner using a linear CCD include Film Scanner LS-1000 from Nikon, Duo Scan HiD from Agfa and Flextight Photo from Imacon. In addition, area CCD-utilized Kodak RFS3570 is also used suitably.

Further, the area CCD-utilized image input unit mounted in Frontier, a digital print system from Fuji Photo Film, is also used to advantage. Furthermore, high-speed reading of high-quality images is achieved by the image input unit Frontier F350 described in Yoshio Ozawa, et al., *Fuji Film Kenkyu Houkoku*, No. 45, pp. 35–41, although this unit uses a linear CCD sensor. So this input unit is suited in particular to reading of heat-developable photosensitive materials.

In reading the image information on a photosensitive material by means of an image sensor, such as CMOS or CCD, the wavelength region in which each image is read can be determined by properly choosing a combination of a light source used for reading, a color filter attached to the light source and the color sensitivity of the image sensor used. Examples of a light source usable for reading include a xenon lamp, a halogen lamp, a tungsten lamp, LED and laser.

For reproduction of color images of good quality, it is appropriate that image information from dyes formed in three layers having different color sensitivities be read in three different wavelength regions corresponding respectively to the absorption peaks of the dyes ±50 nm and appropriate operations be performed on the image information read. In general, a photosensitive material containing yellow, magenta and cyan couplers having their absorption peaks in the visible region is used, and the information about dye images formed respectively from those couplers is read by use of blue light, green light and red light. Alternatively, at least one of the couplers forming dyes having their absorption peaks in the visible region may be replaced by a coupler having its absorption peak in a non-visible region and the image information in the non-visible region may be read. Compounds forming dyes having their absorption peaks in at least two different non-visible regions may be used in combination. As a non-visible light source for reading use, bright LEDs are easy to get. And CCDs are suitable as image sensors because of their high sensitivities in the infrared region.

Image-processing methods applicable to the present image-forming method are explained below.

The image-processing system and the image-processing method for reproducing a subject color faithfully from a negative film as disclosed in JP-A-6-139323 can be adopted. Therein, a subject image is formed in a color negative, and converted into the corresponding image data by the use of a scanner, and then the same color as the subject is output from the decoded color information.

As an image-processing method for controlling the graininess and the noise of a digitized image and enhancing sharpness, the method disclosed in JP-A-10-243238 and the image-processing method disclosed in JP-A-10-243239 may be employed. In the former method, operations for assigning weights to edge and noise and fragmenting are carried out on the basis of sharpness-enhanced image data, smoothed image data and edge detection data; while, in the latter method, an edge component is determined on the basis of sharpness-enhanced image data and smoothed image data and weights-assigning and fragmenting operations are performed.

For correcting changes of color reproduction in the final prints due to difference in storage and development conditions of shooting materials on the part of a digital color print system, the method disclosed in JP-A-10-255037 can be adopted. Therein, the unexposed area of a shooting material is exposed via at least 4-step or 4-color patch and developed, and then the patch densities are measured, both look-up table and color conversion matrix necessary for correction are determined, and color correction of photographic images are performed using the look-up table conversion and the matrix arithmetic.

As the method for conversion of image data color-reproducing region, the method disclosed in JP-A-10-229502 can be employed. Therein, with respect to an image data represented by color signals forming a color recognized visually as neutral color when the numerical values of elements of each color signal become identical, each color signal is separated into a colored component and a colorless component and these components are processed individually.

As an image-processing method for removing deterioration of image quality, such as aberration arising from a camera lens and lowering of peripheral light amounts, in images taken with a camera, the image-processing method and apparatus disclosed in JP-A-11-69277 may be adopted. Therein, a correction pattern of lattice form is recorded in advance on a film for making correction data on image deterioration, the images and the correction pattern are read with a film scanner after shooting, data for correcting a deterioration factor based on the camera lens is formed, and digital image data is corrected using the data on correction of the image deterioration.

Further, as a flesh color and sky blue give a discomfort impression when their sharpness is too much enhanced and thereby the graininess (noise) is also enhanced, it is preferable to control the extent of sharpness enhancement with respect to the skin color and sky blue. As a control method therefor, the method disclosed in JP-A-11-103393 may be adopted, wherein the unsharp masking (USM) coefficient is expressed as a function of (B-A) (R-A) in the sharpness enhancement processing using an unsharp mask.

A flesh color, grass green and sky blue are referred to as critical colors to the color reproduction, and require selective color-reproduction processing. With respect to lightness reproduction, it is visually preferred to give a light finish to the flesh color and an intense finish to the sky blue. As a method of reproducing the critical colors in visually preferred lightness, the method disclosed in JP-A-11-177835 may be adopted, wherein the pixel-by-pixel color signal is converted using coefficients that take small values when the corresponding hues are yellow and red as in the cases of (R-G) and (R-B), while using a coefficient that takes a large value in the case of cyan blue.

On the other hand, as method for compression of color signals, the method disclosed in JP-A-11-113023 may be adopted, wherein the pixel-by-pixel color signal is separated into a lightness component and a chromaticity component, and the template most fit to a pattern of numerical values is selected from a plurality of hue templates prepared in advance for the chromaticity component and the hue information is encoded.

In order to perform natural enhancement operations by suppressing defective conditions, such as loss in color gradation differentiation, washed-out highlights and flat high-density areas, and formation of data outside the defined regions in carrying out the processing for enhancement of saturation or sharpness, the image processing method and the apparatus disclosed in JP-A-11-177832 are applicable, wherein the exposure density data is made using a characteristic curve obtained from each color density data included in color image data, and thereon a color enhancement-contained image processing is performed, and further the characteristic curves made are taken as density data.

Furthermore, it is advantageous to remove unnecessary image information, such as scratches on a photosensitive material, noises and remaining developed silver, by reading image information in the region wherein the total absorption of dyes formed in all color-sensitive layers is minimum, preferably in the infrared region, and performing operations on the thus read image information in combination with image information in the maximum absorption regions of the dyes. In the case where a coupler which forms a dye having its absorption peak wavelength in the visible region is replaced by a coupler which forms a dye having its absorption peak wavelength in a non-visible region and the image information in the non-visible region is read, the image information may be read in at least two different non-visible regions. Alternatively, unnecessary image information about scratches on the photosensitive material, noises and residual developed silver may be removed using the information in the visible region.

The invention will now be illustrated in more detail by reference to the following examples, but these examples should not be construed as limiting the scope of the invention in any way.

EXAMPLE 1

(Preparation of High-speed Silver Halide Emulsions)

In a reaction vessel, 930 ml of distilled water containing 0.37 g of gelatin having an average molecular weight of 15,000, 0.37 g of acid processed gelatin and 0.7 g of potassium bromide was placed and heated up to 38° C. To this solution with vigorous stirring, 30 ml of a water solution containing 0.34 g of silver nitrate and 30 ml of a water solution containing 0.24 g of potassium bromide were added over a 20-second period. After the conclusion of the addition, the reaction solution was kept at 40° C. for 1 minute, and then heated up to 75° C. Thereto, 27.0 g of gelatin the amino groups of which were modified with trimellitic acid was added together with 200 ml of distilled water, and further thereto 100 ml of a water solution containing 23.36 g of silver nitrate and 80 ml of a water solution containing 16.37 g of potassium bromide were added over a 36-minute period while increasing flow rates thereof. Subsequently thereto, 250 ml of water solution containing 83.2 g of silver nitrate and a water solution containing potassium iodide and potassium bromide at a ratio of 3:97 by mole (wherein the bromide concentration was 26 weight %) were added over a 60-minute period while increasing flow rates thereof and controlling a silver potential of the resulting reaction solution to −50 mV relative to the saturated calomel electrode. Further thereto, 75 ml of a water solution containing 18.7 g of silver nitrate and a 21.9 weight % water solution of potassium bromide were added over a 10-minute period while controlling a silver potential of the resulting reaction solution to 0 mV relative to the saturated calomel electrode. After the conclusion of the addition, the reaction solution obtained was kept at 75° C. for 1 minute, and then cooled to 40° C. Further, the reaction solution was adjusted to pH 9.0 by the addition of 100 ml of a water solution containing 10.5 g of sodium p-iodoacetamidobenzenesulfonate monohydrate, and then admixed with 50 ml of a water solution containing 4.3 of sodium sulfite. The reaction mixture thus obtained was kept at 40° C. for 3 minutes, then heated up to 55° C., and further adjusted to pH 5.8. Thereto, 0.8 mg of sodium benzenethiosulfinate, 0.04 mg of potassium hexachloroiridate (IV) and 5.5 g of potassium bromide were added and kept at 55° C. for 1 minute. Further thereto, 180 ml of a water solution containing 44.3 g of silver nitrate and 160 ml of a water solution containing 34.0 g of potassium bromide and 8.9 mg of potassium hexacyanoferrate(II) were added over a 30-minute period. After cooling, the reaction solution was desalted in a usual manner. The desalted solution was admixed with gelatin so as to have a gelatin concentration of 7 weight %, and adjusted to pH 6.2.

The thus obtained emulsion was an emulsion containing hexagonal tabular grains having an average grain size of 1.15 μm expressed in terms of the sphere-equivalent diameter, an average grain thickness of 0.12 μm and an average aspect ratio of 24.0. This emulsion was named "Emulsion A-1".

Emulsion A-2 containing hexagonal tabular grains having an average grain size of 0.75 μm expressed in terms of the sphere-equivalent diameter, an average grain thickness of 0.11 μm and an average aspect ratio of 14.0 and Emulsion A-3 containing hexagonal tabular grains having an average grain size of 0.52 μm expressed in terms of the sphere-equivalent diameter, an average grain thickness of 0.09 μm and an average aspect ratio of 11.3 were prepared individually in the same manner as Emulsion A-1, except that the amounts of silver nitrate and potassium bromide added in the first step of grain formation were changed in every emulsion preparation and thereby the number of nuclei formed was made to differ from emulsion to emulsion. In addition, the amounts of potassium hexachloroiridate(IV) and potassium hexacyanoferrate(II) added were changed so as to be inversely proportional to the volume of the grains formed, while the amount of sodium p-iodoacetamidobenzenesulfonate monohydrate added was changed so as to be proportional to the circumferential length of the grains formed.

After addition of 5.6 ml of a 1 weight % of water solution of potassium iodide, Emulsion A-1 was spectrally and chemically sensitized with $8.2\times10^{-4}$ mole per mole Ag of the spectral sensitizing dye illustrated below, $1.25\times10^{-3}$ mole per mole Ag of Compound 1 illustrated below (a latent image regression inhibitor) and a chemical sensitizer composed of potassium thiocyanate, chloroauric acid, sodium thiosulfate and mono(pentafluorophenyl)diphenylphosphine selenide. After the conclusion of the chemical sensitization, Stabilizer S illustrated below was further added to the emulsion. The amount of the chemical sensitizer used herein was adjusted so that the emulsion was chemically sensitized to the optimum extent.

The structural formulae of the spectral sensitizing dye used, Compound 1 and Stabilizer S are illustrated below:

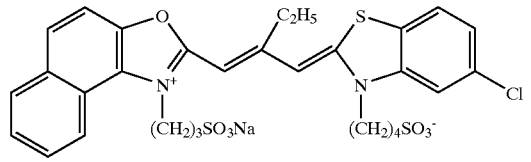

Compound 1

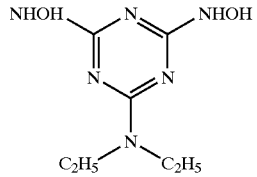

Stabilizer S (a mixture of the following compounds)

2 x $10^{-4}$ mole/mole Ag in Emulsion A-1

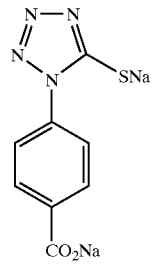

8 x $10^{-5}$ mole/mole Ag in Emulsion A-1

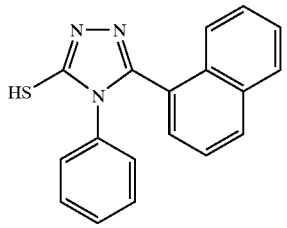

The thus sensitized blue-sensitive emulsion was named "Emulsion A-1b". Similarly to the above, Emulsion A-2 and Emulsion A-3 were each chemically and spectrally sensitized, thereby preparing Emulsion A-2b and Emulsion A-3b respectively. However, the amount of the spectral sensitizing dye added was changed in accordance with the surface area of silver halide grains in each emulsion. In addition, the amounts of chemicals used for chemical sensitization were adjusted respectively so that each emulsion was chemically sensitized to the optimum extent.

Green-sensitive Emulsions A-1g, A-2g and A-3g and red-sensitive Emulsions A-1r, A-2r and A-3r were prepared in the same manner as Emulsion A-1b, A-2b and A-3b, respectively, except that the spectral sensitizing dyes illustrated below were used respectively in place of the sensitizing dye illustrated above.

Sensitizing Dye I for Green-sensitive Emulsion 5.5 x $10^{-4}$ mole/mole silver in Emulsion A-1

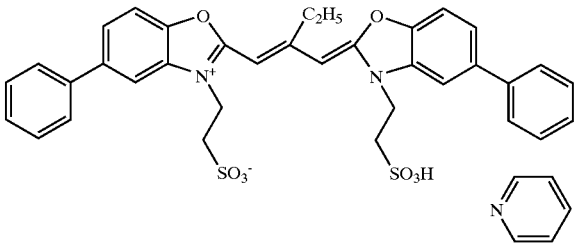

Sensitizing Dye II for Green-sensitive Emulsion 1.3 x $10^{-4}$ mole/mole silver in Emulsion A-1

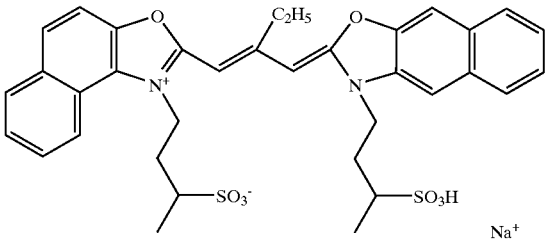

Sensitizing Dye III for Green-sensitive Emulsion 4.8 x $10^{-5}$ mole/mole silver in Emulsion A-1

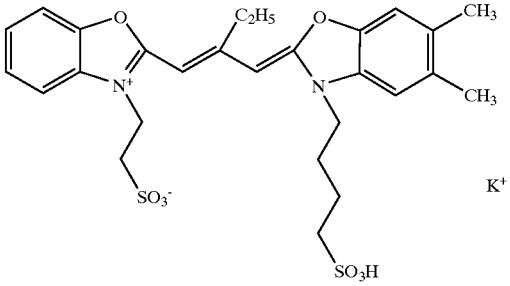

Sensitizing Dye I for Red-sensitive Emulsion 2.5 x $10^{-4}$ mole/mole silver in Emulsion A-1

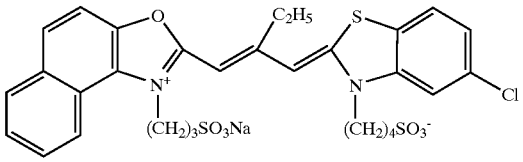

Sensitizing Dye II for Red-sensitive Emulsion 6.3 x $10^{-5}$ mole/mole silver in Emulsion A-1

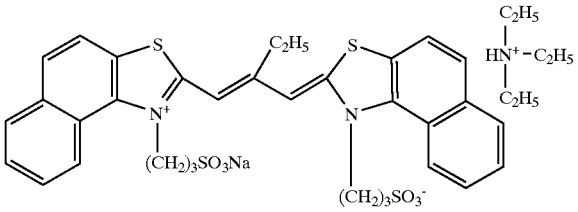

-continued

Sensitizing Dye III for Red-sensitive Emulsion 3.1 x $10^{-4}$ mole/mole silver in Emulsion A-1

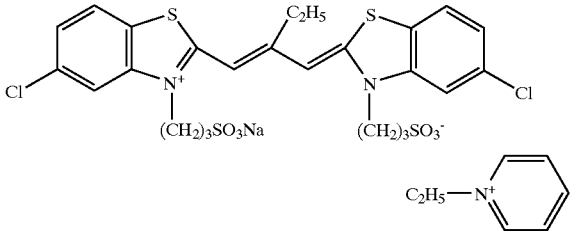

(Preparation of Silver Salt of 1-Phenyl-5-mercaptotetrazole)

In a reaction vessel, 431 g of lime-processed gelatin and 6,569 ml of distilled water were placed. Then, 320 g of 1-phenyl-5-mercaptotetrazole, 2,044 ml of distilled water and 790 g of a 2.5M water solution of sodium hydroxide were mixed together to prepare a solution B. The mixture in the reaction vessel was admixed with the solution B, and adjusted to pAg 7.25 and pH 8.00 by adding thereto nitric acid and sodium hydroxide in amounts required.

To the reaction vessel, 3,200 ml of a 0.54M water solution of silver nitrate was added at a rate of 250 ml/min with vigorous stirring and, at the same time, the solution B was added to the stirrer-inserted region of the reaction solution while controlling its addition amount so that the pAg of the reaction solution was kept at 7.25. After the conclusion of the addition, the mixture was concentrated by undergoing ultrafiltration. Thus, a dispersion containing fine particles of silver salt of 1-phenyl-5-mercaptotetrazole was obtained.

<Preparation of Benzotriazolesilver>

In 700 ml of water, 0.34 g of benzotriazole, 0.24 g of sodium hydroxide and 25 g of phthaloylated gelatin were dissolved and kept at 60° C. with stirring. To the stirrer-inserted region of the solution prepared, a solution containing 3.4 g of benzotrizole and 1.2 g of sodium hydroxide dissolved in 150 ml of water and a solution containing 5 g of silver nitrate dissolved in 150 ml of water were added simultaneously over a 4-minute period. After 5 minutes' stirring, a solution containing 3.4 g of benzotrizole and 1.2 g of sodium hydroxide dissolved in 150 ml of water and a solution containing 5 g of silver nitrate dissolved in 150 ml of water were added simultaneously to the stirrer-inserted region of the foregoing solution over a 6-minute period. The emulsion thus obtained was coagulated by controlling the pH and thereby excess salts were removed therefrom. Thereafter, the resulting emulsion was adjusted to pH 6.0. Thus, 470 g of a benzotriazolesilver emulsion was obtained.

<Production of Support>

In preparing a photosensitive material, a support was produced, and a subbing layer, an antistatic layer (first backing layer), a magnetic recording layer (second backing layer) and a third backing layer were coated on the support in the manners described hereinafter.

(1) Production of Support

The support used in this example was produced in the following process. After 100 parts by weight of polyethylene-2,6-naphthalenedicarboxylate (PEN) and 2 parts by weight of an ultraviolet absorbent, Tinuvin P.326 (produced by Ciba-Geigy Ltd.), were mixed homogeneously, the mixture was molten at 300° C., extruded from a T die, stretched to 3.3 times its original length at 40° C., and subsequently thereto stretched to 4 times its original width, and further subjected to 6 seconds' thermal setting at 250° C., thereby producing a 90 μm-thick PEN film. Additionally, appropriate amounts of blue dyes, magenta dyes and yellow dyes (I-1, I-4, I-6, I-24, I-26, I-27 and II-5 disclosed in *Journal of Technical Disclosure*, Kogi No. 94-6023) were mixed in the PEN film. Further, the PEN film was wound around a stainless steel tube having a diameter of 30 cm, and underwent 110° C.-48 hr. thermal hysteresis. Thus, a core set-resistant support was obtained.

(2) Coating of Subbing Layer

Both surfaces of the PEN support was subjected to glow discharge treatment in the following manner.

Four rod-like electrodes measuring 2 cm in diameter and 40 cm in length were anchored at 10-cm intervals into an insulating plate installed in a vacuum tank. In this vacuum tank, the film was arranged so as to travel at a distance of 15 cm away from the electrodes. Further, a temperature controller-equipped hot roll having a diameter of 50 cm was disposed just before the electrode zone so that the film was brought into contact with the hot roll by three-fourths of the circumference. The 90 μm-thick, 30 cm-wide biaxially stretched film was made to run, and heated by the hot roll so that the film surface had a temperature of 115° C. between the hot roll and the electrode zone. Successivly, the film was transported at a speed of 15 cm/sec and underwent glow discharge treatment.

The pressure inside the vacuum tank was 26.5 Pa, and the partial pressure of $H_2O$ in a gaseous atmosphere was 75%. And the glow discharge was performed under a condition that the discharge frequency was 30 kHz, the output was 2,500 W and the treatment strength was 0.5k·V·A·min/m$^2$. The vacuum glow discharge electrodes were prepared in accordance with the method disclosed in JP-A-7-3056.

On one side (emulsion side) of the glow discharge-treated PEN support, the subbing layer was provided according to the following formula. The coating condition was chosen so that the subbing layer provided had a dry thickness of 0.02 μm. Therein, the drying temperature was 115° C. and the drying time was 3 minutes.

| | |
|---|---|
| Gelatin | 83 parts by weight |
| Water | 291 parts by weight |
| Salicylic acid | 18 parts by weight |
| Aerosil R972 (colloidal silica produced by Nippon Aerosil Co., Ltd.) | 1 parts by weight |
| Methanol | 6,900 parts by weight |
| n-Propanol | 830 parts by weight |
| Polyamide-epichlorohydrin resin disclosed in JP-A-51-36119 | 25 parts by weight |

(3) Coating of Antistatic Layer (First Backing Layer)

A coarse dispersion was prepared by adding a 1N water solution of sodium hydroxide to a mixture of 40 parts by weight of SN-100 (conductive fine particles produced by Ishihara Sangyo Kaisha Ltd.) and 60 parts by weight of water while stirring the mixture, and then subjected to a dispersing operation with a horizontal sand mill. Thus, a conductive fine grain dispersion having an average secondary grain size of 0.06 μm (pH 7.0) was obtained.

A coating solution having the following composition was coated on the surface-treated PEN support (on the backing side) so as to have a coverage of 270 mg/m$^2$ based on the conductive fine particles. The drying conditions were 115° C. and 3 minutes.

| | |
|---|---|
| SN-100 (conductive fine particles produced by Ishihara Sangyo Kaisha Ltd.) | 270 parts by weight |
| Gelatin | 23 parts by weight |
| Rheodol TWL120 (surfactant produced by Kao Corp.) | 6 parts by weight |
| Denachol EX-521 (hardener produced by Nagase Chemtex Corporation) | 9 parts by weight |
| Water | 5,000 parts by weight |

(4) Coating of Magnetic Recording Layer (Second Backing Layer)

Magnetic particles CSF-4085V2 (Co-coated γ-$Fe_2O_3$ produced by Toda Kogyo Corp.) were surface-treated by using a silane coupling agent X-12-641 (produced by Shin-Etsu Chemical Industry Co., Ltd.) in a proportion of 16% by weight to the magnetic particles.

On the first backing layer, a coating solution having the following composition was coated so as to have a coverage of 62 mg/m$^2$ based on the CSF-485V2 treated with the silane coupling agent. Additionally, the magnetic particles and the abrasive shown below were dispersed in accordance with the method disclosed in JP-A-6-35092. The drying conditions were 115° C. and 1 minute.

| | |
|---|---|
| Diacetyl cellulose (binder) | 1,140 parts by weight |
| X-12-641-treated CSF-4085V2 (magnetic particles) | 62 parts by weight |
| AKP-50 (alumina produced by Sumitomo Chemical Co., Ltd., abrasive) | 40 parts by weight |
| Millionate (hardener, produced (by NIPPON POLYURETHANE INDUSTRY CO., LTD.) | 71 parts by weight |
| Cyclohexanone | 12,000 parts by weight |
| Methyl ethyl ketone | 12,000 parts by weight |

The increment of color density by DB of the magnetic recording layer under X-light (blue filter) was about 0.1, the saturation magnetization moment of the magnetic recording layer was 4.2 emu/g, the coercive force was $7.3\times10^4$ A/m, and the squareness ratio was 65%.

(5) Coating of Third Backing Layer

On the magnetic recording layer side of the photosensitive material, a third backing layer was coated. Wax (1-2) having the following formula was emulsified in water and dispersed by use of a high-pressure homogenizer to prepare an aqueous dispersion of wax having a concentration of 10 weight % and a weight average particle size of 0.25 μm.

Wax (1-2)

$n\text{-}C_{17}H_{35}COOC_{40}H_{81}\text{-}n$

A coating solution having the following composition was coated on the magnetic recording layer (second backing layer) at a wax coverage of 27 mg/m$^2$. The drying conditions were 115° C. and 1 minute.

| | |
|---|---|
| Aqueous dispersion of wax (10 weight %) | 270 parts by weight |
| Purified water | 176 parts by weight |
| Ethanol | 7,123 parts by weight |
| Cyclohexanone | 841 parts by weight |

(Preparation of Emulsion Dispersions Containing Yellow Couplers)

A yellow coupler (CPY-1) in an amount of 8.95 g, 0.90 g of a development accelerator (X), 4.54 g of a high-boiling organic solvent (e), 4.54 g of a high-boiling organic solvent (f) and 50.0 ml of ethyl acetate were mixed together at 60° C. The solution obtained was admixed with 200 g of a water solution containing 18.0 g of lime-processed gelatin and 0.8 g of sodium dodecylbenzenesulfonate, and emulsified into a dispersion by using a dissolver stirrer at 10,000 r.p.m for 20 minutes. Then, distilled water was added in an amount to make the total amount 300 g and mixed at 2,000 r.p.m for 10 minutes.

Another emulsion was prepared in the same manner as described above, except that 8.95 g of the yellow coupler (CPY-1) was replaced by 8.95 g of a yellow coupler (CPY-2).

The structural formulae of the yellow couplers (CPY-1) and (CPY-2), the development accelerator (X) and the high-boiling organic solvents (e) and (f) are illustrated below:

Yellow Coupler (CPY-1)

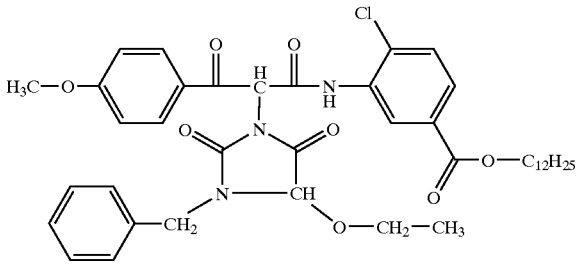

Yellow Coupler (CPY-2)

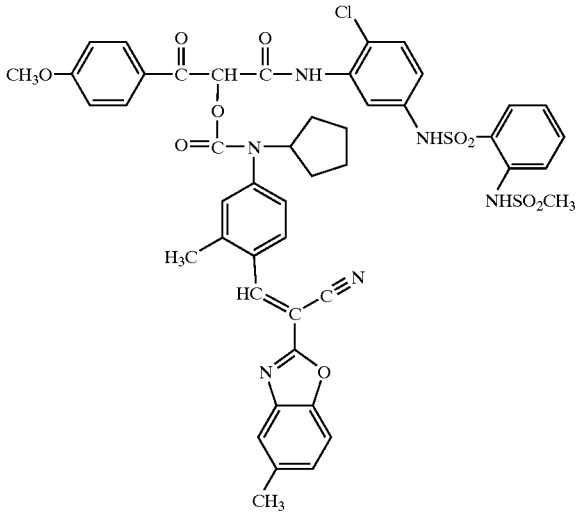

-continued

Development Accelerator (X)

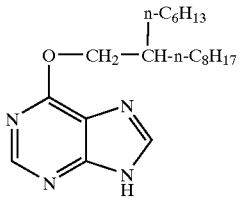

High-boiling Organic Solvent (e)

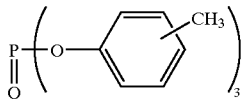

High-boiling Organic Solvent (f)

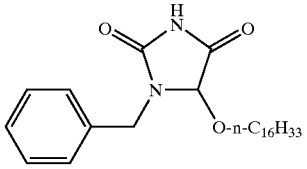

Similarly to the yellow coupler dispersions, magenta coupler dispersions and cyan coupler dispersions were prepared.

A magenta coupler (CPM-1) in an amount of 4.68 g, 2.38 g of a magenta coupler (CPM-2), 0.71 g of a development accelerator (X), 7.52 g of a high-boiling organic solvent (e) and 38.0 ml of ethyl acetate were mixed together at 60° C. The solution obtained was admixed with 150 g of a water solution containing 12.2 g of lime-processed gelatin and 0.8 g of sodium dodecylbenzenesulfonate, and emulsified into a dispersion by using a dissolver stirrer at 10,000 r.p.m. for 20 minutes. Then, distilled water was added in an amount to make the total amount 300 g and mixed at 2,000 r.p.m. for 10 minutes.

Another emulsion was prepared in the same manner as described above, except that 4.68 g of the magenta coupler (CPM-1) was replaced by 4.68 g of a magenta coupler (CPM-3).

The structural formulae of the magenta couplers (CPM-1), (CPM-2) and (CPM-3) are illustrated below. Additionally, x:y:z in the formula of magenta coupler (CPM-2) was 50:25:25 by weight.

Magenta Coupler (CPM-1)

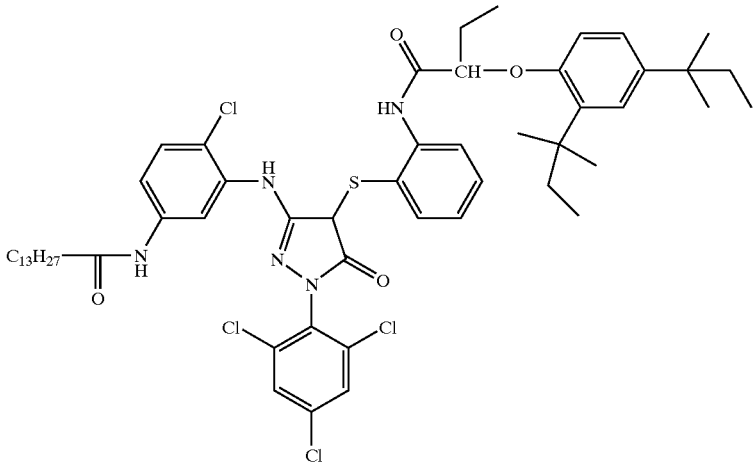

Magenta Coupler (CPM-2)

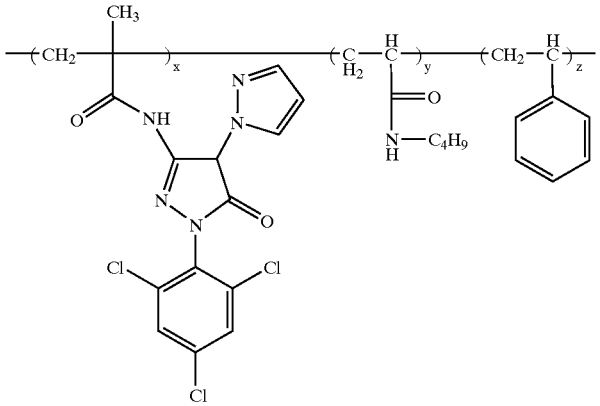

Magenta Coupler (CPM-3)

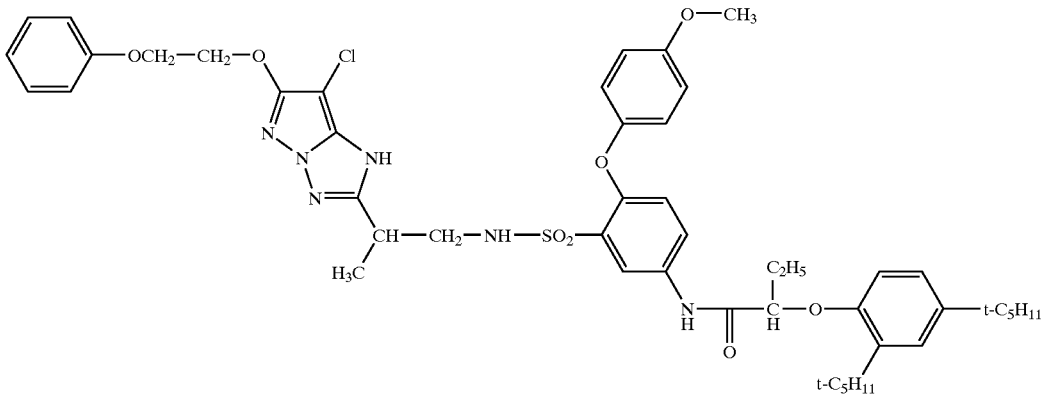

A cyan coupler (CPC-1) in an amount of 7.32 g, 3.10 g of a magenta coupler (CPC-2), 1.04 g of a development accelerator (X), 11.6 g of a high-boiling organic solvent (e) and 38.0 ml of ethyl acetate were mixed together at 60° C. The solution obtained was admixed with 150 g of a water solution containing 12.2 g of lime-processed gelatin and 0.8 g of sodium dodecylbenzenesulfonate, and emulsified into a dispersion by using a dissolver stirrer at 10,000 r.p.m. for 20 minutes. Then, distilled water was added in an amount to make the total amount 300 g and mixed at 2,000 r.p.m. for 10 minutes.

Another emulsion was prepared in the same manner as described above, except that 7.32 g of the cyan coupler (CPC-1) and 3.10 g of the cyan coupler (CPC-2) were replaced by 7.32 g of a cyan coupler (CPC-3) and 3.10 g of a cyan coupler (CPC-4) respectively. The structural formulae of the cyan couplers (CPC-1), (CPC-2), (CPC-3) and (CPC-4) are illustrated below:

Cyan Coupler (CPC-1)

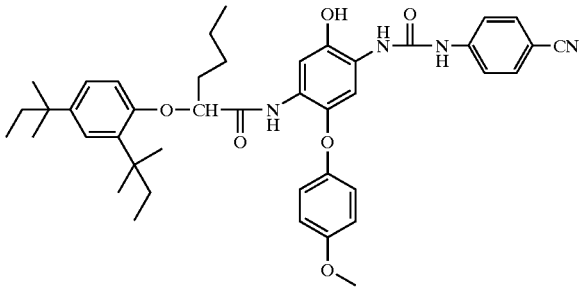

Cyan Coupler (CPC-2)

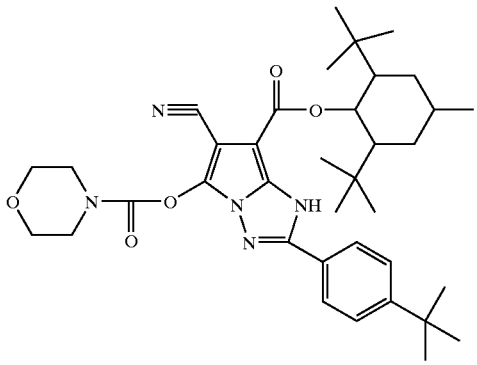

Cyan Coupler (CPC-3)

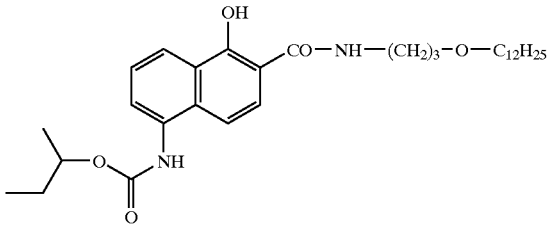

Cyan Coupler (CPC-4)

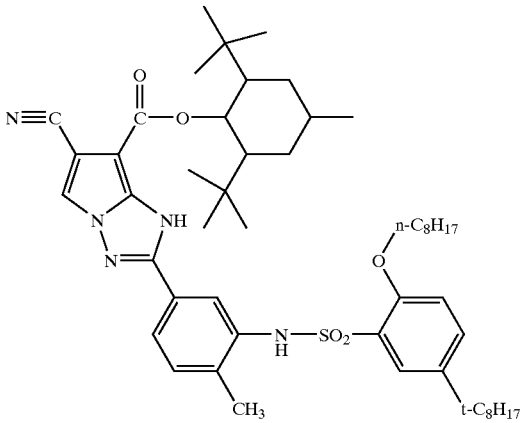

<Preparation of Colorless Coupler Dispersion>

A dispersion of colorless coupler CX-1 in a microcrystalline state was prepared in the following manner.

Water in an amount of 100 g and 0.5 g of Alkanol XC (trade name, a product of DuPont) were added to 50 g of a colorless coupler CX-1 and 30 g of a 10 weight % water solution of modified polyvinyl alcohol (Poval MP203 produced by Kuraray Co., Ltd.), and mixed thoroughly into slurry. By use of a diaphragm pump, the slurry obtained was fed into a horizontal sand mill (UVM-2 made by IMEX Co., Ltd.) packed with zirconia beads having an average diameter of 0.5 mm. Therein, the slurry underwent a dispersing operation for 6 hours. Further, water was added thereto so that the intended compound concentration became 10 weight %. The grains in the thus obtained dispersion of the intended compound had a median diameter of 0.30 μm and the maximum diameter of 1.0 μm or below. The dispersion of the intended compound was filtrated with a polypropylene filter having an average pore size of 10.0 μm for removal of extraneous matter, such as dusts, and stored. In addition, it was filtrated again with a polypropylene filter having an average pore size of 10.0 μm just before practical use. The structural formula of the colorless coupler CX-1 is illustrated below:

CX-1

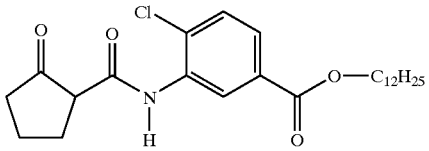

(Preparation of Solid Dispersions of Internal Developing Agents)

A dispersion of internal developing agent DEVP-LX in a microcrystalline state was prepared in the following manner.

Water in an amount of 100 g and 1.0 g of Surfactant 10G produced by Arch Chemicals Incorporated were added to 50 g of an internal developing agent DEVP-1x and 30 g of a 10 weight % water solution of polyvinyl pyrrolidone, and mixed thoroughly into slurry. By use of a diaphragm pump, the slurry obtained was fed into a horizontal sand mill (UVM-2 made by IMEX Co., Ltd.) packed with zirconia beads having an average diameter of 0.5 mm. Therein, the slurry underwent a dispersing operation for 6 hours. Further, water was added thereto so that the intended compound concentration became 10 weight %. The grains in the thus obtained dispersion of the intended compound had a median diameter of 0.50 μm and the maximum diameter of 1.5 μm or below. The dispersion of the intended compound was filtrated with a polypropylene filter having an average pore size of 10.0 μm for removal of extraneous matter, such as dusts, and stored. In addition, it was filtrated again with a polypropylene filter having an average pore size of 10.0 μm just before practical use.

Another dispersion containing an internal developing agent DEVP-2x in a microcrystalline state was prepared in the following manner.

Water in an amount of 100 g and 0.5 g of Alkanol XC were added to 50 g of an internal developing agent DEVP-2x and 30 g of a 10 weight % water solution of modified polyvinyl alcohol (Poval MP203 produced by Kuraray Co., Ltd.), and mixed thoroughly into slurry. By use of a diaphragm pump, the slurry obtained was fed into a horizontal sand mill (UVM-2 made by IMEX Co., Ltd.) packed with zirconia beads having an average diameter of 0.5 mm. Therein, the slurry underwent a dispersing operation for 6 hours. Further, water was added thereto so that the intended compound concentration became 10 weight %. The grains in the thus obtained dispersion of the intended compound had a median diameter of 0.30 μm and the maximum diameter of 1.0 μm or below. The dispersion of the intended compound was filtrated with a polypropylene filter having an average pore size of 10.0 μm for removal of extraneous matter, such as dusts, and stored. In addition, it was filtrated again with a polypropylene filter having an average pore size of 10.0

μm just before practical use. The structural formulae of the internal developing agents DEVP-1x and DEVP-2x are illustrated below:

DEVP-1X

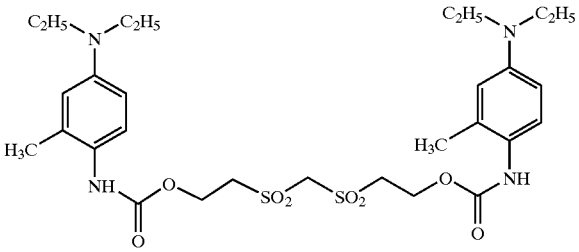

DEVP-2X

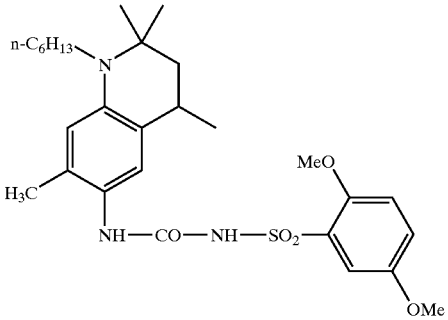

Furthermore, dye dispersions used for coloring interlayers functioning as filter or antihalation layers and decolorized by heating were prepared.

<Preparation of Yellow Dye Composition 101 (Y-101)>

In 200 ml of ethyl acetate, 10 g of a leuco dye (L1), 10 g of a developer (SD-1) and 10 g of a color image stabilizer (HP-1) were dissolved. The solution obtained was mixed in 600 g of a water solution containing 2.0 g of Alkanol XC, and emulsified into a dispersion by using a dissolver stirrer at 10,000 r.p.m. for 20 minutes. The dispersion obtained was stirred for 30 minutes at 50° C. in a stream of nitrogen to remove the ethyl acetate therefrom. Then, distilled water was added thereto in an amount to make the total amount 1,000 g and mixed for 10 minutes at 2,000 r.p.m. To the resulting dispersion were added a solution containing 60 g of lime-processed gelatin dissolved in 500 g of 50° C. water and 300 g of a 20% water-based dispersion of latex E-13 (methyl methacrylate/2-carboxyethyl acrylate (95/5) copolymer, Tg:100° C., average particle size: 80 nm).

<Preparation of Magenta Dye Composition 101 (M-101) and Cyan Dye Composition 101 (C-101)>

M-101 and C-101 were prepared in the same manner as Y-101, except that the leuco dye (L1) was replaced by a leuco dye (L2) and a leuco dye (L3) respectively.

Leuco Dye (L1)

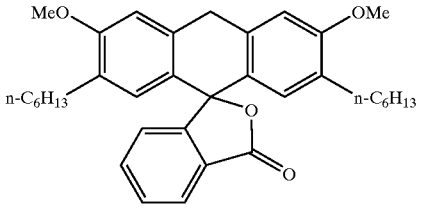

-continued

Developer (SD-1)

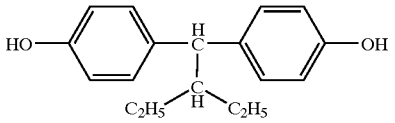

Leuco Dye (L2)

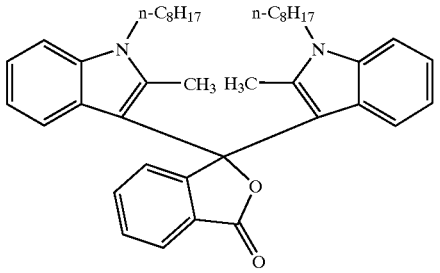

Leuco Dye (L3)

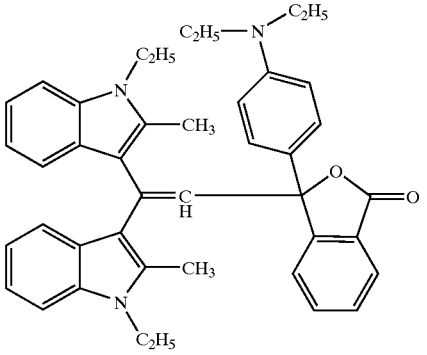

Color Image Stabilizer HP-1

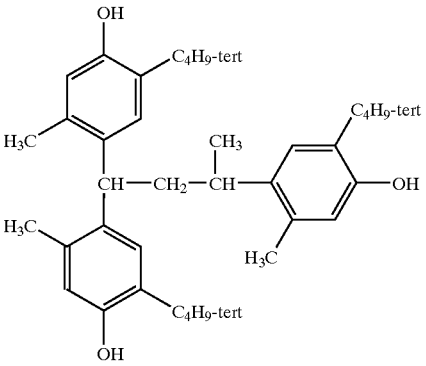

By using those emulsions, multicolor heat-developable photosensitive materials, Sample No. 101 and Sample No. 102, shown in Table 1 were prepared. Additionally, the structures of the ingredients set forth in Table 1 are illustrated hereinafter, and the molecular weight of the water-soluble polymer (C) is about 30,000. The amounts of the ingredients used are expressed in parts by weight.

TABLE 1

| | Photosensitive Material (Sample No. 101) | | Photosensitive Material (Sample No. 102) | |
|---|---|---|---|---|
| | Ingredient | 1* | Ingredient | 1* |
| Protective layer | Lime-processed gelatin | 1623 | Lime-processed gelatin | 1623 |
| | Matting agent (silica) | 50 | Matting agent (silica) | 50 |
| | Surfactant (a) | 30 | Surfactant (a) | 30 |
| | Surfactant (b) | 87 | Surfactant (b) | 87 |
| | Water-soluble polymer (c) | 52 | Water-soluble polymer (c) | 52 |
| | Hardener (t) | 351 | Hardener (t) | 351 |
| Interlayer | Lime-processed gelatin | 461 | Lime-processed gelatin | 1618 |
| | Surfactant(b) | 5 | Surfactant(b) | 19 |
| | | | Salicylanilide | 527 |
| | Formaldehyde scavenger (d) | 150 | Formaldehyde scavenger (d) | 0 |
| | Water soluble polymer (c) | 15 | Water soluble polymer (c) | 15 |
| Yellow color forming layer (High-speed layer) | Lime-processed gelatin | 1750 | Lime-processed gelatin | 1224 |
| | Emulsion A-1b (based on silver) | 550 | Emulsion A-1b (based on silver) | 735 |
| | Benzotriazole silver (based on silver) | 165 | Benzotriazole silver (based on silver) | 449 |
| | Silver salt of 1-phenyl-5-mercaptotetrazole | 437 | 1-Dodecyl-5-mercaptotetrazole | 24 |
| | | | 4-Benzyl-5-butyl-3-mercapto-triazole | 6 |
| | Yellow coupler (CPY-1) | 179 | Yellow coupler (CPY-1) | 178 |
| | DEVP-1X | 230 | DEVP-2X | 467 |
| | Development accelerator (X) | 17.9 | Development accelerator (X) | 11.0 |
| | High-boiling organic solvent (e) | 90 | High-boiling organic solvent (e) | 90 |
| | High-boiling organic solvent (f) | 115 | High-boiling organic solvent (f) | 90 |
| | Surfactant (g) | 27 | Surfactant (g) | 31 |
| | Salicylanilide | 200 | Salicylanilide | 206 |
| | Water-soluble polymer (c) | 1 | Water-soluble polymer (c) | 28 |
| Yellow color forming layer (Medium-speed layer) | Lime-processed gelatin | 1470 | Lime-processed gelatin | 1470 |
| | Emulsion A-2b (based on silver) | 263 | Emulsion A-2b (based on silver) | 263 |
| | Benzotriazole silver (based on silver) | 79 | Benzotriazole silver (based on silver) | 79 |
| | Silver salt of 1-phenyl-5-mercaptotetrazole | 209 | 1-Dodecyl-5-mercaptotetrazole | 6 |
| | | | 4-Benzyl-5-butyl-3-mercaptotriazole | 12 |
| | Yellow coupler (CPY-2) | 269 | Yellow coupler (CPY-2) | 269 |
| | DEVP-1X | 380 | DEVP-2X | 380 |
| | Development accelerator (X) | 26.9 | Development accelerator (X) | 26.1 |
| | High-boiling organic solvent (e) | 134 | High-boiling organic solvent (e) | 134 |
| | High-boiling organic solvent (f) | 190 | High-boiling organic solvent (f) | 190 |
| | Surfactant (g) | 26 | Surfactant (g) | 26 |
| | Salicylanilide | 300 | Salicylanilide | 300 |
| | Water-soluble polymer (c) | 2 | Water-soluble polymer (c) | 2 |
| Yellow color forming layer | Lime-processed gelatin | 1680 | Lime-processed gelatin | 1360 |
| | Emulsion A-3b (based on silver) | 240 | Emulsion A-2b (based on silver) | 608 |

TABLE 1-continued

| | Photosensitive Material (Sample No. 101) | | Photosensitive Material (Sample No. 102) | |
|---|---|---|---|---|
| | Ingredient | 1* | Ingredient | 1* |
| (Low-speed layer) | Benzotriazole silver (based on silver) | 72 | Benzotriazole silver (based on silver) | 351 |
| | Silver salt of 1-phenyl-5-mercaptotetrazole | 191 | 1-Dodecyl-5-mercaptotetrazole | 19 |
| | | | 4-Benzyl-5-butyl-3-mercaptotriazole | 15 |
| | Yellow coupler (CPY-2) | 448 | Yellow coupler (CPY-2) | 419 |
| | DEVP-1X | 590 | DEVP-2X | 366 |
| | Development accelerator (X) | 44.8 | Development accelerator (X) | 25.0 |
| | High-boiling organic solvent (e) | 224 | High-boiling organic solvent (e) | 212 |
| | High-boiling organic solvent (f) | 295 | High-boiling organic solvent (f) | 212 |
| | Surfactant (g) | 30 | Surfactant (g) | 73 |
| | Salicylanilide | 600 | Salicylanilide | 162 |
| | Water-soluble polymer (c) | 3 | Water-soluble polymer (c) | 2 |
| Interlayer (Yellow filter layer) | Lime-processed gelatin | 768 | Lime-processed gelatin | 768 |
| | Surfactant (b) | 58 | Surfactant (b) | 58 |
| | Surfactant (g) | 60 | Surfactant (g) | 60 |
| | Latex E-13 | 2250 | Latex E-13 | 2250 |
| | Leuco dye (L1) | 300 | Leuco dye (L1) | 300 |
| | Developer (SD-1) | 300 | Developer (SD-1) | 300 |
| | | | Colorless coupler CX-1 | 80 |
| | | | Salicylanilide | 449 |
| | Water-soluble polymer (c) | 15 | Water-soluble polymer (c) | 15 |
| Magenta color forming layer (High-speed layer) | Lime-processed gelatin | 781 | Lime-processed gelatin | 590 |
| | Emulsion A-1g (based on silver) | 488 | Emulsion A-1g (based on silver) | 699 |
| | Benzotriazole silver (based on silver) | 146 | Benzotriazole silver (based on silver) | 89 |
| | Silver salt of 1-phenyl-5-mercaptotetrazole | 388 | 1-Dodecyl-5-mercaptotetrazole | 7 |
| | Magenta coupler (CPM-1) | 47 | Magenta coupler (CPM-1) | 66 |
| | Magenta coupler (CPM-2) | 24 | Magenta coupler (CPM-2) | 0 |
| | DEVP-1X | 74 | DEVP-2X | 145 |
| | Development accelerator (X) | 4.7 | Development accelerator (X) | 6.6 |
| | High-boiling organic solvent (e) | 75 | High-boiling organic solvent (e) | 66 |
| | Surfactant (g) | 8 | Surfactant (g) | 26 |
| | Salicylanilide | 100 | Salicylanilide | 49 |
| | Water-soluble polymer (c) | 8 | Water-soluble polymer (c) | 13 |
| Magenta color forming layer | Lime-processed gelatin | 659 | Lime-processed gelatin | 441 |
| | Emulsion A-2g (based on silver) | 492 | Emulsion A-2g (based on silver) | 339 |

TABLE 1-continued

| | Photosensitive Material (Sample No. 101) | | Photosensitive Material (Sample No. 102) | |
|---|---|---|---|---|
| | Ingredient | 1* | Ingredient | 1* |
| (Medium-speed layer) | Benzotriazole silver (based on silver) | 148 | Benzotriazole silver (based on silver) | 67 |
| | Silver salt of 1-phenyl-5-mercaptotetrazole | 391 | 1-Dodecyl-5-mercaptotetrazole | 5 |
| | Magenta coupler (CPM-3) | 94 | Magenta coupler (CPM-3) | 37 |
| | Magenta coupler (CPM-2) | 48 | Magenta coupler (CPM-2) | 12 |
| | DEVP-1X | 140 | DEVP-2X | 109 |
| | Development accelerator (X) | 14.1 | Development accelerator (X) | 4.9 |
| | High-boiling organic solvent (e) | 150 | High-boiling organic solvent (e) | 66 |
| | Surfactant (g) | 11 | Surfactant (g) | 20 |
| | Salicylanilide | 80 | Salicylanilide | 36 |
| | Water-soluble polymer (c) | 14 | Water-soluble polymer (c) | 14 |
| Magenta color forming layer (Low-speed layer) | Lime-processed gelatin | 711 | Lime-processed gelatin | 876 |
| | Emulsion A-3g (based on silver) | 240 | Emulsion A-3g (based on silver) | 644 |
| | Benzotriazole silver (based on silver) | 72 | Benzotriazole silver (based on silver) | 122 |
| | Silver salt of 1-phenyl-5-mercaptotetrazole | 191 | 1-Dodecyl-5-mercaptotetra-zole | 10 |
| | Magenta coupler (CPM-3) | 234 | Magenta coupler (CPM-3) | 137 |
| | Magenta coupler (CPM-2) | 119 | Magenta coupler (CPM-2) | 137 |
| | DEVP-1X | 349 | DEVP-2X | 199 |
| | Development accelerator (X) | 35.3 | Development accelerator (X) | 27.4 |
| | High-boiling organic solvent (e) | 376 | High-boiling organic solvent (e) | 273 |
| | Surfactant (g) | 29 | Surfactant (g) | 109 |
| | Salicylanilide | 80 | Salicylanilide | 67 |
| | Water-soluble polymer (c) | 14 | Water-soluble polymer (c) | 23 |
| Interlayer (Magenta filter layer) | Lime-processed gelatin | 850 | Lime-processed gelatin | 850 |
| | Surfactant (b) | 8 | Surfactant (b) | 8 |
| | Surfactant (g) | 15 | Surfactant (g) | 15 |
| | Latex E-13 | 563 | Latex E-13 | 563 |
| | Leuco dye (L2) | 75 | Leuco dye (L2) | 75 |
| | Developer (SD-1) | 75 | Developer (SD-1) | 75 |
| | | | Formaldehyde scavenger (d) | 300 |
| | | | Colorless coupler CX-1 | 110 |
| | | | Salicylanilide | 328 |
| | Water-soluble polymer (c) | 15 | Water-soluble polymer (c) | 15 |
| Cyan color forming layer | Lime-processed gelatin | 842 | Lime-processed gelatin | 598 |
| | Emulsion A-1r (based on silver) | 550 | Emulsion A-1r (based on silver) | 588 |

TABLE 1-continued

| | Photosensitive Material (Sample No. 101) | | Photosensitive Material (Sample No. 102) | |
|---|---|---|---|---|
| | Ingredient | 1* | Ingredient | 1* |
| (High-speed layer) | Benzotriazole silver (based on silver) | 165 | Benzotriazole silver (based on silver) | 87 |
| | Silver salt of 1-phenyl-5-mercaptotetrazole | 437 | 1-Dodecyl-5-mercaptotetra-zole | 7 |
| | Cyan coupler (CPC-1) | 19 | Cyan coupler (CPC-1) | 19 |
| | Cyan coupler (CPC-2) | 44 | Cyan coupler (CPC-2) | 44 |
| | DEVP-1X | 91 | DEVP-2X | 205 |
| | Development accelerator (X) | 6.2 | | |
| | High-boiling organic solvent (e) | 70 | High-boiling organic solvent (e) | 62 |
| | Surfactant (g) | 5 | Surfactant (g) | 8 |
| | Salicylanilide | 80 | Salicylanilide | 120 |
| | Water-soluble polymer (c) | 18 | Water-soluble polymer (c) | 9 |
| Cyan color forming layer (Medium-speed layer) | Lime-processed gelatin | 475 | Lime-processed gelatin | 385 |
| | Emulsion A-2r (based on silver) | 600 | Emulsion A-2r (based on silver) | 516 |
| | Benzotriazole silver (based on silver) | 180 | Benzotriazole silver (based on silver) | 103 |
| | Silver salt of 1-phenyl-5-mercaptotetrazole | 477 | 1-Dodecyl-5-mercaptotetrazole | 8 |
| | Cyan coupler (CPC-3) | 56 | Cyan coupler (CPC-3) | 39 |
| | Cyan coupler (CPC-4) | 131 | Cyan coupler (CPC-4) | 92 |
| | DEVP-1X | 209 | DEVP-2X | 240 |
| | Development accelerator (X) | 18.7 | | |
| | High-boiling organic solvent (e) | 209 | High-boiling organic solvent (e) | 129 |
| | Surfactant (g) | 10 | Surfactant (g) | 16 |
| | Salicylanilide | 50 | Salicylanilide | 141 |
| | Water-soluble polymer (c) | 15 | Water-soluble polymer (c) | 16 |
| Cyan color forming layer (Low-speed layer) | Lime-processed gelatin | 825 | Lime-processed gelatin | 538 |
| | Emulsion A-3r (based on silver) | 300 | Emulsion A-3r (based on silver) | 328 |
| | Benzotriazole silver (based on silver) | 90 | Benzotriazole silver (based on silver) | 69 |
| | Silver salt of 1-phenyl-5-mercaptotetrazole | 239 | 1-Dodecyl-5-mercaptotetrazole | 6 |
| | Cyan coupler (CPC-3) | 99 | Cyan coupler (CPC-4) | 211 |
| | Cyan coupler (CPC-4) | 234 | DEVP-2XXX | 162 |
| | DEVP-1X | 373 | High-boiling organic solvent (e) | 209 |
| | Development accelerator (X) | 33.2 | | |
| | High-boiling organic solvent (e) | 372 | Surfactant (g) | 26 |
| | Surfactant (g) | 17 | Salicylanilide | 95 |
| | Salicylanilide | 100 | Water-soluble polymer (c) | 6 |
| | Water-soluble polymer (c) | 10 | | |
| Interlayer | Lime-processed gelatin | 850 | Lime-processed gelatin | 883 |
| | | | Surfactant(b) | 59 |
| | | | Salicylanilide | 589 |
| | Water soluble polymer (c) | 15 | Water soluble polymer (c) | 24 |

TABLE 1-continued

| | Photosensitive Material (Sample No. 101) | | Photosensitive Material (Sample No. 102) | |
|---|---|---|---|---|
| | Ingredient | 1* | Ingredient | 1* |
| Antihalation layer | Lime-processed gelatin | 2194 | Lime-processed gelatin | 2194 |
| | Latex E-13 | 1144 | Latex E-13 | 1144 |
| | Leuco dye (L3) | 151 | Leuco dye (L3) | 151 |
| | Developer (SD-1) | 151 | Developer (SD-1) | 151 |
| | Color image stabilizer (HP-1) | 301 | Color image stabilizer (HP-1) | 301 |
| | Surfactant (b) | 19 | Surfactant (b) | 19 |
| | Water-soluble polymer (c) | 15 | Water-soluble polymer (c) | 15 |
| | Transparent PEN base (96 μm) | | | |

Note:
1* means an amount used.
Surfactant (a)

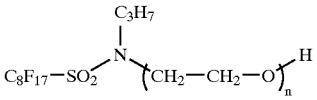

n = 14–16

Surfactant (b)

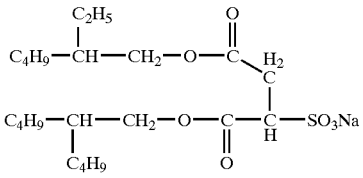

Water-soluble Polymer (c)

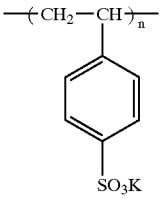

Hardener (t)

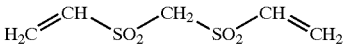

Formaldehyde Scavenger (d)

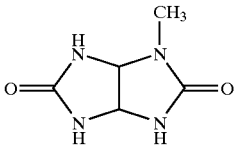

Surfactant (g)
Alkanol XC

Photosensitive materials according to the invention, Sample Nos. 103 and 104, were prepared in the same manners as Sample Nos. 101 and 102 respectively, except that the high boiling organic solvent (e) used in the coupler emulsions was replaced by the present water-insoluble Polymer P-4 as the contents thereof in the corresponding emulsions were adjusted to the same value on a coverage basis.

Sample pieces were cut from each of these photosensitive materials, Sample Nos. 101 to 104, and subjected to contact exposure using X rays via 10 μm slits. After exposure, the photosensitive materials, Sample No. 101 to Sample No. 104, were each heat-developed at 150° C. for 15 seconds by the use of a heat drum.

Each sample was immersed in 25° C. Super Fuji Fix for 5 minutes, and then rinsed for 10 minutes with running water of ambient temperature to remove silver.

By observation of color images in the areas exposed to X rays under an optical microscope, it was found that the color images in the comparative Samples, Sample No. 101 and Sample No. 102, had line widths 3–5 μm greater than 10 μm, but the increase in line width was smaller than 2 μm in the present cases where the couplers were co-emulsified by the use of the present water-insoluble polymer, namely reduction in dye bleed was achieved.

Each of the photosensitive materials, Sample No. 101 to Sample No. 104, was cut into strips of a 135 negative film size, perforated, and loaded in cameras. Portraits and photographs of Macbeth Chart were taken with these cameras, and subjected to heat development in the foregoing manner. The images in the thus processed materials were each read with a digital image reader, Frontier SP-100 (made by Fuji Photo Film Co., Ltd.), subjected to image processing on a work station, and then output to a heat-development type of printer (PICTROGRAPHY 3000, made by Fuji Photo Film Co., Ltd.).

Therein, color correction processing for raising saturation while maintaining color reproducibility by digital signal processing was performed utilizing the Macbeth Chart included in the images. As a result, the prints obtained had high saturation as well as high developed-color densities, high sensitivities and excellent discrimination. However, the images obtained from the comparative photosensitive materials, Sample Nos. 101 and 102, was poor in sharpness and looked more or less blurred. On the other hand, Sample No. 103 and Sample No. 104 using the present water-insoluble polymer provided images of high sharpness.

After they were allowed to stand for 3 weeks under the condition of 50° C.-60% RH, the photosensitive materials, Sample Nos. 101 to 104, were each examined for color bleed by the foregoing X-ray slit exposure. It was shown from the examination results that the line width increase in the areas exposed to X rays was smaller than 2 μm in the present photosensitive materials, Samples Nos. 103 and 104, even after the aging test, while it was from 5 to 7 μm in the comparative photosensitive materials, Samples Nos. 101 and 102, after the aging test and the dye bleed was further increased by the aging.

As mentioned above in detail, the present water-insoluble polymers enable highly sharp color images to be formed without attended by dye bleed in the process of heat development. Therefore, the photosensitive materials according to the invention are very useful as silver halide color photographic materials. Further, the present heat-developable photosensitive materials have sufficient raw-stock storability (or storage stability before practical use).

While the invention has been described in detail and with reference to specific embodiments thereof, it will be apparent to one skilled in the art that various changes and modifications can be made therein without departing from the spirit and scope thereof.

What is claimed is:

1. A mono-sheet, heat-developable color photosensitive material comprising a support having provided thereon at least a light-sensitive silver halide, a color developing agent or a precursor thereof, dye-forming couplers capable of forming dyes by reacting with an oxidation product of the color developing agent, a reducible silver salt, a thermal solvent and a binder, wherein a water-insoluble thermoplastic polymer prepared by polymerizing at least one monomer is included in layers containing the dye-forming couplers, said photosensitive material is a mono-sheet heat-developable color photosensitive material.

2. The heat-developable color photosensitive material as described in claim 1, wherein the thermal solvent is a water-insoluble solvent and contained as a solid microcrystalline dispersion.

3. The heat-developable color photosensitive material as described in claim 1 or 2, wherein the water-insoluble thermoplastic polymer contains at least one of aromatic group-containing monomer units as constituents thereof.

4. The heat-developable color photosensitive material as described in claim 1, wherein the thermal solvent has a water solubility of 1 $g/m^3$ or below.

5. The heat-developable color photosensitive material as described in claim 1, wherein the thermal solvent has a melting temperature of from 90° C. to the temperature chosen for development processing.

6. The heat-developable color photosensitive material as described in claim 1, wherein the thermal solvent is used in an amount of from 1 to 200 weight % of the binder coverage.

7. The heat-developable color photosensitive material as described in claim 3, wherein the water-insoluble thermoplastic polymer has a molecular weight of 10,000 or less.

8. The heat-developable color photosensitive material as described in claim 3, wherein the water-insoluble thermoplastic polymer is a polymer containing monomer units derived from at least one of styrene, α-methylstyrene and β-methylstyrene as constituents thereof.

9. The heat-developable color photosensitive material as described in claim 7, wherein the water-insoluble thermoplastic polymer is a polymer containing monomer units derived from at least one of styrene, α-methylstyrene and β-methylstyrene as constituents thereof.

10. The heat-developable color photosensitive material as described in claim 1, wherein the water-insoluble thermoplastic polymer is used in an amount of from 1 to 1,000% by weight based on the dye-forming coupler incorporated in the same layer.

11. The heat-developable color photosensitive material as described in claim 1, wherein the water-insoluble thermoplastic polymer is introduced as the same emulsions as the couplers.

* * * * *